US011590756B2

(12) United States Patent
Tanaka et al.

(10) Patent No.: US 11,590,756 B2
(45) Date of Patent: Feb. 28, 2023

(54) LIQUID DISCHARGE APPARATUS

(71) Applicant: BROTHER KOGYO KABUSHIKI KAISHA, Nagoya (JP)

(72) Inventors: Mitsugi Tanaka, Nagoya (JP); Yoshikazu Shimizu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/121,907

(22) Filed: Dec. 15, 2020

(65) Prior Publication Data

US 2021/0178766 A1 Jun. 17, 2021

(30) Foreign Application Priority Data

Dec. 16, 2019 (JP) ..... JP2019-226254

(51) Int. Cl.
*B41J 2/165* (2006.01)

(52) U.S. Cl.
CPC ..... *B41J 2/16585* (2013.01); *B41J 2/16508* (2013.01); *B41J 2/16535* (2013.01); *B41J 2/16538* (2013.01); *B41J 2/16547* (2013.01)

(58) Field of Classification Search
CPC .... B41J 2/16585; B41J 2/165; B41J 2/16535; B41J 2/16538; B41J 2/16547
See application file for complete search history.

(56) References Cited

U.S. PATENT DOCUMENTS 7,354,134 B2 * 4/2008 Okamoto ..... B41J 2/16523 347/35

FOREIGN PATENT DOCUMENTS

| | | |
|---|---|---|
| JP | 2004-237462 A | 8/2004 |
| JP | 2008-055733 A | 3/2008 |
| JP | 2011-183768 A | 9/2011 |
| JP | 2017-100383 A | 6/2017 |

* cited by examiner

*Primary Examiner* — Geoffrey S Mruk
(74) *Attorney, Agent, or Firm* — Scully, Scott, Murphy & Presser, PC

(57) ABSTRACT

A liquid discharge apparatus is provided, which comprises a conveyor, a support member which supports a medium existing in a conveying passage, a head, a maintenance mechanism which has a wiper, and a wiper cleaner. The maintenance mechanism is opposed to a nozzle surface of the head and movable to a wiping position at which the wiper abuts against the nozzle surface and a cleaning position at which the wiper abuts against the wiper cleaner. The wiper cleaner is disposed at a position at which a part thereof is overlapped with the support member in a direction orthogonal to the nozzle surface under or below the support member.

10 Claims, 25 Drawing Sheets

LIQUID DISCHARGE APPARATUS

CROSS REFERENCE TO RELATED APPLICATION

The present application claims priority from Japanese Patent Application No. 2019-226254, filed on Dec. 16, 2019, the disclosure of which is incorporated herein by reference in its entirety.

BACKGROUND

Field of the Invention

The present disclosure relates to a liquid discharge apparatus for discharging a liquid from nozzles of a head to a medium.

Description of the Related Art

A liquid discharge apparatus is known, which discharges a liquid to a medium from nozzles formed on a nozzle surface of a head. In the case of an ink-jet recording apparatus as an example of the liquid discharge apparatus, the maintenance is executed for the head when the printing is not executed on the medium. So-called unsubstantial discharge, in which inks are forcibly discharged from nozzles, is executed as an example of the maintenance.

The nozzle surface of the head, which has been subjected to the unsubstantial discharge executed in the maintenance, is wiped out by a wiper. The wiper wipes out the ink adhered to the nozzle surface by making relative movement while abutting against the nozzle surface of the head. The ink, which adheres to the wiper, is cleaned by a wiper cleaner.

SUMMARY

Usually, the wiper cleaner is arranged in the vicinity of the wiper. For example, in the case of a known ink-jet printer, a printing head apparatus, on which a head is carried, is provided with a wiper cleaner. Further, in the case of another known recording apparatus, a wiper cleaner is arranged adjacently aside a head.

The head is the portion for performing the printing on the medium in the ink-jet recording apparatus. Therefore, various members are arranged around the head. On this account, as described above, when the wiper cleaner is arranged in the vicinity of the head, it is necessary to provide a space for arranging the wiper cleaner in the vicinity of the head. If the various members, which are to be arranged closely to the head as described above, are arranged separately from the head in order to secure the space, the ink-jet recording apparatus is consequently large-sized.

The present disclosure has been made taking the foregoing circumstances into consideration, an object of which is to provide a liquid discharge apparatus which makes it possible to suppress any large size by arranging a wiper cleaner just under a member for supporting a medium.

According to an aspect of the present disclosure, there is provided a liquid discharge apparatus including: a conveyor configured to convey a medium; a support member defining a part of a conveying passage for allowing the medium conveyed by the conveyor to pass therethrough and which supports the medium existing in the conveying passage; a head including a nozzle surface on which a nozzle is opened; a maintenance mechanism including a wiper for the nozzle surface; and a wiper cleaner configured to clean the wiper.

The maintenance mechanism is movable to a wiping position and a cleaning position. The wiping position is a position at which the maintenance mechanism faces the nozzle surface of the head and the wiper makes contact with the nozzle surface. The cleaning position is a position at which the wiper makes contact with the wiper cleaner. The wiper cleaner is disposed at a position at which a part of the wiper cleaner is overlapped with the support member in a direction orthogonal to the nozzle surface under or below the support member.

According to the configuration as described above, the wiper cleaner is arranged at the position at which at least the part thereof is overlapped with the support member in the direction orthogonal to the nozzle surface under or below the support member, without being arranged in the vicinity of the head. Therefore, it is unnecessary to provide any space for arranging the wiper cleaner in the vicinity of the head.

BRIEF DESCRIPTION OF THE DRAWINGS

FIGS. 22A and 22B depict a sectional view schematically illustrating the maintenance mechanism 60 and the wiper cleaning mechanism 80, wherein FIG. 22A depicts a state in which the maintenance mechanism 60 is disposed at the waiting position, and FIG. 22B depicts a state in which projections 159, 160 abut against first cam surfaces 171.

FIGS. 23A and 23B depict a sectional view schematically illustrating the maintenance mechanism 60 and the wiper cleaning mechanism 80, wherein FIG. 23A depicts a state in which the maintenance mechanism 60 is disposed at the cleaning start position, and FIG. 23B depicts a state in which the maintenance mechanism 60 is disposed at the cleaning termination position.

FIGS. 24A and 24B depicts a sectional view schematically illustrating the maintenance mechanism 60 and the wiper cleaning mechanism 80, wherein FIG. 24A depicts a state in which the projections 159, 160 are positioned in front of protrusions 168, 169 respectively, and FIG. 24B depicts a state in which the projections 159, 160 abut against third cam surfaces 173.

DESCRIPTION OF THE PREFERRED EMBODIMENTS

Figure 1:
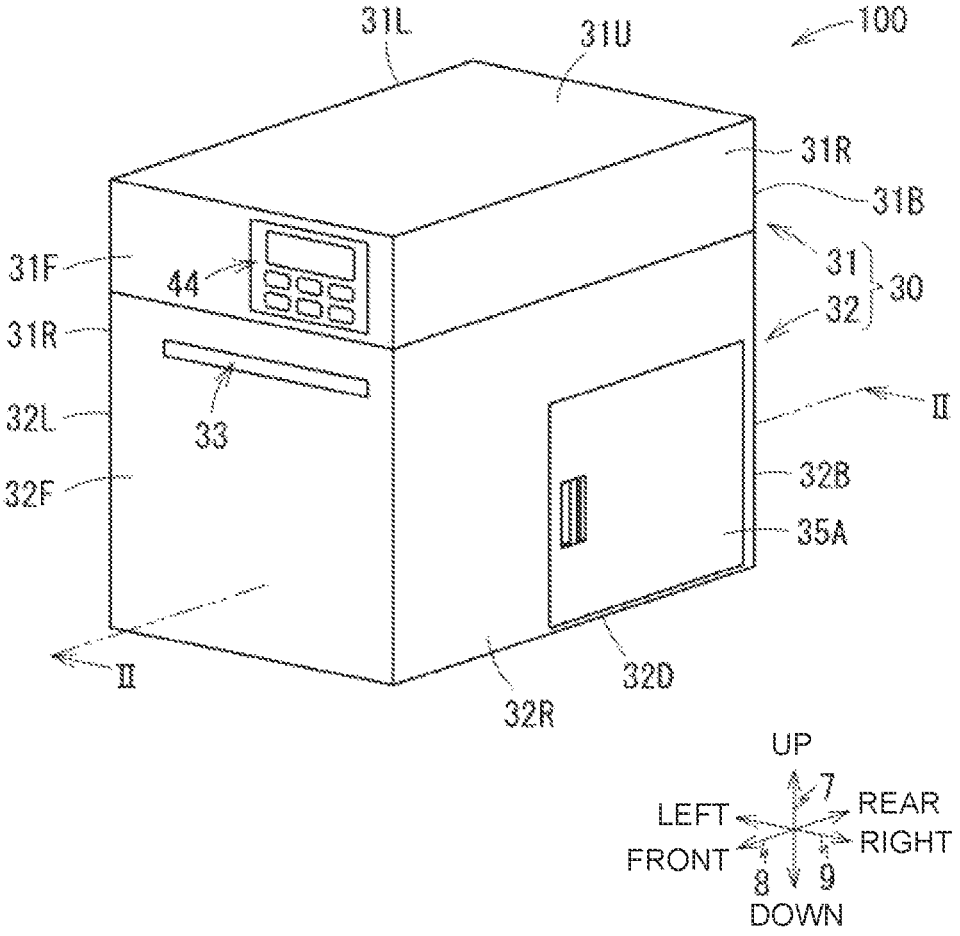
FIG. 1 depicts a perspective view illustrating an appearance of an image recording apparatus 100.

An image recording apparatus 100 according to an embodiment of the present disclosure will be explained below. Note that the embodiment explained below is merely an example of the present disclosure, and it goes without saying that the embodiment can be appropriately changed within a range without changing the gist or essential characteristics of the present disclosure. Further, in the following explanation, the upward-downward direction 7 is defined on the basis of a state (state depicted in FIG. 1) in which the image recording apparatus 100 is usably installed. The front-back direction 8 is defined assuming that the side, on which a discharge port 33 is provided, is designated as the front side (front surface). The left-right direction 9 is defined while the image recording apparatus 100 is viewed from the front side (front surface). Note that in this specification, the end portion of the rotating object, which is disposed on the side opposite to the rotation shaft in the radius vector direction of the rotation, is referred to as "rotation forward end", and the end portion, which is disposed on the side near to the rotation shaft in the radius vector direction of the rotation, is referred to as "rotation proximal end".

<Appearance Configuration of Image Recording Apparatus 100>

Figure 2:
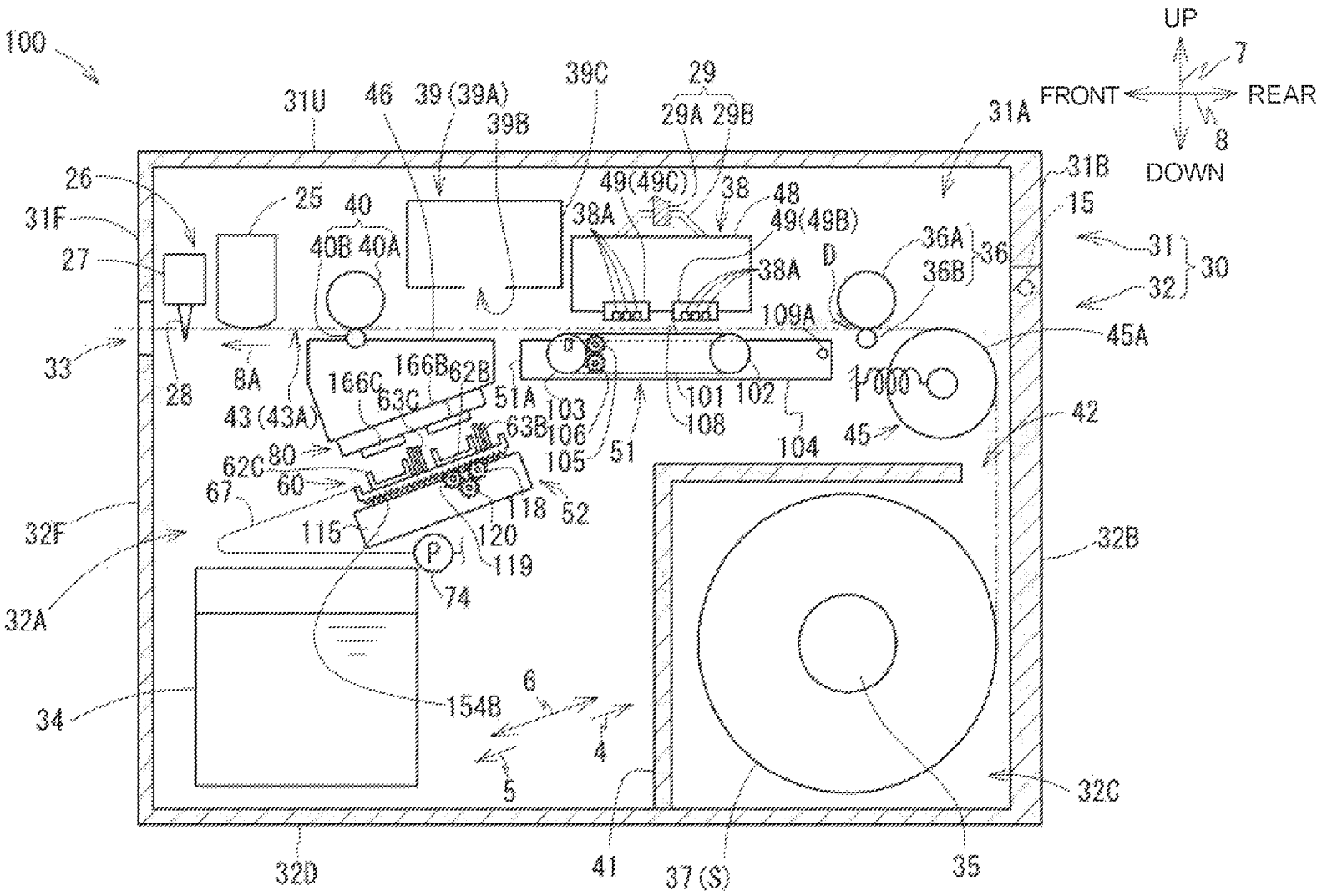
FIG. 2 depicts a sectional view illustrating a cross section taken along II-II depicted in FIG. 1, depicting a state in which a head 38 is disposed at the recording position, a first support mechanism 51 is disposed at the first rotation position, and a maintenance mechanism 60 is disposed at the waiting position.

In the image recording apparatus 100 depicted in FIG. 1 (example of the liquid discharge apparatus), an image is recorded in accordance with the ink-jet recording system on a sheet S (example of the medium) which forms a roll member 37 (see FIG. 2).

As depicted in FIG. 1, the image recording apparatus 100 is provided with a casing 30. The casing 30 is provided with an upper casing 31 and a lower casing 32. The upper casing 30 and the lower casing 32 generally have rectangular parallelepiped shapes as a whole, each of which has a size capable of being placed on a desk. That is, the image recording apparatus 100 is suitable for the use of being placed on a desk. Of course, the image recording apparatus 100 may be used while being placed on a floor or a rack.

As depicted in FIG. 2, the upper casing 31 has a right surface 31R, a left surface 31L, an upper surface 31U, a front surface 31F, and back surface 31B. Accordingly, the internal space 31A of the upper casing 31 (see FIG. 2) is comparted from the outside. The right surface 31R and the left surface 31L are positioned while being separated from each other in the left-right direction 9. The upper surface 31U connects the upper end of the right surface 31R and the upper end of the left surface 31L. The front surface 31F and the back surface 31B are positioned while being separated from each other in the front-back direction 8.

The lower casing 32 has a right surface 32R, a left surface 32L, a lower surface 32D, a front surface 32F, and a back surface 32B. Accordingly, the internal space 32A of the lower casing 32 (see FIG. 2) is comparted from the outside. The right surface 32R and the left surface 32L are positioned while being separated from each other in the left-right direction 9. The lower surface 32D connects the lower end of the right surface 32R and the lower end of the left surface 32L. The front surface 32F and the back surface 32B are positioned while being separated from each other in the front-back direction 8.

Figure 3:
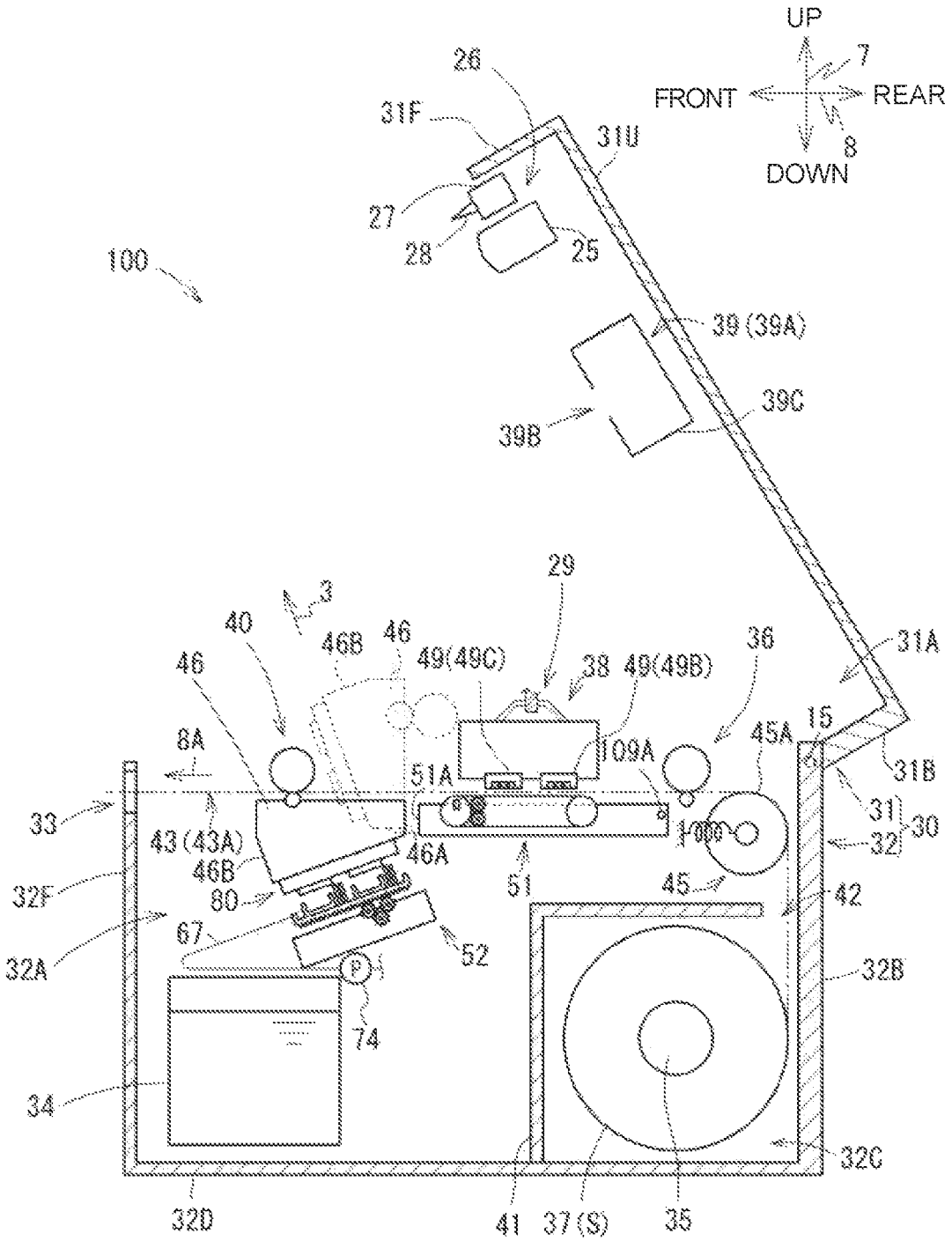
FIG. 3 depicts a sectional view illustrating a state in which an upper casing 31 is disposed at the open position in relation to FIG. 2.

As depicted in FIGS. 2 and 3, the upper casing 31 is rotatably supported by the lower casing 32. The upper casing 31 is rotatable to the closed position depicted in FIG. 2 and the open position depicted in FIG. 3 about a rotation shaft 15 which is provided at the back lower end portion and which extends in the left-right direction 9. Note that the configuration, which allows the upper casing 31 to rotate, is not limited to the configuration based on the rotation shaft 15. It is also allowable to cause the rotation, for example, by means of a hinge.

As depicted in FIG. 2, when the upper casing 31 is disposed at the closed position, the internal space 31A of the upper casing 31 and the internal space 32A of the lower casing 32 are shut off with respect to the outside. As depicted in FIG. 3, when the upper casing 31 is disposed at the open position, the internal space 31A of the upper casing 31 and the internal space 32A of the lower casing 32 are exposed to the outside.

As depicted in FIG. 1, a slit-shaped discharge port 33, which is long in the left-right direction 9, is formed on the front surface 32F of the lower casing 32. The sheet S (see FIG. 2), on which the image has been recorded, is discharged from the discharge port 33.

An operation panel 44 is provided on the front surface 31F of the upper casing 31. A user performs the input by means of the operation panel 44 in order that the image recording apparatus 100 is operated and/or various settings are confirmed and decided.

[Internal Structure of Image Recording Apparatus 100]

As depicted in FIG. 2, those arranged in the internal spaces 31A, 32A are a holder 35, a tensioner 45, a conveying roller pair 36, a conveying roller pair 40, a head 38, a first support mechanism 51 (example of the support mechanism), a fixing unit 39, a support member 46, a second support mechanism 52, CIS 25, a cutter unit 26, a tank 34, a maintenance mechanism 60, and a wiper cleaning mechanism 80. Although not depicted in FIG. 2, a controller 130 is arranged in the internal space 32A (see FIG. 17). The controller 130 controls the operation of the image recording apparatus 100.

A partition wall 41 is provided in the internal space 32A. The partition wall 41 partitions the back lower portion of the internal space 32A to compart a sheet accommodating space 32C. The sheet accommodating space 32C is the space which is surrounded by the partition wall 41 and the lower casing 32 (specifically the back surface 32B, the lower surface 32D, the right surface 32R, and the left surface 32L) and which is isolated, for example, from the head 38.

The roll member 37 is accommodated in the sheet accommodating space 32C. The roll member 37 has a core tube and the lengthy sheet S. The sheet S is wound around the core tube in a roll form in the circumferential direction of the axial center of the core tube. The sheet S can have the width (from the minimum width to the maximum width) at which the image recording apparatus 100 can record the image. That is, a plurality of types of roll members 37 having different widths can be accommodated in the sheet accommodating space 32C. Note that it is also allowable that the roll member 37 does not have the core tube, and the sheet S is wound in a roll form so that the sheet S can be installed to the holder 35. Further, it is also allowable that fan-fold paper and cut paper can be accommodated in the sheet accommodating space 32C.

As depicted in FIG. 2, the holder 35, which extends in the left-right direction 9, is positioned in the sheet accommodating space 32C. One type of the roll member 37, which is selected from the plurality of types, can be installed to the holder 35. Upon the installation, the holder 35 supports the roll member 37 so that the axial center of the core tube of the roll member 37 extends in the left-right direction 9 and the roll member 37 is rotatable about the axial center in the circumferential direction. Further, the center in the widthwise direction of the sheet S is positioned at the center in the left-right direction 9 of a conveying passage 43 (hereinafter referred to as "paper passing center" as well). The holder 35 is rotated by the driving force transmitted from a conveying motor 53 (see FIG. 17). The roll member 37, which is supported by the holder 35, is also rotated in accordance with the rotation of the holder 35. Note that as depicted in FIG. 1, a right cover 35A is positioned on the right surface 32R of the lower casing 32. The holder 35 and other components, which are positioned in the sheet accommodating space 32C, are exposed or shut off in accordance with the opening/closing operation of the right cover 35A.

As depicted in FIG. 2, the sheet accommodating space 32C is open toward the upward at the back portion. In particular, a gap 42 is formed between the partition wall 41 and the back surface 32B, i.e., over or above the back end of the roll member 37. The sheet S is pulled out upwardly from the back end of the roll member 37 in accordance with the rotation of the conveying roller pairs 36, 40, and the sheet S is guided to the tensioner 45 via the gap 42.

The tensioner 45 is positioned over or above the partition wall 41 at the back portion of the internal space 32A. The tensioner 45 has the outer circumferential surface 45A which is directed to the outside of the lower casing 32. The outer circumferential surface 45A has the size which is not less than the maximum width of the sheet in the left-right direction 9, and the outer circumferential surface 45A has the shape which is mutually symmetrical with respect to the paper passing center. The upper end of the outer circumferential surface 45A is disposed at approximately the same vertical position as that of the nip D of the conveying roller pair 36 in the upward-downward direction 7.

The sheet S, which is pulled out from the roll member 37, is applied to the outer circumferential surface 45A, and the sheet S abuts thereagainst. The sheet S is curved frontwardly along the outer circumferential surface 45A. The sheet S extends in the conveyance direction 8A, and the sheet S is guided by the conveying roller pair 36. The conveyance direction 8A is the frontward orientation extending in the front-back direction 8. The tensioner 45 gives the tension to the sheet S by means of any well-known technique.

Note that as for the tensioner 45, the present disclosure is not limited to the configuration depicted in FIG. 2, i.e., the configuration in which the backward urging force is applied to the roller by means of any urging member such as a spring or the like. It is also allowable to apply any other well-known technique.

The conveying roller pair 36 is positioned in front of the tensioner 45, the conveying roller pair 36 has a conveying roller 36A and a pinch roller 36B. The conveying roller 36A and the pinch roller 36B mutually abut at approximately the same vertical position as that of the upper end of the outer circumferential surface 45A to form the nip D.

The conveying roller pair 40 is positioned in front of the conveying roller pair 36. The conveying roller pair 40 has a conveying roller 40A and a pinch roller 40B. The conveying roller 40A and the pinch roller 40B mutually abut at approximately the same vertical position as that of the upper end of the outer circumferential surface 45A to form the nip.

Figure 17:
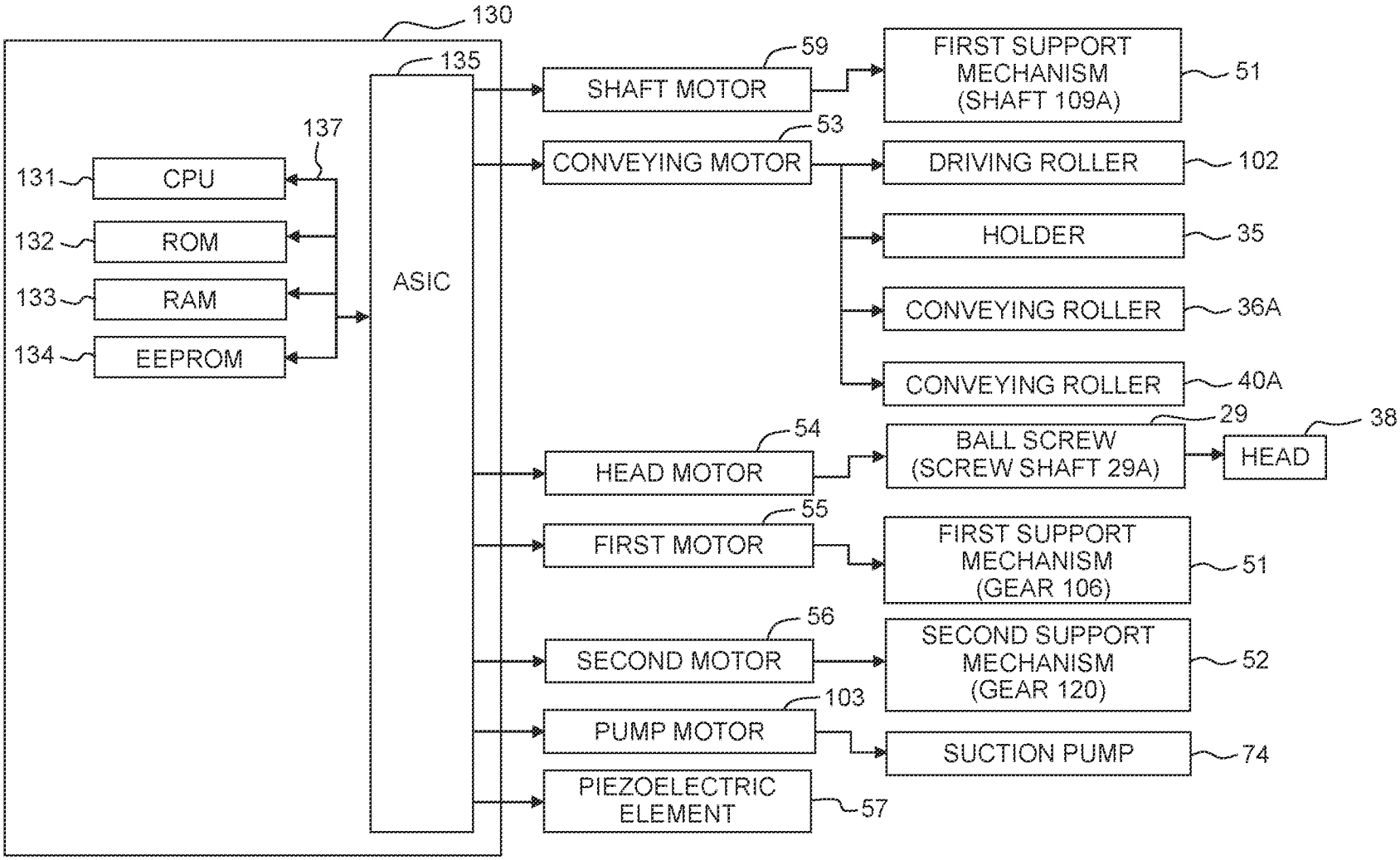
FIG. 17 depicts a block diagram of the image recording apparatus 100.

The conveying rollers 36A, 40A are rotated by the driving force transmitted from the conveying motor 53 (see FIG. 17). The conveying roller pair 36 is rotated while nipping the sheet S which extends in the conveyance direction 8A from the tensioner 45, and thus the conveying roller pair 36 feeds the sheet S in the conveyance direction 8A extending along a conveying surface 43A. The conveying roller pair 40 is rotated while nipping the sheet S which is fed from the conveying roller pair 36, and thus the conveying roller pair 40 feeds the sheet S in the conveyance direction 8A. Further, the sheet S is pulled out from the sheet accommodating space 32C via the gap 42 toward the tensioner 45 in accordance with the rotation of the conveying roller pairs 36, 40.

As depicted in FIG. 2, the conveying passage 43, which extends from the upper end of the outer circumferential surface 45A and arrives at the discharge port 33, is formed in the internal space 32A. The conveying passage 43 extends substantially linearly (in a straight form) in the conveyance direction 8A, and the conveying passage 43 is the space through which the sheet S can pass. In particular, the conveying passage 43 expands in the conveyance direction 8A and in the left-right direction 9, and the conveying passage 43 extends along the conveying surface 43A which is long in the conveyance direction 8A. Note that in FIG. 2, the conveying surface 43A is depicted by a two-dot chain line which indicates the conveying passage 43. The conveying passage 43 is comparted, for example, by guide members (not depicted) which are positioned separately in the upward-downward direction 7, the head 38, the conveying belt 101, the support member 46, and the fixing unit 39. That is, the head 38, the conveying belt 101, the support member 46, and the fixing unit 29 are positioned along the conveying passage 43.

The head 38 is positioned on the downstream side in the conveyance direction 8A as compared with the conveying roller pair 36 over or above the conveying passage 43. The head 38 has a plurality of nozzles 38A. The ink is discharged downwardly from the plurality of nozzles 38A toward the sheet S supported by the conveying belt 101. Accordingly, the image is recorded on the sheet S. The configuration of the head 38 will be explained in detail later on.

The first support mechanism 51 is positioned downstream in the conveyance direction 8A as compared with the conveying roller pair 36 under or below the conveying passage 43. The first support mechanism 51 is opposed to the head 38 under or below the head 38. The first support mechanism 51 has a conveying belt 101 and a support unit 104. The conveying belt 101 supports the sheet S which is conveyed in the conveyance direction 8A by the conveying roller pair 36 and which is positioned just under the head 38. The conveying belt 101 conveys the supporting sheet S in the conveyance direction 8A. The support unit 104 can support the maintenance mechanism 60. The configuration of the first support mechanism 51 will be explained in detail later on.

The fixing unit 39 is positioned downstream in the conveyance direction 8A from the head 38 over or above the conveying passage 43 and upstream in the conveying direction from the conveying roller pair 40. The fixing unit 39 is an ultraviolet radiating device having an approximately rectangular parallelepiped shape which is lengthy in the left-right direction 9. The fixing unit 39 has a casing 39A. An opening 39B, which extends in the left-right direction 9, is formed on the lower wall of the casing 39A. The fixing unit 39 radiates the ultraviolet light via the opening 39B to the sheet S and/or the ink on the sheet S which passes just under the opening 39B. In this embodiment, the ink contains a resin which is curable by the ultraviolet. Therefore, the ink, which is irradiated with the ultraviolet light, is fixed on the sheet S.

Note that the fixing unit 39 is not limited to the ultraviolet radiating device. For example, the fixing unit 39 may be a halogen heater having an approximately rectangular parallelepiped shape which is lengthy in the left-right direction 9. In this case, the fixing unit 39 radiates the infrared light via the opening 39B to heat the sheet S and/or the ink on the sheet S which passes just under the opening 39B. Accordingly, the ink is fixed to the sheet S.

The support member 46 is positioned under or below the conveying passage 43. The support member 46 is positioned downstream in the conveyance direction 8A as compared with the head 38 and the first support mechanism 51. The back portion of the support member 46 is opposed to the fixing unit 39. The front portion of the support member 46 is opposed to the conveying roller 40A. An upper surface 46U of the support member 46 faces and supports the sheet S which is conveyed in the conveyance direction 8A by the conveying belt 101 of the first support mechanism 51. The upper surface 46U corresponds to a facing surface of the present disclosure.

The support member 46 is supported rotatably about the axis or shaft (not depicted) extending in the left-right direction 9 by the lower casing 32. As depicted in FIG. 3, when the upper casing 31 is positioned at the open portion, the support member 46 is rotatable to the lodging position (falling position, an example of a first rotation position) indicated by solid lines in FIG. 3 and the upstanding position (an example of a second rotation position) indicated by broken lines in FIG. 3.

When the support member 46 is positioned at the lodging position, the rotation forward end 46B of the support member 46 is positioned frontwardly (downstream in the conveyance direction 8A) as compared with the rotation proximal end 46A. When the support member 46 is positioned at the lodging position, then the support member 46 constitutes a part of the conveying passage 43, and the support member 46 can support the sheet S which is conveyed in the conveyance direction 8A by the conveying belt 101. When the support member 46 is positioned at the upstanding position, then the rotation forward end 46B of the support member 46 is positioned upwardly as compared with when the support member 46 is positioned at the lodging position, and the maintenance mechanism 60 can be exposed to the outside.

The second support mechanism 52 is positioned under or below the support member 46. The second support mechanism 52 is fixed at the inside of the lower casing 32 by being supported by the lower casing 32. The second support mechanism 52 can support the maintenance mechanism 60. The configuration of the second support mechanism 52 will be explained in detail later on.

Note that in this embodiment, the axis or shaft of the support member 46 is provided at the back end portion of the support member 46, and the axis or shaft of the support member 46 extends in the left-right direction 9. However, the axis or shaft is not limited to the configuration as described above. For example, the axis or shaft of the support member 46 may be provided at the front end portion of the support member 46, and the axis or shaft of the support member 46 may extend in the left-right direction 9. Alternatively, for example, the axis or shaft of the support member 46 may extend in the front-back direction 8.

CIS 25 is positioned downstream in the conveyance direction 8A as compared with the conveying roller pair 40 over or above the conveying passage 43. In CIS 25, the light is radiated from the light source such as LED or the like, and the light is reflected by the sheet to provide the reflected light which is collected to a line sensor by means of a refractive index distribution (refractive index profile) type lens. Thus, an electric signal, which depends on the intensity of the reflected light received by the line sensor, is outputted. Accordingly, CIS 25 can read the image on the printing surface of the sheet. CIS 25 is arranged so that the reading line extends in the left-right direction 9.

The cutter unit 26 is positioned downstream in the conveying direction 8A as compared with CIS 25 over or above the conveying passage 43. As for the cutter unit 26, a cutter 28 is carried on a cutter carriage 27. The cutter carriage 27 is movable in the left-right direction 9 across the conveying passage 43, for example, by means of an unillustrated belt driving mechanism. The cutter 28 is positioned so that the cutter 28 traverses the conveying passage 43 in the upward-downward direction 7. The cutter 28 is moved in the left-right direction across the conveying passage 43 in accordance with the movement of the cutter carriage 27. The sheet S, which is positioned in the conveying passage 43, is cut in the left-right direction 9 in accordance with the movement of the cutter 28.

The tank 34 stores the ink. The ink is a liquid containing a pigment or the like. The ink has a viscosity which is suitable to uniformly disperse the pigment. The pigment provides the color of the ink. The ink is supplied from the tank 34 via an unillustrated tube to the head 38. As described above, the ink can contain the resin which is curable by the ultraviolet light. However, it is not necessarily indispensable that the ink contains the resin which is curable by the ultraviolet light. When the ink does not contain the resin, the fixing unit 39 is constructed by any device including, for example, a halogen heater other than the ultraviolet radiating device.

The maintenance mechanism 60 is provided to perform the maintenance for the head 38. The maintenance mechanism 60 is configured so that the maintenance mechanism 60 is movable. When the maintenance is performed for the head 38, the maintenance mechanism 60 is moved to the position disposed just under the head 38 (see FIG. 14).

Figure 14:
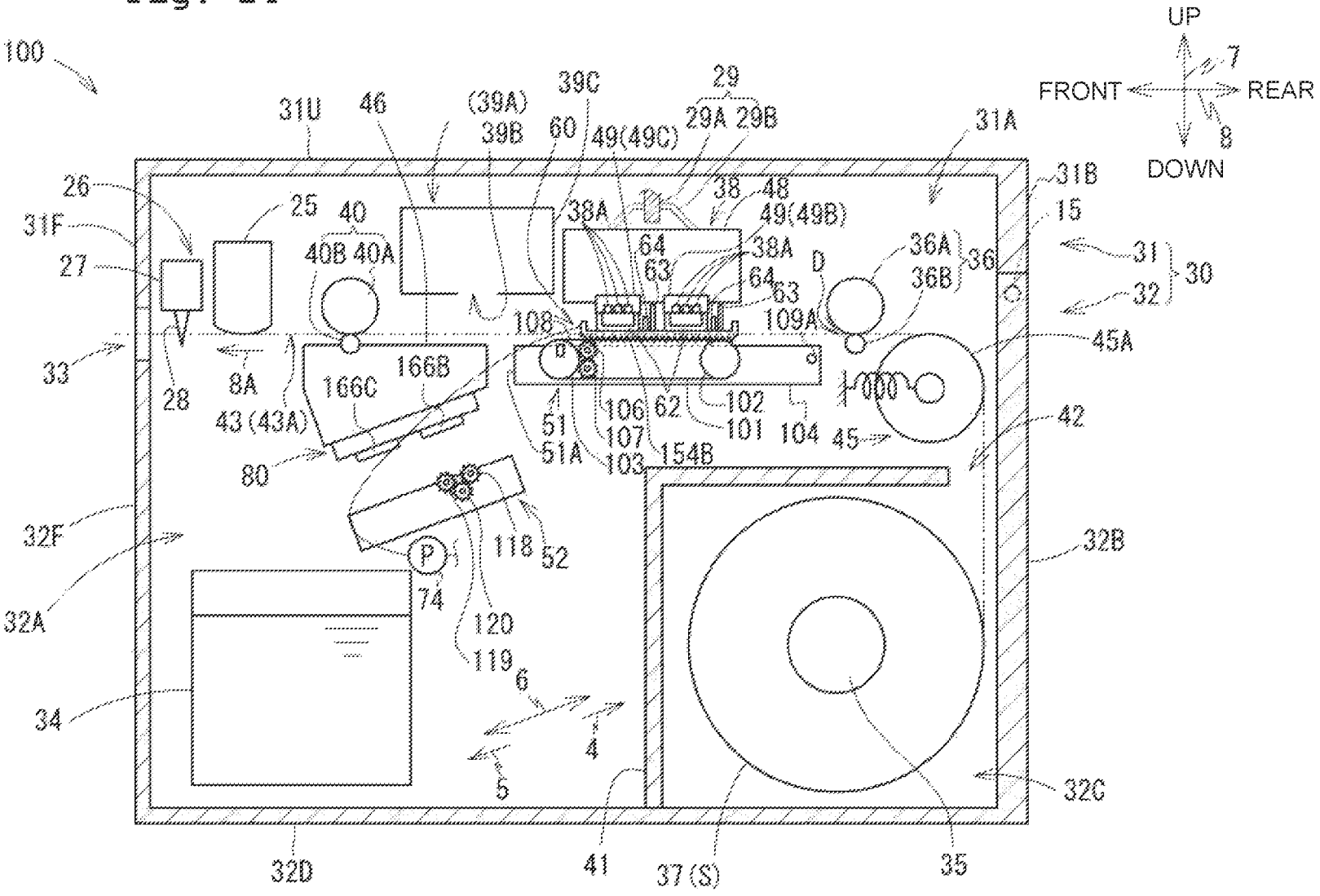
FIG. 14 depicts a sectional view illustrating a cross section taken along II-II depicted in FIG. 1, depicting a state in which the head 38 is disposed at the capping position, the first support mechanism 51 is disposed at the first rotation position, and the maintenance mechanism 60 is disposed at the maintenance position.
Figure 15:
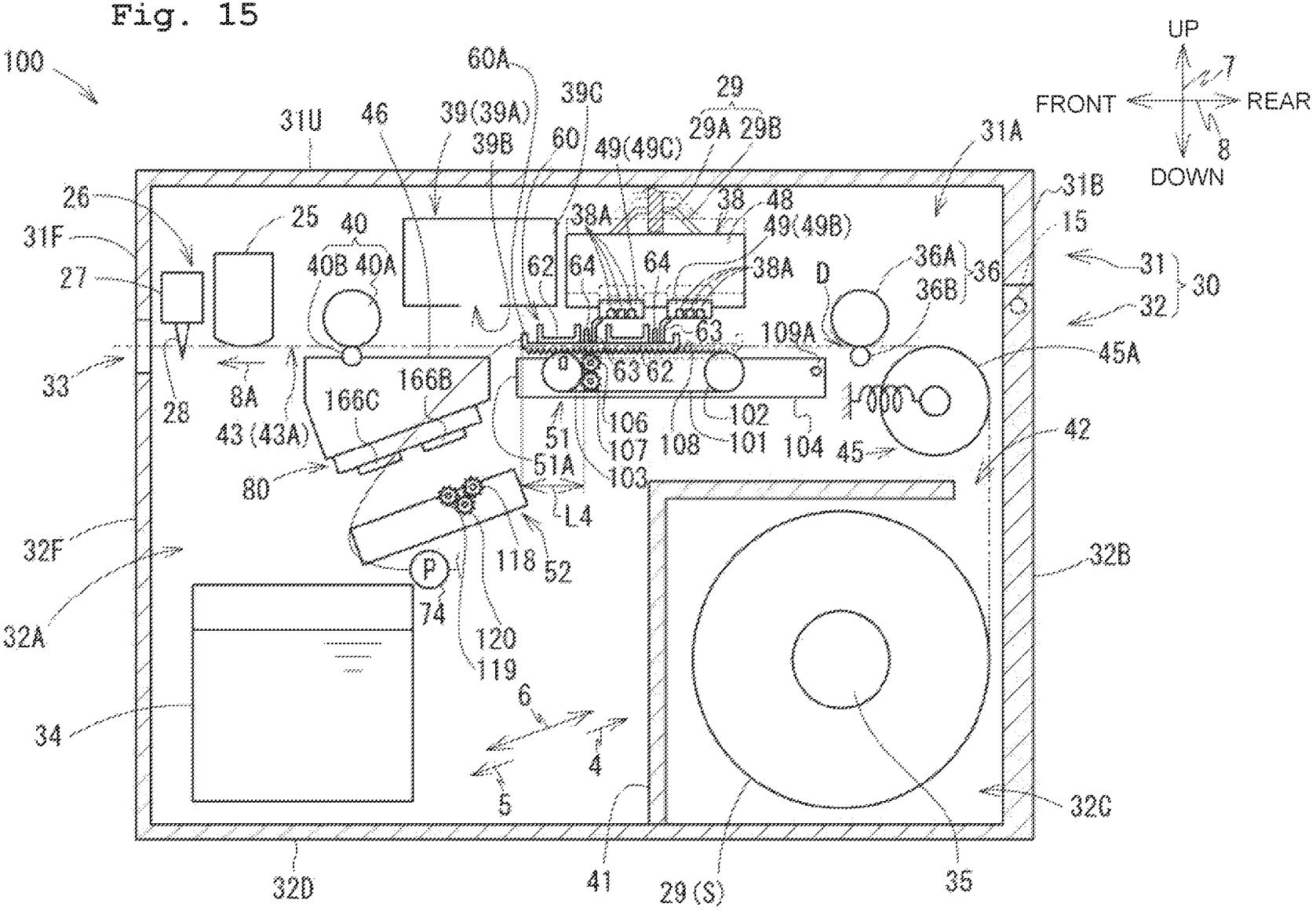
FIG. 15 depicts a sectional view illustrating a cross section taken along II-II depicted in FIG. 1, depicting a state in which the head 38 is disposed at the wiping position, the first support mechanism 51 is disposed at the first rotation position, and the maintenance mechanism 60 is disposed at the wiping position.

The maintenance for the head 38 includes, for example, the flashing process, the purge process, and the wiping process. The flashing process is the process in which the ink is discharged toward the maintenance mechanism 60 (in particular, toward a liquid receiver of the maintenance mechanism 60 as described later on). As depicted in FIG. 14, the purge process is the process in which the nozzles 38A are covered with a cap 62 of the maintenance mechanism 60 as described later on, and then the ink is sucked from the nozzles 38A by means of a suction pump 74. As depicted in FIG. 15, the wiping process is the process in which a lower surface 50 (example of the nozzle surface) of a discharge module 49 described later on of the head 38 is wiped out by means of a wiper 63 of the maintenance mechanism 60 as described later on. The configuration of the maintenance mechanism 60 will be explained in detail later on.

Figure 16:
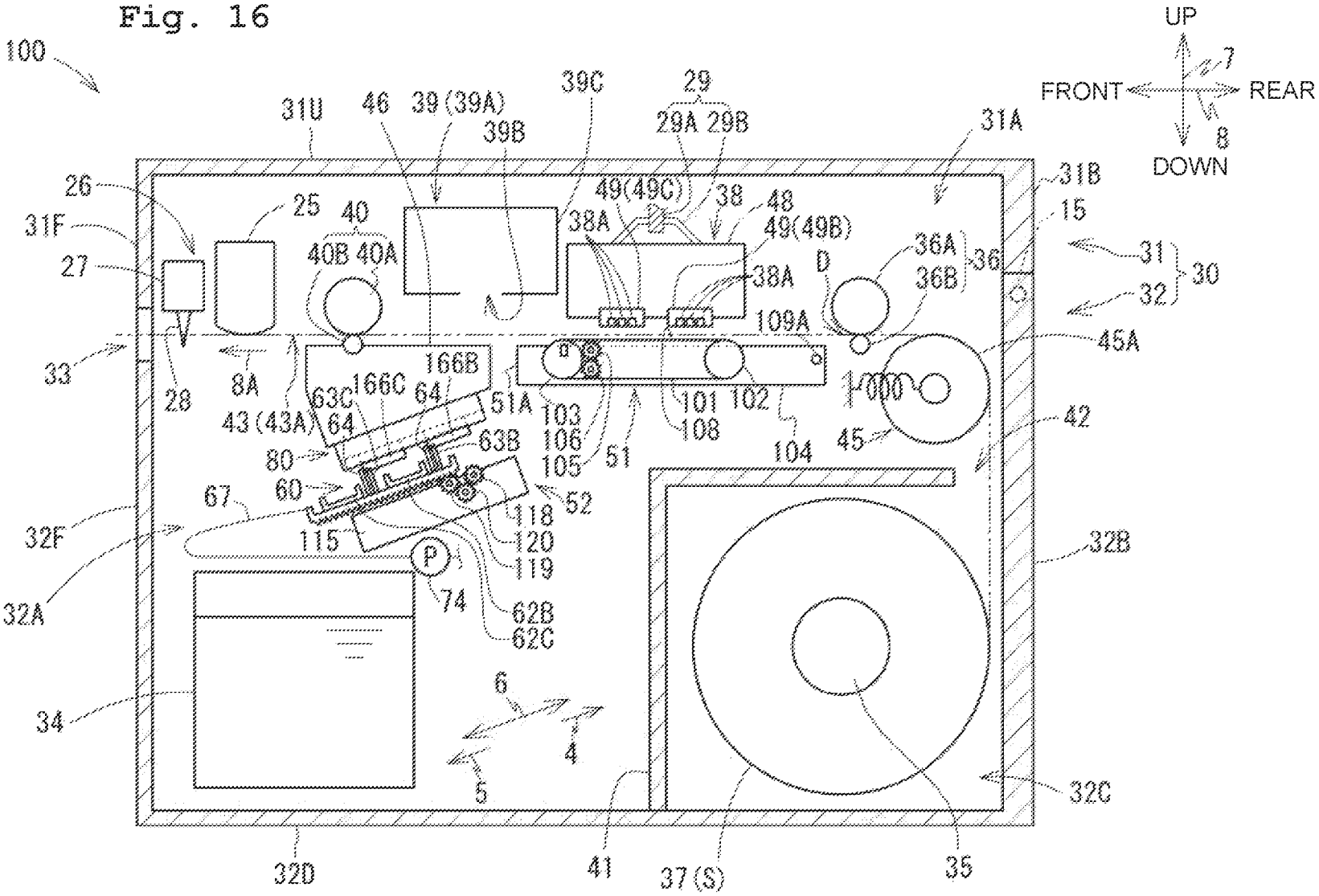
FIG. 16 depicts a sectional view illustrating a cross section taken along II-II depicted in FIG. 1, depicting a state in which the head 38 is disposed at the recording position, the first support mechanism 51 is disposed at the first rotation position, and the maintenance mechanism 60 is disposed at the cleaning termination position.

The wiper cleaning mechanism 80 is configured to clean the wiper 63 of the maintenance mechanism 60 (see FIG. 16). When the wiper 63 is cleaned, the maintenance mechanism 60 is moved to the position disposed just under the wiper cleaning mechanism 80. The configuration of the wiper cleaning mechanism 80 will be explained in detail later on.

<Head 38>

Figure 4:
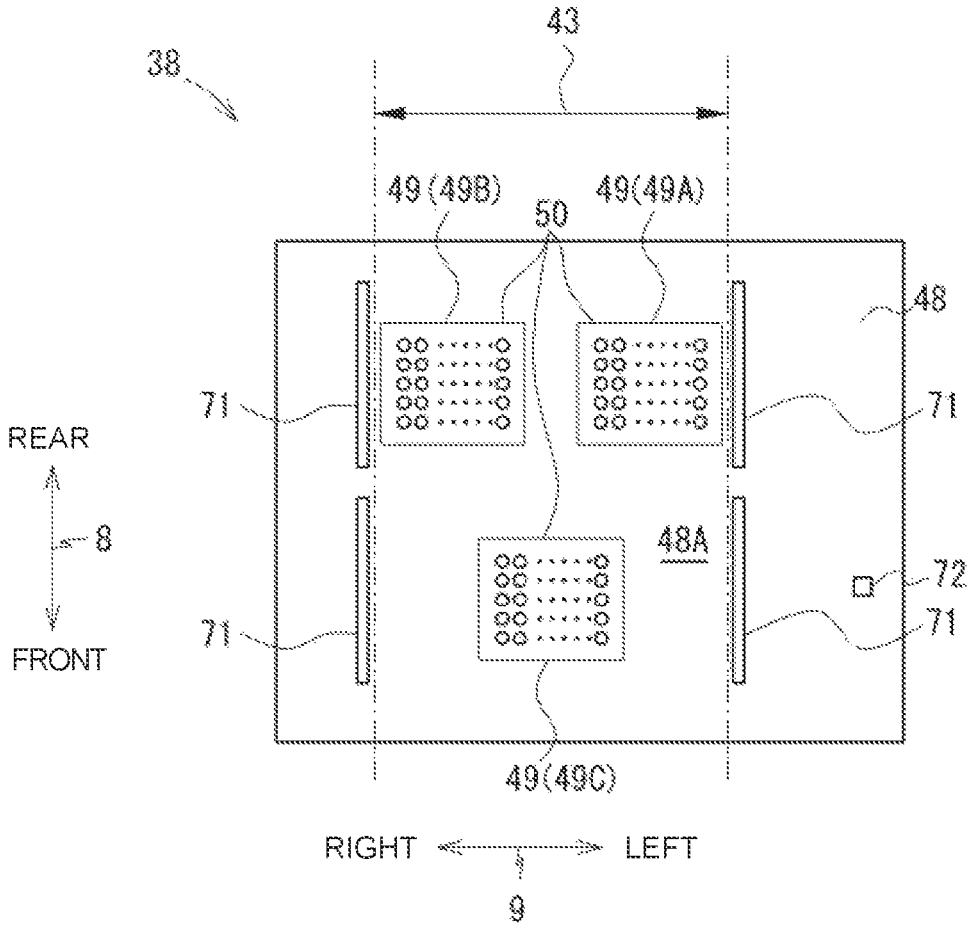
FIG. 4 depicts a bottom view illustrating the head 38.

The head 38 depicted in FIGS. 2 and 4 has an approximately rectangular parallelepiped shape which is long in the left-right direction 9. As depicted in FIGS. 2 and 4, the head 38 is provided with a frame 48, three discharge modules 49A, 49B, 49C, cams 71, and a protrusion 72. In the following description, the three discharge modules 49A, 49B, 49C are generally referred to as "discharge module 49" as well. Note that the number of discharge modules 49 is not limited to three. For example, it is also allowable that the number is one.

The frame 48 is fixed to the lower casing 32. As depicted in FIG. 4, the frame 48 is arranged to range over from the position disposed rightwardly from the conveying passage 48 to the position disposed leftwardly from the conveying passage 43.

As depicted in FIGS. 2 and 4, the discharge module 49 is supported by the frame 48. Three openings are formed on the lower surface 48A of the frame 48. The respective discharge modules 49A, 49B, 49C are arranged so that the lower surfaces thereof are positioned at the openings. Accordingly, the lower surface of the discharge module 49 is exposed downwardly. The discharge module 49 is arranged in the conveying passage 43 in the left-right direction 9.

As depicted in FIG. 4, the discharge modules 49A, 49B are arranged at the same position in the conveyance direction 8A. The discharge modules 49A 49B are arranged while being separated from each other by a spacing distance in the left-right direction 9. The discharge module 49C is arranged on the downstream side in the conveyance direction 8A as compared with the discharge modules 49A, 49B. The discharge module 49C is arranged between the two discharge modules 49A, 49B which are adjacent to one another in the left-right direction 9. The left end of the discharge module 49C is positioned leftwardly as compared with the right end of the discharge module 49A. The right end of the discharge module 49C is positioned rightwardly as compared with the left end of the discharge module 49B. In other words, the end portions of the discharge module 49C are overlapped with the end portions of the discharge modules 49A, 49B in the left-right direction 9.

Each of the discharge modules 49A, 49B, 49C is provided with the plurality of nozzles 38A. The respective nozzles 38A are open on the lower surfaces 50 of the respective discharge modules 49A, 49B, 49C. The lower surface 50 is the surface which expands in the front-back direction 8 and the left-right direction 9. As described above, the ink is discharged downwardly from the plurality of nozzles 38A toward the sheet S which is supported by the conveying belt 101 of the first support mechanism 51, and the image is recorded on the sheet S. Note that the arrangement and the number of the plurality of nozzles 38A are not limited to the arrangement and the number depicted in FIGS. 2 and 4.

As depicted in FIG. 4, the cams 71 protrude downwardly from the lower surface 48A of the frame 48. The cams 71 extend in the front-back direction 8 at the outside of the discharge module 49 in the left-right direction 9. The cams 71 can make abutment, from the upper positions, against projections 64A (see FIG. 7) of shutters 64 of the maintenance mechanism 60 described later on.

The protrusion 72 protrudes downwardly from the lower surface 48A of the frame 48. The protrusion 72 can be vertically opposed to a protrusion 158 (see FIG. 7) of the maintenance mechanism 60 described later on.

The head 38 is movable in the upward-downward direction 7 to the recording position (example of the second position) depicted in FIGS. 2, 11 to 13, and 16, the capping position (example of the first position) depicted in FIG. 14, the wiping position depicted by solid lines in FIG. 15, and the upper retracted position depicted by broken lines in FIG. 15. The recording position is the position of the head 38 provided when the image is recorded on the sheet S supported by the conveying belt 101. The capping position is the position of the head 38 provided when the discharge module 49 is covered with the cap 62 of the maintenance mechanism 60. The capping position is the position which is disposed upwardly as compared with the recording position (position which is separated further from the first support mechanism 51 as compared with the recording position). The wiping position is the position of the head 38 provided when the wiper 63 of the maintenance mechanism 60 wipes out the lower surface 50 of the discharge module 49. The wiping position is the position which is disposed upwardly as compared with the capping position. The upper retracted position is the position of the head 38 provided when the head 38 is completely separated from the maintenance mechanism 60. The upper retracted position is the position which is disposed upwardly as compared with the wiping position.

As depicted in FIG. 2, the head 38 is moved by a ball screw 29. The ball screw 29 is provided with a screw shaft 29A and a nut member 29B. The screw shaft 29A is supported rotatably about the axis provided along the upward-downward direction, by the lower casing 32. The screw shaft 29A is rotated by the driving force transmitted from a head motor 54 (see FIG. 17). The nut member 29B is meshed with the screw shaft 29A. The nut member 29B is fixed to the head 38. The nut member 29B is moved upwardly in accordance with the forward rotation of the screw shaft 29A, and the nut member 29B is moved downwardly in accordance with the reverse rotation of the screw shaft 29A. The head 38 is moved upwardly/downwardly integrally with the nut member 29B. Note that a pair of plates, which interpose the head 38, are arranged in the internal space 32A in order that the head 38 is prevented from being rotated by the rotation of the ball screw 29. Further, the configuration, which is provided in order to move the head 38 upwardly/downwardly, is not limited to the configuration in which the ball screw 29 is used. It is possible to adopt various known configurations.

<First Support Mechanism 51>

Figure 5:
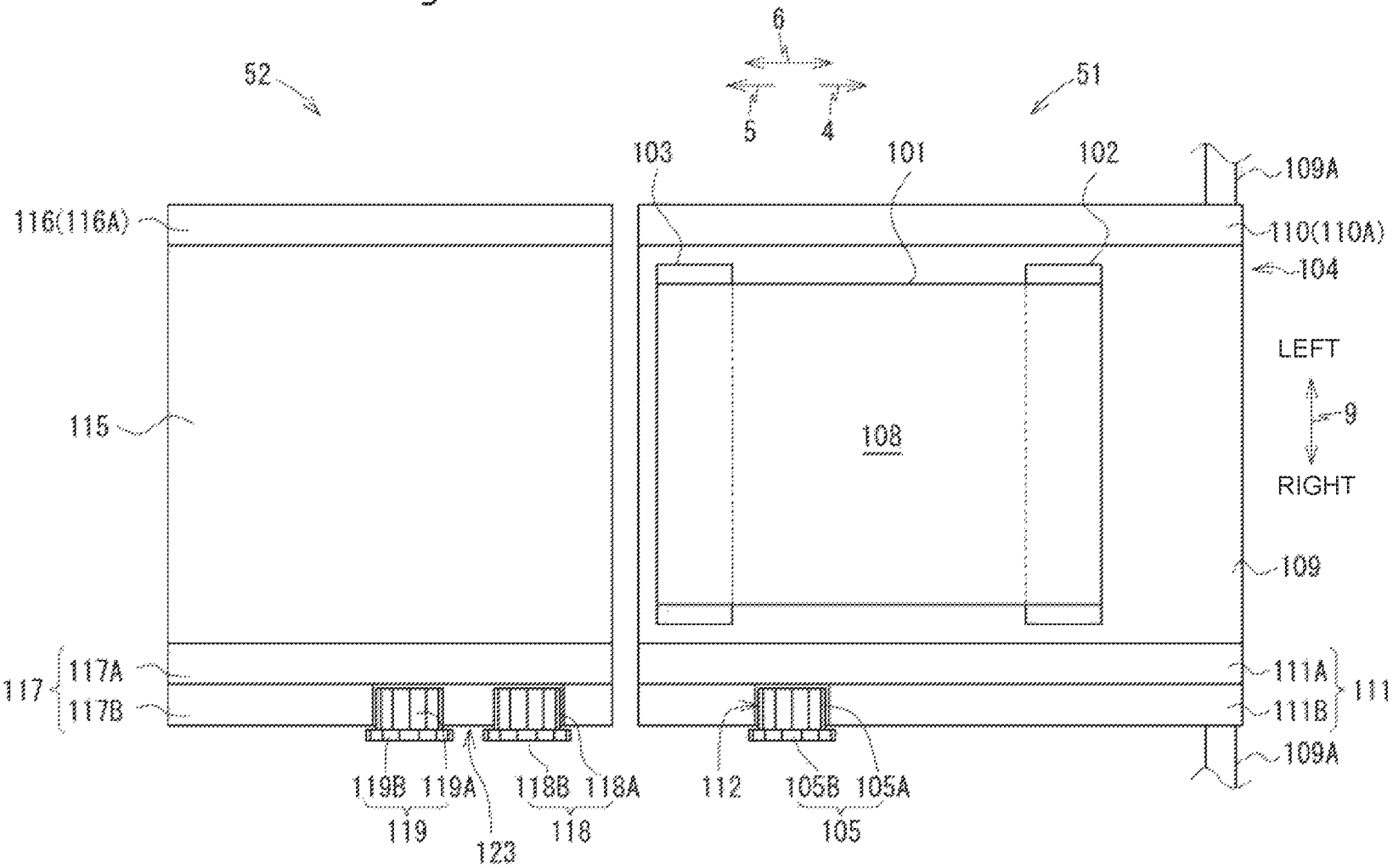
FIG. 5 depicts a plan view illustrating the first support mechanism 51 disposed at the second rotation position and a second support mechanism 52.
Figure 6:
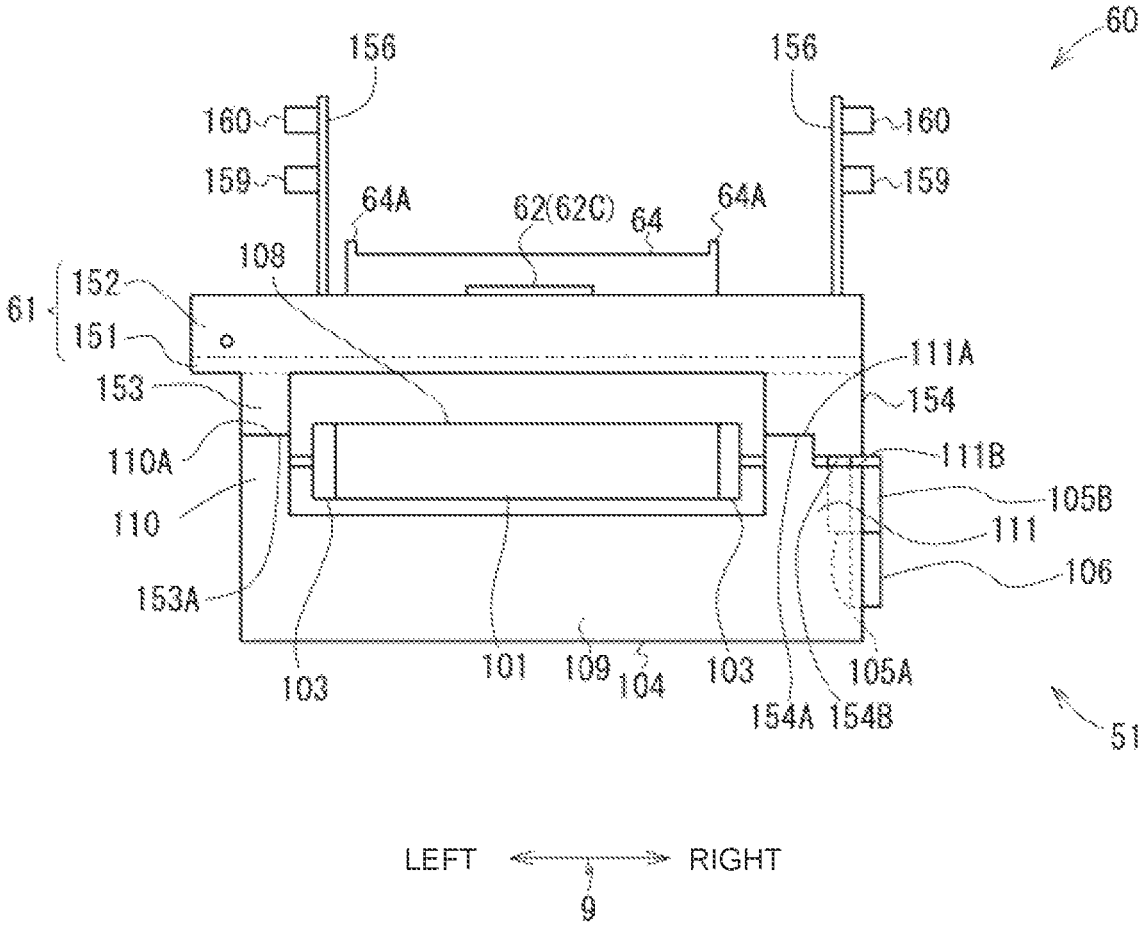
FIG. 6 depicts a front view illustrating the first support mechanism 51 disposed at the second rotation position and the maintenance mechanism 60.

As depicted in FIGS. 2, 5, and 6, the first support mechanism 51 is provided with a conveying belt 101, a driving roller 102, a following roller 103, a support unit 104, a gear 105, and a gear 106. Note that in the respective drawings, gear teeth of the gears 105, 106 are omitted from the illustration. The conveying belt 101, the driving roller 102, and the following roller 103 are examples of the conveyor.

The driving roller 102 and the following roller 103 are rotatably supported by the support unit 104. The driving roller 102 and the following roller 103 are separated from each other in the front-back direction 8 (conveyance direction 8A). The conveying belt 101 is an endless belt. The conveying belt 101 is applied and stretched under tension between the driving roller 102 and the following roller 103. The conveying belt 101 is arranged in the conveying passage 43 in the left-right direction 9.

The driving roller 102 is rotated by the driving force given by the conveying motor 53 (see FIG. 17) to rotate the conveying belt 101. The following roller 103 is rotated in accordance with the rotation of the conveying belt 101. The conveying belt 101 has a conveying surface 108. The conveying surface 108 is the upper portion of the outer circumferential surface of the conveying belt 101, and the conveying surface 108 extends in the conveyance direction 8A. The conveying surface 108 is opposed to the nozzles 38A of the head 38 with the conveying passage 43 intervening therebetween. The driving roller 102 is rotated so that the conveying surface 108 is moved in the conveyance direction 8A. Further, the conveying surface 108 gives the conveying force to the sheet S while supporting, from the lower position, the sheet S which is conveyed between the pair of conveying rollers 36, 40. Accordingly, the sheet S, which is positioned in the conveying passage 43, is conveyed in the conveyance direction 8A along the conveying surface 108 by the conveying belt 101.

As depicted in FIGS. 2 and 5, the support unit 104 is provided with a shaft 109A (example of the rotation shaft). The shaft 109A is rotatably supported by the lower casing 32. The shaft 109A extends in the left-right direction 9 (direction orthogonal to the conveyance direction 8A and parallel to the lower surface 50, example of the axial direction). The shaft 109A is provided upstream in the conveyance direction 8A from the driving roller 102. The shaft 109A is positioned under or below the conveying roller 36.

The shaft 109 is rotated by the driving force transmitted from the shaft motor 59 (see FIG. 17). The support unit 104 is rotated about the shaft 109A in accordance with the rotation of the shaft 109A. The conveying belt 101, the driving roller 102, the following roller 103, the gear 105, and the gear 106 are also rotated in accordance with the rotation of the support unit 104. In other words, the first support mechanism 51 is rotated. The rotation forward end 51A of the first support mechanism 51 is positioned downstream in the conveyance direction 8A as compared with the shaft 109A.

Note that the configuration for rotating the support unit 104 is not limited to the configuration described above. For example, the following configuration is also available. That is, the lower casing 32 is provided with a shaft 109A. The shaft 109A is fitted to a hole provided for the support unit 104, and thus the support unit 104 is rotated about the shaft 109A. In this case, the support unit 104 is provided with a virtual shaft or axis.

Figure 11:
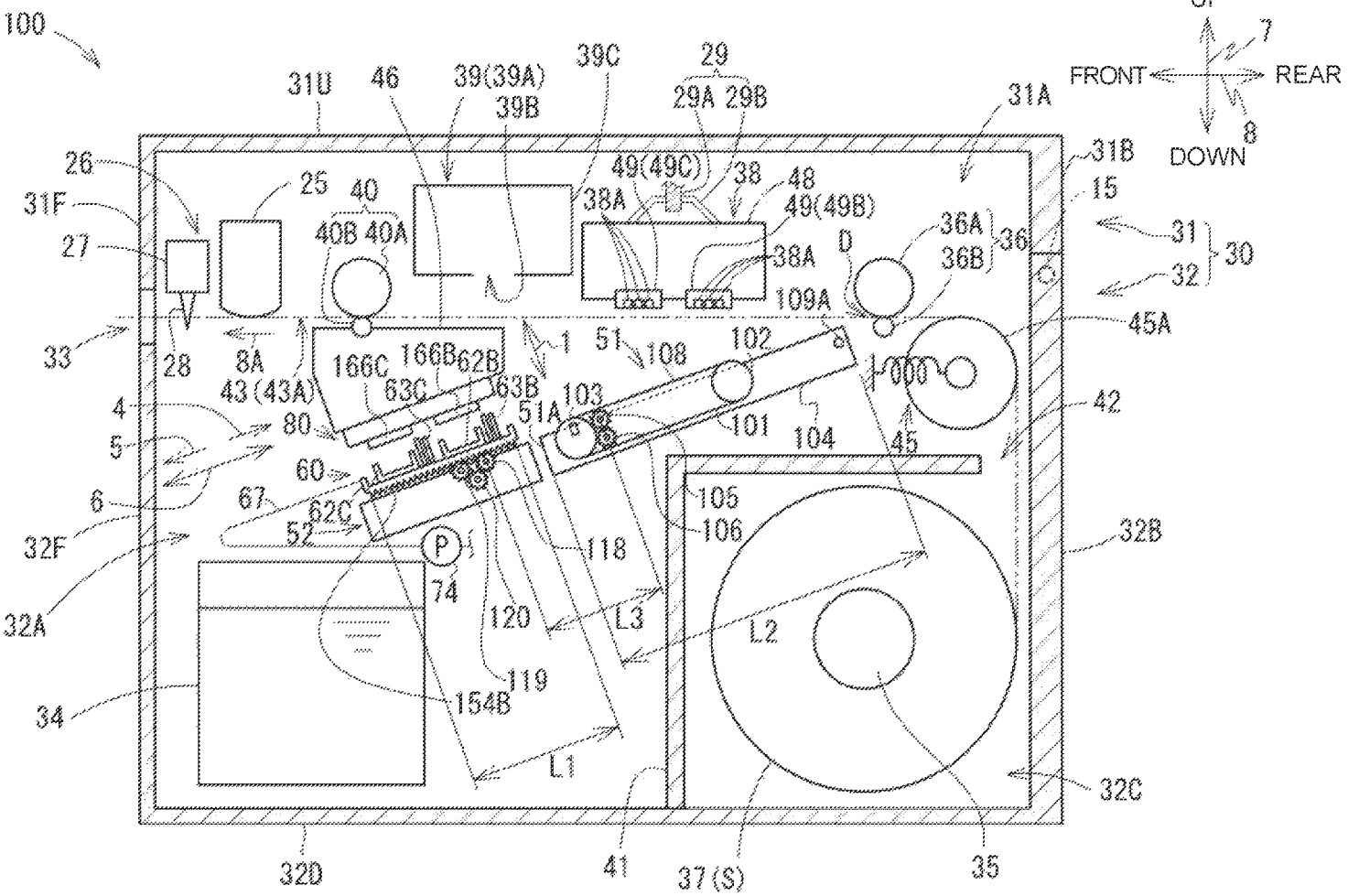
FIG. 11 depicts a sectional view illustrating a cross section taken along II-II depicted in FIG. 1, depicting a state in which the head 38 is disposed at the recording position, the first support mechanism 51 is disposed at the second rotation position, and the maintenance mechanism 60 is disposed at the waiting position.
Figure 12:
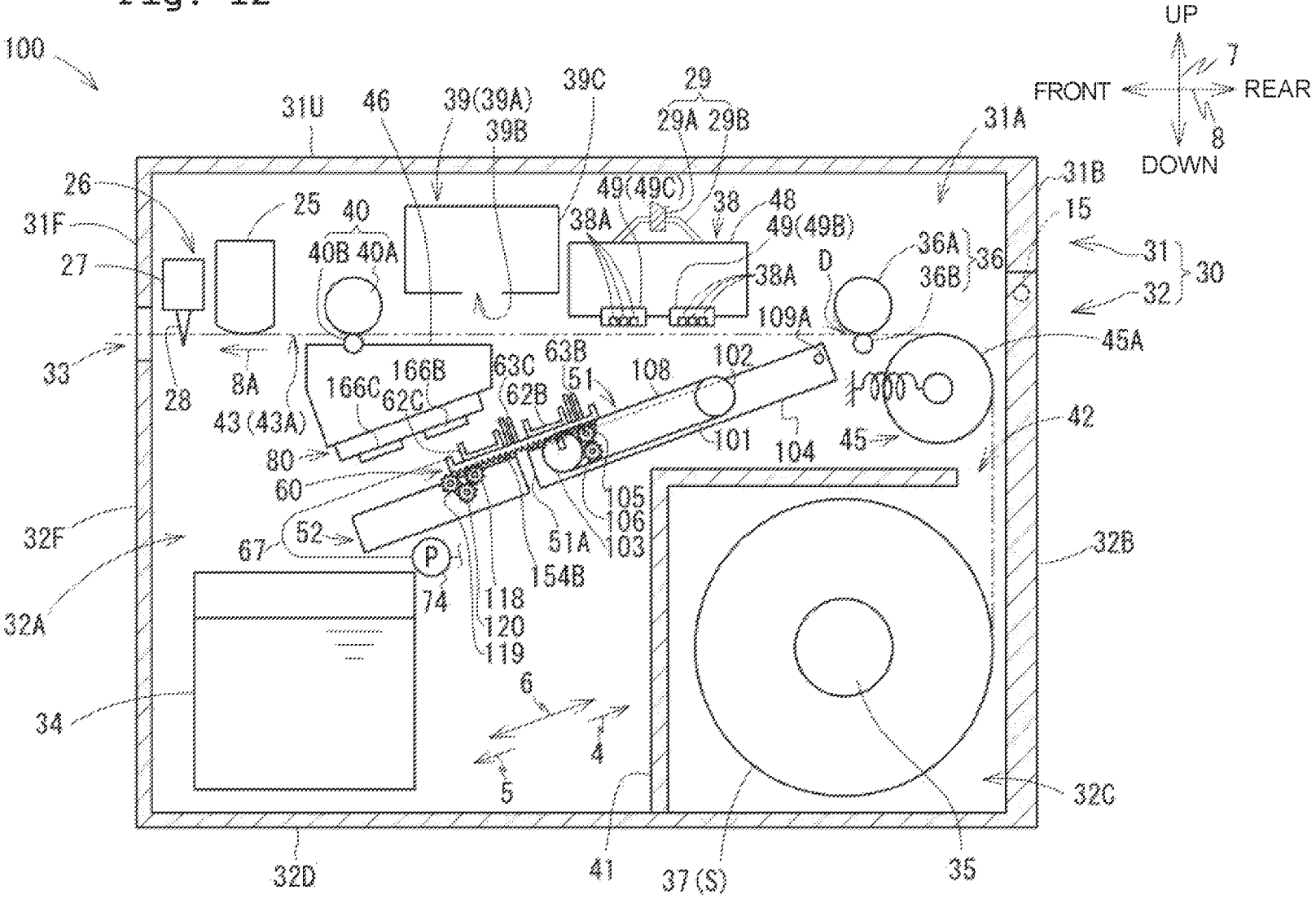
FIG. 12 depicts a sectional view illustrating a cross section taken along II-II depicted in FIG. 1, depicting a state in which the head 38 is disposed at the recording position, the first support mechanism 51 is disposed at the second rotation position, and the maintenance mechanism 60 is disposed at the position between the waiting position and the maintenance position.
Figure 13:
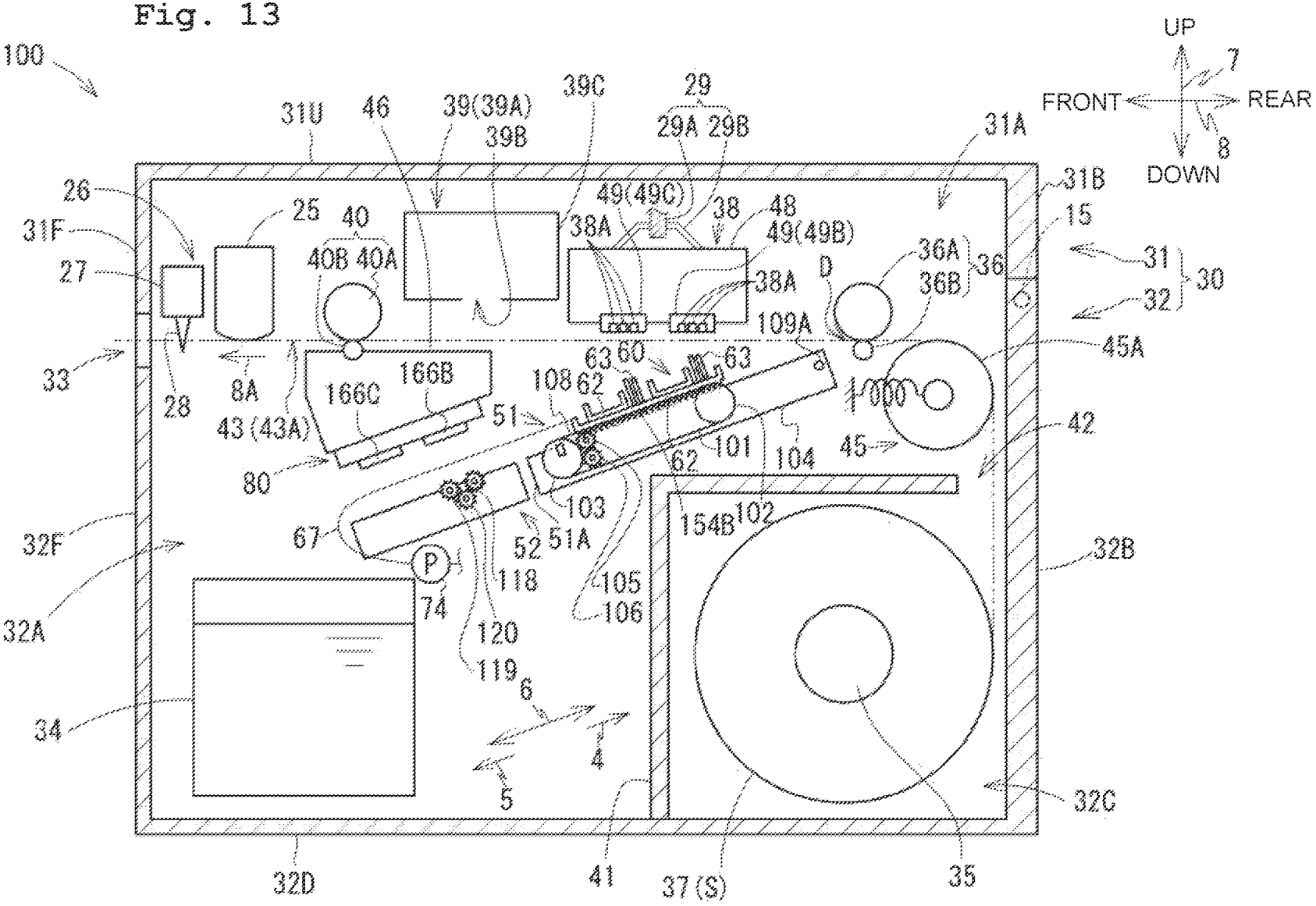
FIG. 13 depicts a sectional view illustrating a cross section taken along II-II depicted in FIG. 1, depicting a state in which the head 38 is disposed at the recording position, the first support mechanism 51 is disposed at the second rotation position, and the maintenance mechanism 60 is disposed at the position at which the maintenance mechanism 60 is supported by the first support mechanism 51.

The first support mechanism 51 is rotatable to the first rotation position depicted in FIGS. 2 and 14 to 16 and the second rotation position depicted in FIGS. 11 to 13.

As depicted in FIG. 2, when the first support mechanism 51 is disposed at the first rotation position, the conveying surface 108 of the conveying belt 101 extends in the front-back direction 8. Accordingly, the conveying belt 101 can frontwardly convey the sheet S which is positioned in the conveying passage 43, and the conveying belt 101 can feed the sheet S to the position between the fixing unit 39 and the support member 46.

As depicted in FIGS. 11 to 13, when the first support mechanism 51 is disposed at the second rotation position, the rotation forward end 51A of the first support mechanism 51 is positioned downwardly as compared with when the first support mechanism 51 is disposed at the first rotation position (see FIG. 2). Accordingly, the conveying surface 108 of the conveying belt 101 extends in the inclination direction 6 which is directed downwardly at positions disposed more frontwardly. Note that the inclination direction 6 is the orientation which is orthogonal to the left-right direction 9 and which intersects the conveyance direction 8A.

As depicted in FIGS. 5 and 6, the support unit 104 is provided with a main body 109 and upstanding walls 110, 111. Note that in the following explanation about the support unit 104, it is assumed that the first support mechanism 51 is disposed at the second rotation position. The main body 109 is an approximately plate-shaped member, and the main body 109 is provided with the shaft 109A. The upstanding wall 110 is provided in an upstanding manner upwardly from the left end portion of the main body 109. The upstanding wall 111 is provided in an upstanding manner upwardly from the right end portion of the main body 109. The upstanding walls 110, 111 extend in the inclination direction 6.

The upstanding walls 110, 111 are arranged outside the conveying passage 43 in the left-right direction 9. The upstanding walls 110, 111 rotatably support the driving roller 102 and the following roller 103.

Figure 8:
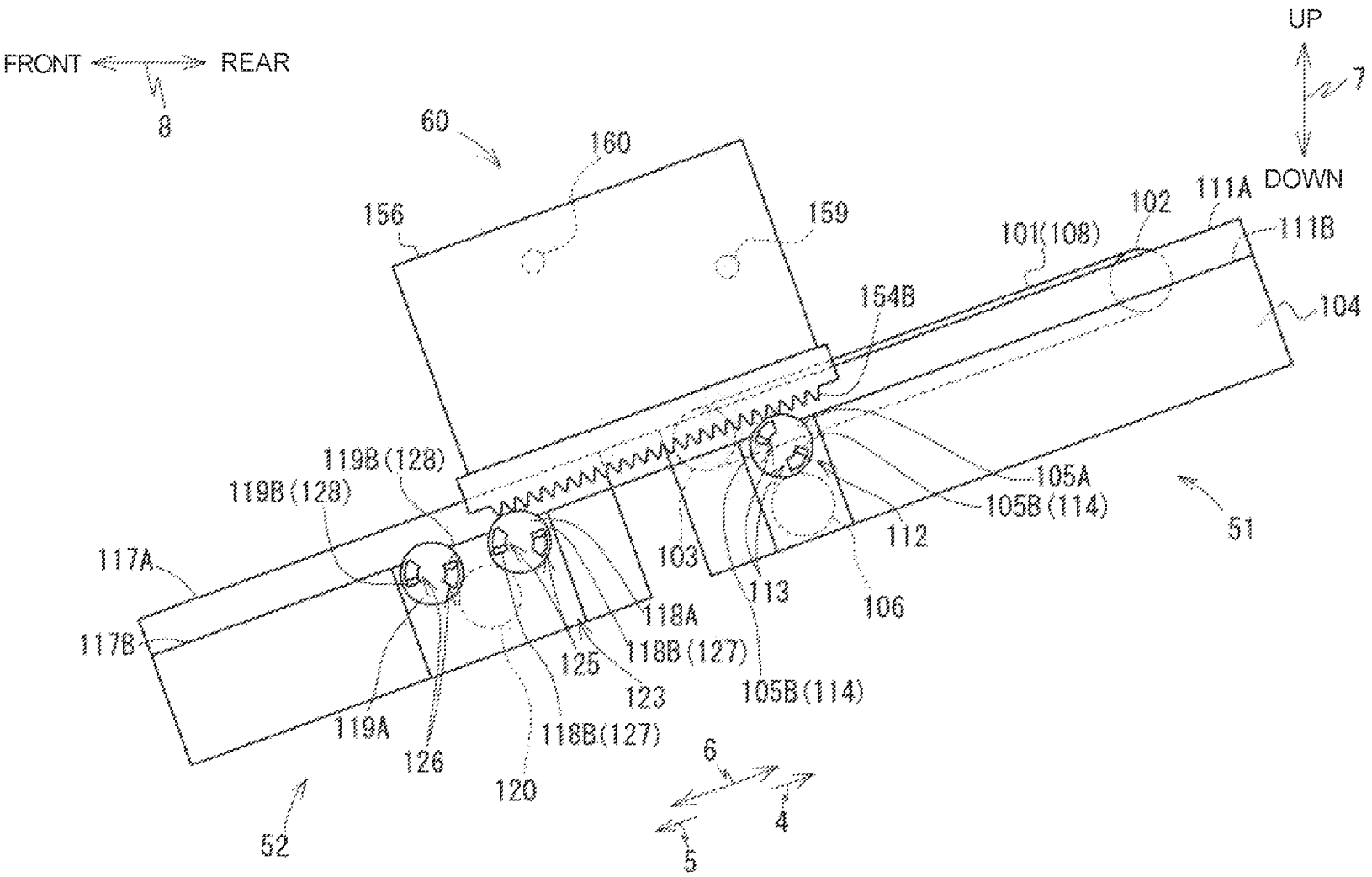
FIG. 8 depicts a sectional view illustrating a cross section taken along VIII-VIII depicted in FIG. 7.

The upstanding wall 110 is provided with an upper surface 110A. The upstanding wall 111 is provided with a first upper surface 111A and a second upper surface 111B. The second upper surface 111B is positioned at the position different from the position of the first upper surface 111A in the left-right direction 9. The upper surface 110A and the first upper surface 111A support the maintenance mechanism 60 and guide the movement of the maintenance mechanism 60. As depicted in FIGS. 5 and 8, the second upper surface 111B is disposed at the position at which the second upper surface 111B can be opposed to a rack gear 154B of the maintenance mechanism 60. An opening 112 is formed on the second upper surface 111B. A part of a gear 105A protrudes from the opening 112. The gear 105 can be meshed with the rack gear 154B which is disposed at the opposing position.

As depicted in FIG. 6, the gears 105, 106 are rotatably supported by the first support mechanism 51. The gear 105 is composed of gears 105A, 105B which are aligned in the left-right direction 9. The gears 105A, 105B are coaxial, but the gears 105A, 105B are rotated individually. The gear 105B is meshed with the gear 106. The gear 106 is connected to the first motor 55 (see FIG. 17) directly or by the aid of other gears or the like, and the driving force is given to the gear 106 from the first motor 55.

As depicted in FIG. 8, the gear 105A has holes 113. The holes 113 penetrate through the gear 105A in the left-right direction 9. Note that it is also allowable that the holes 113 do not penetrate through the gear 105A. The holes 113 extend in the circumferential direction of the gear 105A. The gear 105B has projections 114. The projections 114 protrude leftwardly from the left surface of the gear 105B toward the gear 105A, and the projections 114 enter the holes 113. The lengths of the projections 114 in the circumferential direction are shorter than the lengths of the holes 113 in the circumferential direction. Accordingly, the gear 105B is engaged with the gear 105A while providing the so-called play.

In other words, when the gear 105B is rotated, when any gap is present between the projection 114 and the surface for comparting the hole 113 on the side in the movement orientation of the projection 114, then the gear 105B undergoes the racing or idling with respect to the gear 105A during the period until the projections 114 abut against the surfaces. Then, when the projections 114 abut against the surfaces, then the projections 114 push the surfaces, and thus the gear 105B and the gear 105A are integrally rotated. In other words, the driving force is transmitted from the gear 105B to the gear 105A.

<Second Support Mechanism 52>

As depicted in FIG. 2, the second support mechanism 52 is arranged in a state in which the second support mechanism 52 extends in the inclination direction 6 as a whole.

As depicted in FIGS. 2 and 5, the second support mechanism 52 is provided with a main body 115, upstanding walls 116, 117, and gears 118, 119, 120. Note that in the respective drawings, gear teeth of the gears 118, 119, 120 are omitted from the illustration.

The main body 115 is an approximately plate-shaped member, and the main body 115 is fixed to the lower casing 32. The upstanding wall 116 is provided in an upstanding manner upwardly from the left end portion of the main body 115. The upstanding wall 117 is provided in an upstanding manner upwardly from the right end portion of the main body 115. The upstanding walls 116, 117 extend in the inclination direction 6.

The upstanding wall 116 is disposed at the same position as that of the upstanding wall 110 of the first support mechanism 51 in the left-right direction 9. The upstanding wall 117 is disposed at the same position as that of the upstanding wall 111 of the first support mechanism 51 in the left-right direction 9.

The upstanding wall 116 is provided with an upper surface 116A. The upstanding wall 117 is provided with a first upper surface 117A and a second upper surface 117B. The second upper surface 117B is disposed at the position which is different from the position of the first upper surface 117A in the left-right direction 9.

When the first support mechanism 51 is disposed at the second rotation position, then the first upper surface 117A is aligned in the inclination direction 6 with the first upper surface 111A of the upstanding wall 111 of the first support mechanism 51, and the first upper surface 117A is disposed on the same plane as that of the first upper surface 111A (see FIG. 8). In other words, the first upper surface 117A and the first upper surface 111A are aligned linearly (on a straight line). When the first support mechanism 51 is disposed at the second rotation position, then the second upper surface 117B is aligned in the inclination direction 6 with the second upper surface 111B of the upstanding wall 111 of the first support mechanism 51, and the second upper surface 117B is disposed on the same plane as that of the second upper surface 111B (see FIG. 8). In other words, the second upper surface 117B and the second upper surface 111B are aligned linearly (on a straight line).

Similarly, when the first support mechanism 51 is disposed at the second rotation position, then the upper surface 116A is aligned in the inclination direction 6 with the upper surface 110A of the upstanding wall 110 of the first support mechanism 51, and the upper surface 116A is disposed on the same plane as that of the upper surface 110A. In other words, the upper surface 116A and the upper surface 110A are aligned linearly (on a straight line).

The upper surface 116A and the first upper surface 117A support the maintenance mechanism 60 to guide the movement of the maintenance mechanism 60. As depicted in FIGS. 5 and 8, the second upper surface 117B is disposed at the position at which the second upper surface 117B can be opposed to the rack gear 154B of the maintenance mechanism 60. Openings 123, 124 are formed on the upper surface 117B. The opening 124 is positioned in front of the opening 123. A part of the gear 118 protrudes from the opening 123. A part of the gear 119 protrudes from the opening 124. The gears 118, 119 can be meshed with the rack gear 154B which is disposed at the opposing position.

As depicted in FIGS. 2, 5, and 8, the gears 118, 119, 120 are rotatably supported by the second support mechanism 52. The gear 118 is composed of gears 118A, 118B which are aligned in the left-right direction 9. The gears 118A, 118B are coaxial, but the gears 118A, 118B are rotated individually. The gear 119 is composed of gears 119A, 119B which are aligned in the left-right direction 9. The gears 119A, 119B are coaxial, but the gears 119A, 119B are rotated individually. The gear 120 is meshed with the gears 118B, 119B. Accordingly, when the gear 120 is rotated, the gears 118, 119 are rotated in the same direction. The gear 120 is connected to the second motor 56 (see FIG. 17)

directly or by the aid of other gears or the like, and the driving force is given to the gear 120 from the second motor 56.

As depicted in FIG. 8, the gears 118A, 119A have holes 125, 126 respectively. The holes 125, 126 penetrate through the gears 118A, 119A in the left-right direction 9 respectively. Note that it is also allowable that the holes 125, 126 do not penetrate through the gears 118A, 119A. The holes 125 extend in the circumferential direction of the gear 118A. The holes 126 extend in the circumferential direction of the gear 119A. The gears 118B, 119B have projections 127, 128 respectively. The projections 127 protrude leftwardly from the left surface of the gear 118B toward the gear 118A, and the projections 127 enter the holes 125. The projections 128 protrude leftwardly from the left surface of the gear 119B toward the gear 119A, and the projections 128 enter the holes 126. The lengths of the projections 127, 128 in the circumferential direction are shorter than the lengths of the holes 125, 126 in the circumferential direction. Accordingly, the gears 118B, 119B are engaged with the gears 118A, 119B respectively bile providing so-called plays.

In other words, when the gear 118B is rotated, when any gap is present between the projection 127 and the surface for comparting the hole 125 on the side in the movement orientation of the projection 127, then the gear 118B undergoes the racing or idling with respect to the gear 118A during the period until the projections 127 abut against the surfaces. Then, when the projections 127 abut against the surfaces, then the projections 127 push the surfaces, and thus the gear 118B and the gear 118A are integrally rotated. In other words, the driving force is transmitted from the gear 118B to the gear 118A.

Further, when the gear 119B is rotated, when any gaps are present between the projections 128 and the surfaces for comparting the holes 126 in the orientation in which the gear 119B is rotated, in relation to the projections 128, then the gear 119B undergoes the racing or idling with respect to the gear 119A during the period until the projections 128 abut against the surfaces. Then, when the projections 128 abut against the surfaces, then the projections 128 push the surfaces, and thus the gear 119B and the gear 119A are integrally rotated. In other words, the driving force is transmitted from the gear 119B to the gear 119A.

In this case, the lengths in the circumferential direction and the positions in the circumferential direction of the holes 125, 126 and the lengths in the circumferential direction and the positions in the circumferential direction of the projections 127, 128 are set so that the timing, at which the gear 118B and the gear 118A start the integral rotation, is the same as the timing at which the gear 119B and the gear 119B are rotated integrally.

<Maintenance Mechanism 60>

Figure 7:
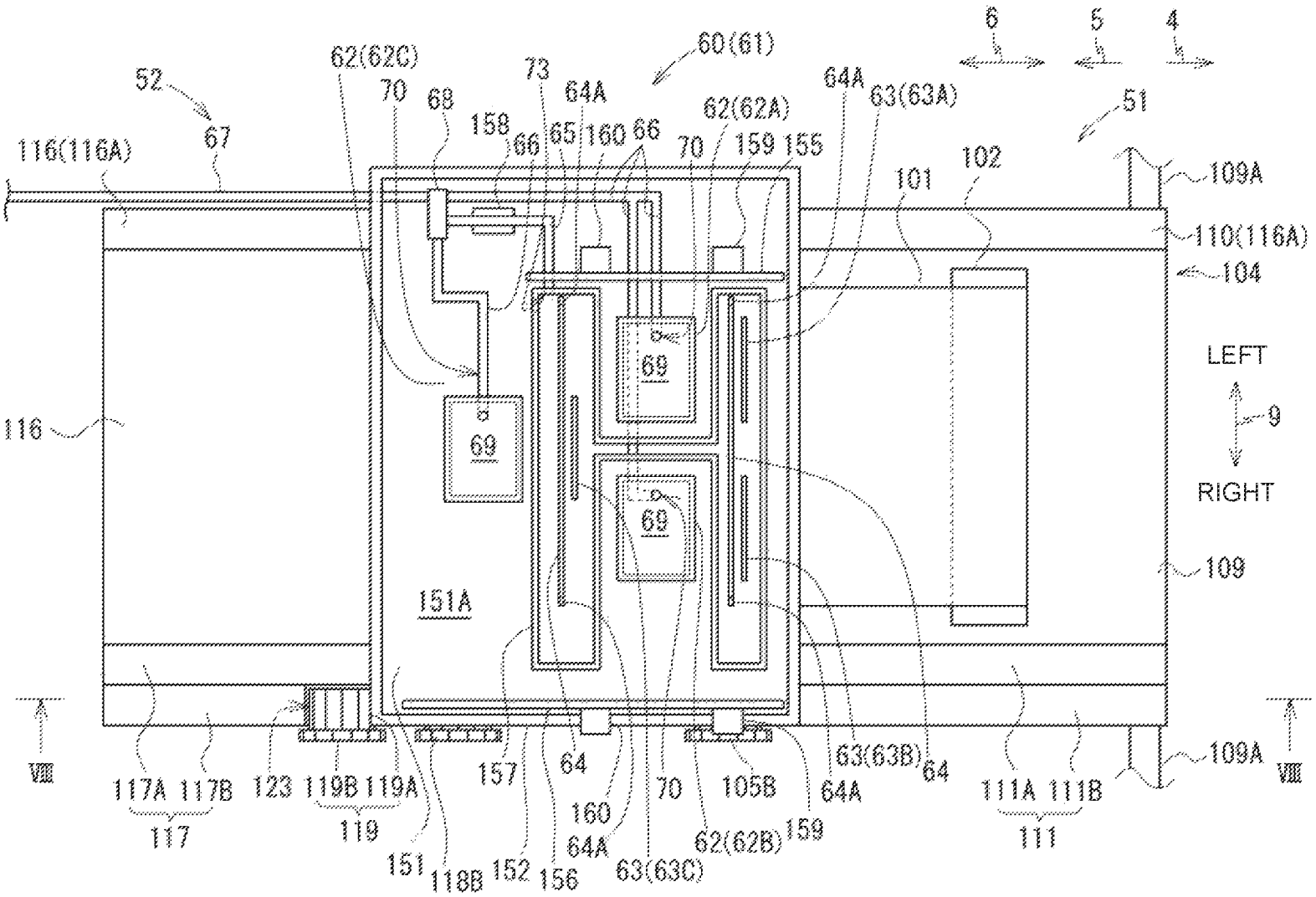
FIG. 7 depicts a plan view illustrating the first support mechanism 51 disposed at the second rotation position, the second support mechanism 52, and the maintenance mechanism 60.

As depicted in FIGS. 6 and 7, the maintenance mechanism 60 is provided with a main body 61, three caps 62, three wipers 63, two shutters 64, tubes 65, 66, 67, and a joint unit 68. Note that in the following explanation about the maintenance mechanism 60, it is assumed that the maintenance mechanism 60 is supported by the second support mechanism 52 and the first support mechanism 51 disposed at the second rotation position.

The main body 61 has a box-shaped form in which the upper portion is open. The main body 61 is provided with a bottom plate 151, an edge plate 152 which is provided in an upstanding manner upwardly from the circumferential edge of the bottom plate 151, protruding walls 153, 154, upstanding walls 155, 156, a comparting wall 157, and a protrusion 158.

The protruding wall 153 protrudes downwardly from the left end of the bottom plate 151. The protruding wall 154 protrudes downwardly from the right end of the bottom plate 151. The protruding walls 153, 154 extend in the inclination direction 6.

As depicted in FIG. 6, the protruding wall 153 is provided with a lower surface 153A. The protruding wall 154 is provided with a lower surface 154A and the rack gear 154B. The rack gear 154B is disposed at the position which is different from that of the lower surface 154A in the left-right direction 9.

As depicted in FIG. 11, the length L1 in the inclination direction 6 of the rack gear 154B is shorter than the length L2 in the inclination direction 6 of the first support mechanism 51 disposed at the second rotation position. In other words, as depicted in FIG. 14, when the first support mechanism 51 is disposed at the first rotation position, the length L1 in the front-back direction 8 of the rack gear 154B is shorter than the length L2 in the front-back direction 8 of the first support mechanism 51. Note that the length L1 may be the same as the length L2.

As depicted in FIG. 6, the lower surface 153A can abut against the upper surface 110A of the upstanding wall 110 of the first support mechanism 51 from the upper position. The lower surface 154A can abut against the first upper surface 111A of the upstanding wall 111 of the first support mechanism 51 from the upper position. Accordingly, the maintenance mechanism 60 can be supported by the first support mechanism 51.

The lower surface 153A can abut against the upper surface 116A of the upstanding wall 116 of the second support mechanism 52 from the upper position. The lower surface 154A can abut against the first upper surface 117A of the upstanding wall 117 of the second support mechanism 52 from the upper position. Accordingly, the maintenance mechanism 60 can be supported by the second support mechanism 52.

The rack gear 154B can be vertically opposed to the second upper surface 111B of the upstanding wall 111 of the first support mechanism 51. The rack gear 154B can be meshed with the gear 105A which protrudes from the opening 112 of the second upper surface 111B. The gear 105A is rotated in a state in which the rack gear 154B and the gear 105A are meshed with each other, and thus the maintenance mechanism 60 slides along the upper surface 110A and the first upper surface 111A with respect to the first support mechanism 51. In other words, the movement of the maintenance mechanism 60 is guided by the first upper surface 111A and the upper surface 110A of the first support mechanism 51.

The rack gear 154B can be vertically opposed to the second upper surface 117B of the upstanding wall 117 of the second support mechanism 52. The rack gear 154B can be meshed with the gear 118A which protrudes from the opening 123 of the second upper surface 117B and the gear 119A which protrudes from the opening 124 of the second upper surface 117B. The gear 105A is rotated in a state in which the rack gear 154B and at least one of the gear 118A and the gear 119A are meshed with each other, and thus the maintenance mechanism 60 slides along the upper surface 116A and the first upper surface 117A with respect to the second support mechanism 52. In other words, the movement of the maintenance mechanism 60 is guided by the first upper surface 111A and the upper surface 116A of the second support mechanism 52.

Accordingly, the maintenance mechanism 60 can be moved to the waiting position depicted in FIGS. 2 and 11, the cleaning termination position depicted in FIG. 16, the maintenance position depicted in FIG. 14, and the wiping position depicted in FIG. 15 as described later on. The maintenance mechanism 60, which is disposed at the maintenance position or the wiping position, is opposed in the vertical direction 7 to the lower surface 50 of the discharge module 49 of the head 38.

As depicted in FIGS. 6 and 7, the upstanding walls 155, 156 are provided in an upstanding manner upwardly from the bottom plate 151. The upstanding walls 155, 156 are the walls which are higher than the edge plate 152. The upstanding walls 155, 156 are arranged opposingly while providing a spacing distance in the left-right direction 9. The upstanding walls 155, 156 are positioned outwardly as compared with the conveying belt 101 in the left-right direction 9. In other words, the conveying belt 101 is positioned between the upstanding walls 155, 156 in the left-right direction 9. The upstanding walls 155, 156 are provided with projections 159, 160 respectively. The projections 159, 160 protrude leftwardly from the left surface of the upstanding wall 155, and the projections 159, 160 protrude rightwardly from the right surface of the upstanding wall 156. As depicted in FIG. 8, the projection 160 is positioned frontwardly and upwardly as compared with the projection 159.

As depicted in FIG. 7, the comparting wall 157 is provided in an upstanding manner upwardly from the bottom plate 151. The comparting wall 157 is the wall which is lower than the upstanding walls 155, 156. The comparting wall 157 is the wall which is lower than the edge plate 152. However, the comparting wall 157 may have a height which is not less than that of the edge plate 152.

The comparting wall 157 is positioned between the upstanding walls 155, 156 in the left-right direction 9. The comparting wall 157 is disposed at the position at which the three caps 62 are not arranged. The comparting wall 157 is provided to extend so that a predetermined area of the bottom plate 151 is surrounded. In this embodiment, the comparting wall 157 has an H-shaped form as viewed in a plan view. A liquid receiver, which receives the liquid such as the ink or the like, is constructed by the comparting wall 157 and the portion of the bottom plate 151 (bottom plate 151 in the predetermined area) disposed inside the comparting wall 157 as viewed in a plan view. The liquid receiver is provided with a receiving surface. The receiving surface is constructed by the upper surface 151A of the bottom plate 151 disposed inside the comparting wall 157 as viewed in a plan view. Note that the predetermined area is not limited to the area depicted in FIG. 7. For example, the predetermined area may be an area which ranges over the entire surface of the upper surface 151A of the bottom plate 151.

A through-hole 73, which penetrates through the comparting wall 157 in the left-right direction 9, is formed at the front left end portion of the comparting wall 157. The through-hole 73 is formed at the lower end portion of the comparting wall 157. One end of the tube 65 is connected to the through-hole 73.

The protrusion 158 protrudes upwardly from the bottom plate 151. In this embodiment, the protrusion 158 is positioned leftwardly as compared with the upstanding wall 155 in the left-right direction 9. Note that the position of the protrusion 158 is not limited to the position depicted in FIG. 7. The protrusion 158 supports the tube 65.

<Cap 62>

As depicted in FIG. 7, the caps 62 are supported by the upper surface 151A of the bottom plate 151. In other words, the caps 62 are positioned over or above the receiving surface.

The plurality of caps 62 are provided. In this embodiment, the caps 62 are composed of the three caps 62A, 62B, 62C. In the following description, the three caps 62A, 62B, 62C are generally referred to as "cap 62" as well. The cap 62A corresponds to the discharge module 49A, and the cap 62A can be opposed in the upward-downward direction 7 to the discharge module 49A. The cap 62B corresponds to the discharge module 49B, and the cap 62B can be opposed in the upward-downward direction 7 to the discharge module 49B. The cap 62C corresponds to the discharge module 49C, and the cap 62C can be opposed in the upward-downward direction 7 to the discharge module 49C. In other words, the mutual positional relationship among the caps 62A, 62B, 62C is the same as or equivalent to the mutual positional relationship among the discharge modules 49A, 49B, 49C. That is, the caps 62A, 62B are positioned while providing a spacing distance in the left-right direction 9. The cap 62C is positioned in front of the caps 62A, 62B, and the cap 62C is positioned between the caps 62A. 62B in the left-right direction 9. Note that the number of the caps 62 is not limited to three. The number of the caps 62 is set in conformity with the number of the discharge modules 49 of the head 38 described above.

The cap 62 is composed of an elastic member such as rubber, silicon or the like. Each of the caps 62A, 62B, 62C has a box-shaped form in which the upper portion is open. A hole 70 is formed through a bottom plate 69 of each of the caps 62A, 62B, 62C. One end of the tube 66 is connected to the hole 70.

As depicted in FIG. 14, when the maintenance mechanism 60 is positioned at the maintenance position, the cap 62A is opposed to the discharge module 49A in the upward-downward direction 7, the cap 62B is opposed to the discharge module 49B, and the cap 62C is opposed to the discharge module 49C. Further, the head 38 is moved to the capping position during the process in which the maintenance mechanism 60 is moved to the maintenance position. In other words, when the maintenance mechanism 60 is positioned at the maintenance position, the head 38 is positioned at the capping position. In this situation, the upper end of each of the caps 62 makes contact with the lower surface 50 of each of the discharge modules 49 under pressure respectively to cover, from the lower position, the nozzles 38 which are open on the lower surface 50. In other words, the ball screw 29, which moves the head 38, moves the head 38 relatively with respect to the maintenance mechanism 60, and thus the cap 62 is positioned at the covering position to cover the nozzles 38A.

On the other hand, as depicted in FIG. 15, when the head 38 is positioned at the wiping position or the upper retracted position, each of the caps 62 is separated from the lower surface 50. In other words, the ball screw 29 moves the head 38 relatively with respect to the maintenance mechanism 60, and thus the cap 62 is positioned at the separated position separated from the nozzles 38A. When the cap 62 is disposed at the separated position, the nozzles 38A are exposed.

<Wiper 63>

As depicted in FIGS. 2 and 7, the wipers 63 are provided in an upstanding manner upwardly from the inside of the comparting wall 157 on the bottom plate 151. In other words, the wiper 63 is opposed in the upward-downward direction 7 with respect to the receiving surface, and the wiper 63 is positioned over or above the receiving surface. The three wipers 63 (wipers 63A, 63B, 63C) are provided. Each of the wipers 63A, 63B, 63C is positioned at the back of each of the caps 62 (upstream in the conveyance direction 8A from each of the caps 62). Note that in the following explanation, the wipers 63A, 63B, 63C are generally referred to as "wiper 63" as well.

The wiper 63A corresponds to the discharge module 49A, and the wiper 63A can be opposed in the upward-downward direction 7 to the discharge module 49A. The wiper 63B corresponds to the discharge module 49B, and the wiper 63B can be opposed in the upward-downward direction 7 to the discharge module 49B. The wiper 63C corresponds to the discharge module 49C, and the wiper 63C can be opposed in the upward-downward direction 7 to the discharge module 49C. In other words, the mutual positional relationship among the wipers 63A, 63B, 63C is the same as or equivalent to the mutual positional relationship among the discharge modules 49A, 49B, 49C. That is, the wipers 63A, 63B are positioned while providing a spacing distance in the left-right direction 9, the wiper 63C is positioned in front of the wipers 63A, 63B, and the wiper 63C is positioned between the wipers 63A, 63B in the left-right direction 9. Note that the number of the wipers 63 is not limited to three. The number of the wipers 63 is set in conformity with the number of the discharge modules 49 of the head 38 described above.

The wiper 63 is composed of an elastic member such as rubber or the like, or cloth. As described later on, the wiper 63 slides against the lower surface 50 of the discharge module 49 of the head 38, and thus the wiper 63 wipes out the lower surface 50.

<Shutter 64>

As depicted in FIG. 7, the shutters 62 are arranged at the inside of the comparting wall 157 on the bottom plate 151. The two shutters 64 are provided. Each of the shutters 64 is connected to the bottom plate 151 by the aid of an unillustrated elastic member (for example, a coil spring). Accordingly, each of the shutters 64 is provided in an upstanding manner upwardly from the bottom plate 151.

One of the two shutters 64 is positioned in front of the wipers 63A, 63B provided at the back of the caps 62A, 62*b*, at the back of the caps 62A. 62C. The other of the two shutters 64 is positioned in front of the wiper 63C provided between the cap 62C and the caps 62A, 62B, at the back of the cap 62C. Each of the shutters 64 extends to the both outer sides of the wiper 63 in the left-right direction 9.

The shutter 64 extends to the position disposed over or above the wiper 63 in a state in which no force is applied from the outside (see FIG. 2, FIGS. 11 to 13, and FIG. 16).

Each of the shutters 64 is provided with projections 64A at both left and right end portions. Accordingly, the both left and right end portions of the shutter 64 is higher than the other portions of the shutter 64. When the maintenance mechanism 60 is positioned within a range ranging from the maintenance position to the wiping position (see FIGS. 14 and 15), then the cams 71 of the head 38 abut against the projections 64A from the upper positions, and the cams 71 push the projections 64A downwardly. Accordingly, the shutter 64 is moved downwardly against the urging force of the elastic member. As a result, the position of the upper end of the shutter 64 is lower than the position of the upper end of the wiper 63.

<Tubes 65, 66, 67 and Joint Unit 68>

As depicted in FIG. 7, one end of the tube 64 is connected to the through-hole 73 from the left of the comparting wall 157, i.e., from the outside of the comparting wall 157 as viewed in a plan view. The other end of the tube is connected to the joint unit 68. The tube 65 is arranged on the bottom plate 151. The internal space of the tube 65 constitutes the first flow passage. In other words, the ink, which is collected in the liquid receiver, flows through the first flow passage from the liquid receiver to the joint unit 68. Note that the tube 65 passes through the through-hole formed through the upstanding wall 155.

The plurality of tubes 66 are provided corresponding to the plurality of caps 62. One end of each of the tubes 66 is connected to the hole 70 formed for one of the caps 62. In other words, the other end of the tube 66 is connected to the joint unit 68. The tube 66 is arranged on the bottom plate 151. The internal space of the tube 66 constitutes the second flow passage. In other words, the ink, which is collected in the cap 62, flows through the second flow passage from the cap 62 to the joint unit 68.

In this embodiment, the tube 66 which is connected to the cap 62A merges with the tube 66 which is connected to the cap 62B, at the position disposed in front of the joint unit 68. Note that the tube 66 which is connected to the cap 62A and the tube 66 which is connected to the cap 62B penetrate through the through-holes formed through the upstanding wall 155. The tube 66, which is connected to the cap 62C, is arranged separately from the tubes 66 which are connected to the caps 62A, 62B. Note that the arrangement of the tubes 66 is not limited to the arrangement depicted in FIG. 7. For example, in FIG. 7, the two tubes 66 are arranged, i.e., one connected to the caps 62A, 62B and one connected to the cap 62C are arranged. However, one tube may be arranged for each of the caps 62A, 62B, 62C. In other words, it is also allowable that the three tubes 66 are arranged.

One end of the tube 67 is connected to the joint unit 68. The other end of the tube 67 is connected to an unillustrated waste liquid tank. The internal space of the tube 67 constitutes the third flow passage. In other words, the ink, which stays in the joint unit 68, flows through the third flow passage from the joint unit 68 to the waste liquid tank.

The tube 67 is positioned leftwardly as compared with the second support mechanism 52 in the left-right direction 9. Further, the tube 67 is positioned leftwardly as compared with the support member 46 and the wiper cleaning mechanism 80 (see FIG. 2) in the left-right direction 9. As depicted in FIG. 2, the tube 67 is drawn frontwardly and obliquely downwardly from the maintenance mechanism 60, and the tube 67 makes U-turn from the front to the back to arrive at the suction pump 74. The space for arranging the tube 67 is provided at the position which is disposed over or above the tank 34 and which is disposed frontwardly and obliquely downwardly with respect to the second support mechanism 52 in the internal space 32A. As depicted in FIGS. 11 to 16, the tube 67 moves while following the movement of the maintenance mechanism 60 and changing the curvature position in the process in which the maintenance mechanism 60 moves to the respective positions. Further, in the process, the tube 67 is suppressed from being expanded upwardly beyond the maintenance mechanism 60.

The joint unit 68 mutually communicates the internal spaces of the connected tubes 65, 66, 67. In other words, the joint unit 68 mutually communicates the first flow passage, the second flow passage, and the third flow passage. That is, the first flow passage and the second flow passage merge at the joint unit 68.

As depicted in FIG. 2, the suction pump 74 is arranged between one end and the other end of the tube 67. The suction pump 74 is fixedly arranged in the internal space 32A. The suction pump 74 is, for example, a rotary type tube pump. The suction pump 74 is driven by the pump motor 58 (see FIG. 17).

A part of the tube 65 is supported by the protrusion 158 which protrudes upwardly from the bottom plate 151. In other words, the portion of the tube 65, which is supported by the protrusion 158, is disposed at the position higher than those of the other portions of the tube 65 (portions arranged on the bottom plate 151). Further, the portion of the tube 65, which is supported by the protrusion 158, is disposed at the position higher than that of the tube 66 arranged on the bottom plate 151. An opening/closing mechanism is constructed by the protrusion 158 and the protrusion 72 described above. The opening/closing mechanism opens/closes the first flow passage as described later on.

<Wiper Cleaning Mechanism 80>

As depicted in FIG. 2, the wiper cleaning mechanism 80 is arranged just under the support member 46. In other words, at least a part of the wiper cleaning mechanism 80 is overlapped with the support member 46 in the upward-downward direction 7 (as viewed in a plan view).

Figure 9:
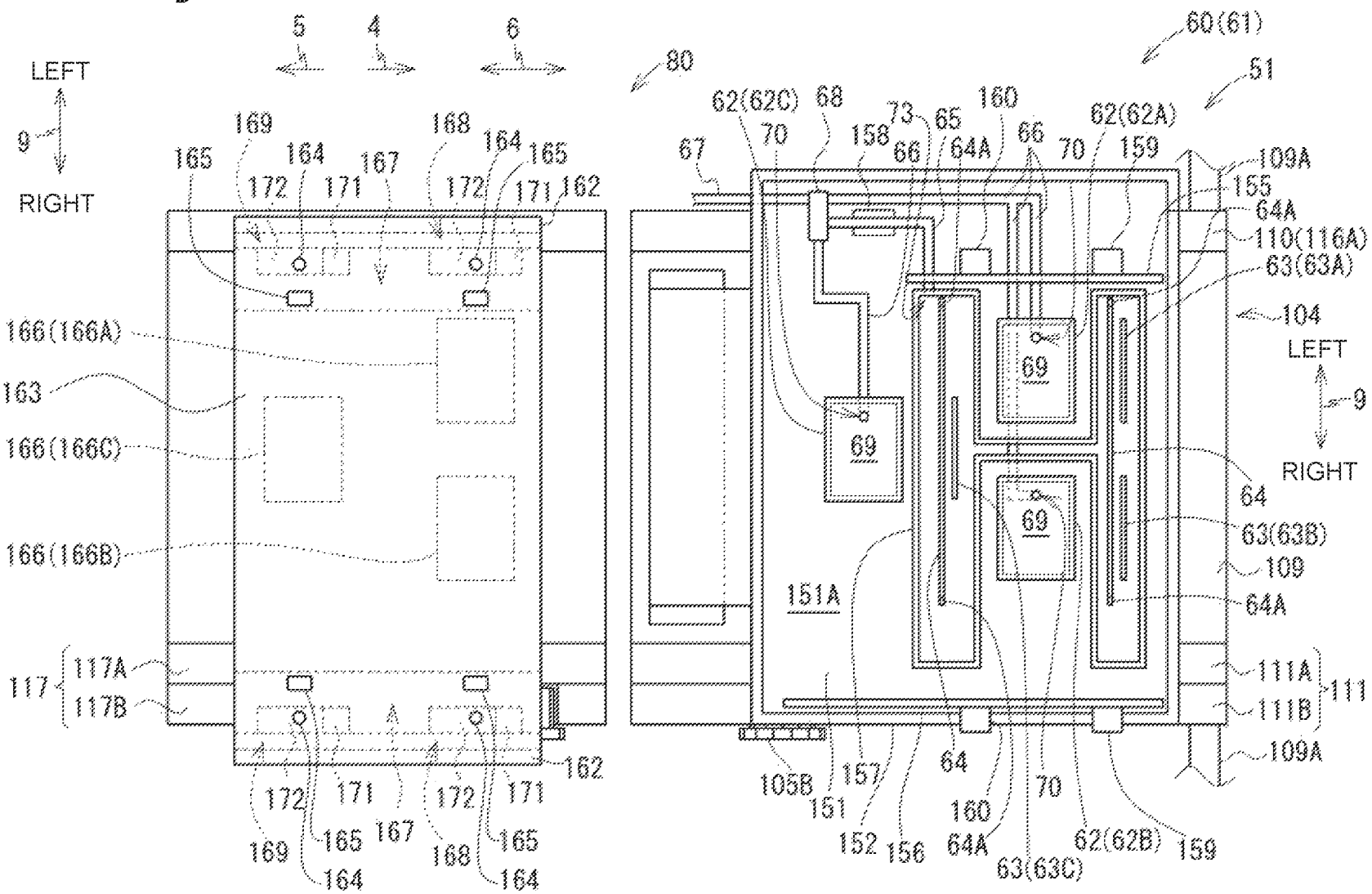
FIG. 9 depicts a plan view illustrating the first support mechanism 51 disposed at the second rotation position, the second support mechanism 52, the maintenance mechanism 60, and a wiper cleaning mechanism 80.
Figure 10:
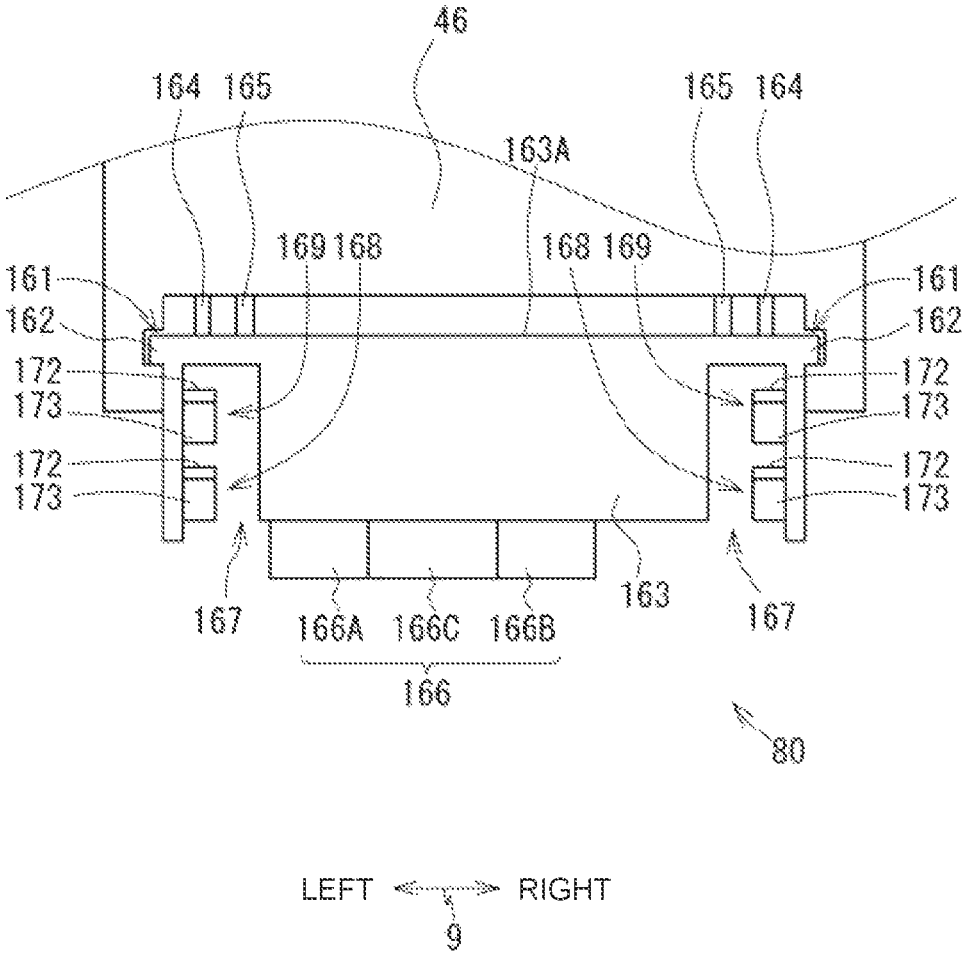
FIG. 10 depicts a front view illustrating the wiper cleaning mechanism 80 and a lower portion of a support member 46.

As depicted in FIGS. 9 and 10, the wiper cleaning mechanism 80 is provided with a main body 163, first urging members 164, second urging members 165, and foams 166.

The main body 163 is provided with a pair of protrusions 162. The pair of protrusions 162 protrude outwardly in the left-right direction 9 from the both upper left and right end portions of the main body 163. The pair of protrusions 162 extends in the inclination direction 6 (direction directed to the back of the paper surface of FIG. 10).

The main body 163 is formed with a pair of recesses 167. The pair of recesses 167 are recessed upwardly from the both left and right end portions of the lower surface of the main body 163. The pair of recesses 167 are formed to range over from one end to the other end in the inclination direction 6 of the main body 163. Protrusions 168, 169 are formed on the surfaces of the pair of recesses 167 for comparting the outer sides in the left-right direction 9. The protrusion 169 is formed frontwardly and upwardly as compared with the protrusion 168. The protrusions 168, 169 have the same shape. The protrusion 168 is disposed at the same position as that of the projection 159 in the left-right direction 9 and the upward-downward direction 7. The protrusion 169 is disposed at the same position as that of the projection 160 in the left-right direction 9 and the upward-downward direction 7.

Each of the protrusions 168, 169 has a first cam surface 171, a second cam surface 172, and a third cam surface 173. In other words, the two first cam surfaces 171, the two second cam surfaces 172, and the two third cam surfaces 173 are provided respectively while providing spacing distances in the inclination direction 6 respectively. Further, the two first cam surfaces 171, the two second cam surfaces 172, and the two third cam surfaces 173 are provided at different positions in the inclination direction respectively, and they are provided at different positions in the orthogonal direction 1 respectively. The orthogonal direction 1 is the direction which is orthogonal to the inclination direction 6 and the left-right direction 9.

Figure 22B:
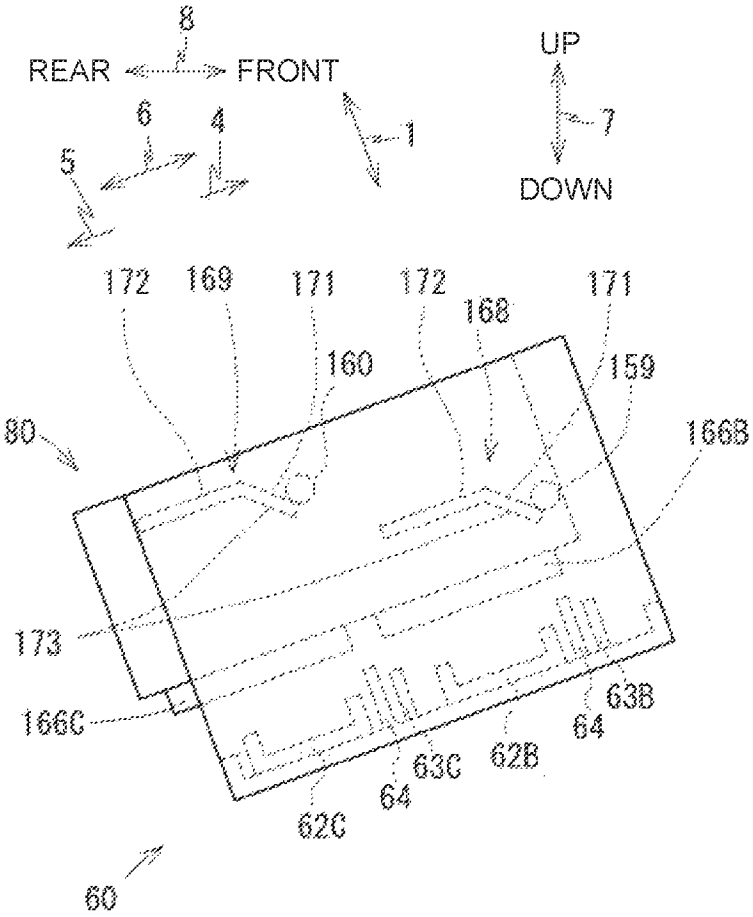
Figure 22A:
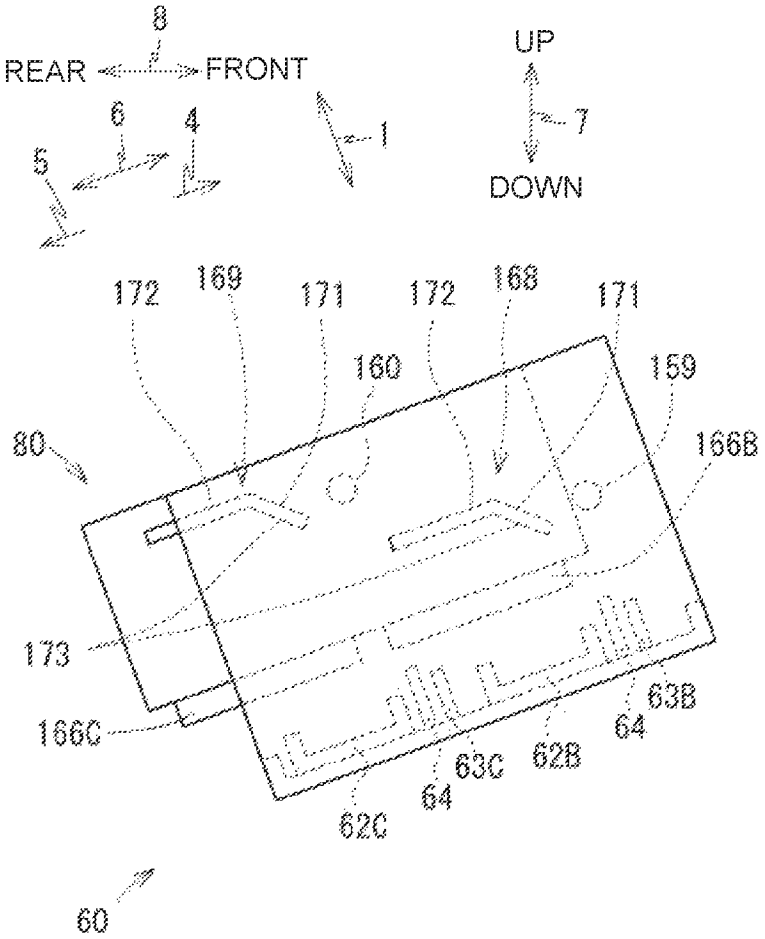

As depicted in FIG. 22A, the first cam surface 171 is the surface which is directed upwardly at the back portion of the protrusion 168, 169. More specifically, the first cam surface 171 is the surface which is inclined with respect to the inclination direction 6 so that the first cam surface 171 is directed upwardly at positions disposed more frontwardly in the inclination direction 6. The second cam surface 172 is continued to the front end of the first cam surface 171, and the second cam surface 172 is the surface which is directed in the frontward inclination orientation 5 as the orientation directed frontwardly and obliquely downwardly in the inclination direction 6. The third cam surface 173 is the back surface of the first cam surface 171. In other words, the third cam surface 173 is disposed at the same position as that of the first cam surface 171 in the inclination direction 6. The third cam surface 173 is the surface which is inclined with respect to the inclination direction 6 so that the third cam surface 173 is directed downwardly at positions disposed more backwardly in the inclination direction 6.

In this embodiment, the first urging member 164 and the second urging member 165 depicted in FIGS. 9 and 10 are elastic members. In this embodiment, the first urging member 164 is a coil spring (extension spring). The second urging member 165 is a coil spring (compression spring). The urging force of the second urging member 165 is larger than the urging force of the first urging member 164.

As depicted in FIG. 10, the first urging member 164 and the second urging member 165 are arranged between the main body 163 and the support member 46. One end of each of the first urging member 164 and the second urging member 165 is connected to the upper surface 163A of the main body 163. The other ends of the first urging member 164 and the second urging member 165 abut against the support member 46. Note that conversely to the above, one end of each of the first urging member 164 and the second urging member 165 may abut against the main body 163, and the other ends of the first urging member 164 and the second urging member 165 may be connected to the support member 46. Further, both ends of the first urging member 164 and the second urging member 165 may be connected to the main body 163 and the support member 46 respectively.

The foam 166 depicted in FIGS. 9 and 10 wipes out and sucks the liquid such as the ink or the like adhered to the wiper 63. The form 166 is, for example, a porous material. The three foams 166 are provided (foams 166A, 166B, 166C). The foam 166A corresponds to the wiper 63A, and the foam 166A can be opposed to the wiper 63A in the orthogonal direction 1. The foam 166B corresponds to the wiper 63B, and the foam 166B can be opposed to the wiper 63B in the orthogonal direction 1. The foam 166C corresponds to the wiper 63C, and the foam 166C can be opposed to the wiper 63C in the orthogonal direction 1. In other words, the mutual positional relationship among the foams 166A, 166B, 166C is the same as or equivalent to the mutual positional relationship among the wipers 63A, 63B, 63C. In other words, the foams 166A, 166B are positioned while providing a spacing distance in the left-right direction 9. The foam 166C is positioned in front of the foams 166A, 166B, and the foam 166C is positioned between the foams 166A, 166B in the left-right direction 9. Note that the number of the foams 166 is not limited to three. The number of the foams 166 is set in conformity with the number of the wipers 63.

The wiper cleaning mechanism 80 is movable in the orthogonal direction 1 to the separated position depicted in FIG. 11, the abutment position depicted by solid lines in FIG. 16, and the retracted position depicted by broken lines in FIG. 16. The abutment position is positioned backwardly and obliquely downwardly as compared with the separated position. The retracted position is positioned frontwardly and obliquely upwardly as compared with the separated position. In other words, the retracted position is positioned oppositely to the abutment position with respect to the separated position. The wiper cleaning mechanism 80 is positioned at the separated position in a state in which no force is exerted from the outside. The wiper cleaning mechanism 80 is moved from the separated position to the abutment position by elongating the first urging member 164 by the force exerted from the outside. The wiper cleaning mechanism 80 is moved from the separated position to the retracted position by shrinking the second urging member 165 by the force exerted from the outside.

The wiper cleaning mechanism 80 is detachable with respect to the support member 46.

This feature will be described in detail below. As depicted in FIG. 10, the support member 46 has a holder 161 which has a recess 161*a* recessed outwardly in the left-right direction 9 and extending in the inclination direction 6 and which detachably holds the wiper cleaning mechanism 80, at the lower portion when the support member 46 is disposed at the lodging position (falling position). The recess 161*a* of the holder 161 extends up to the front end (rotation forward end 46B) of the support member 46 at the lodging position. The wiper cleaning mechanism 80 is supported by the support member 46 disposed at the lodging position in a state in which the projection 162 is inserted into the recess 161*a* of the holder 161 (see FIG. 2). The recess 161*a* of the holder 161 corresponds to a holding surface of the present disclosure.

The wiper cleaning mechanism 80 is disengaged from the support member 46 in accordance with the following procedure. At first, the upper casing 31 is rotated from the closed position (see FIG. 2) to the open portion (see FIG. 3). Accordingly, the support member 46 is exposed to the outside. In this situation, the support member 46 is disposed at the lodging position depicted by solid lines in FIG. 3. Subsequently, the support member 46 is rotated from the lodging position to the upstanding position depicted by broken lines in FIG. 3. In this situation, the wiper cleaning mechanism 80 is rotated integrally with the support member 46. In other words, the wiper cleaning mechanism 80 is rotated from the position depicted by solid lines in FIG. 3 to the position depicted by broken lines in FIG. 3.

When the support member 46 is positioned at the upstanding position, the holder 161 extends in the orientation 3 directed frontwardly and obliquely upwardly up to the upper end of the support member 46. In this case, the orientation 3 is the orientation which is directed from the rotation proximal end 46A of the support member 46 to the rotation forward end 46B. The wiper cleaning mechanism 80 is allowed to slide in the orientation 3 with respect to the support member 46, and the wiper cleaning mechanism 80 is disengaged from the support member 46.

The wiper cleaning mechanism 80 is installed to the support member 46 in accordance with the following procedure. At first, the upper casing 31 is positioned at the open portion, and the support member 46 is positioned at the upstanding position. Subsequently, the protrusion 162 of the wiper cleaning mechanism 80 is inserted into the holder 161 from the rotation forward end 46B of the support member 46, and the wiper cleaning mechanism 80 is allowed to slide in the orientation directed backwardly and obliquely downwardly (orientation reverse to the orientation 3). Accordingly, the wiper cleaning mechanism 80 is installed to the support member 46. After that, the support member 46 is rotated from the upstanding position to the lodging position, and the upper casing 31 is rotated from the open portion to the closed position.

As described above, the holder 161 of the support member 46 disposed at the upstanding position holds the wiper cleaning mechanism 80 in the orientation 3 so that the wiper cleaning mechanism 80 can be inserted/withdrawn.

Note that in this embodiment, the entire wiper cleaning mechanism 80 can be attached/detached with respect to the support member 46. However, it is also allowable that only a part of the wiper cleaning mechanism 80 can be attached/detached with respect to the support member 46. For example, any portion of the wiper cleaning mechanism 80 other than the foam 166 may be fixed to the support member 46, and only the foam 166 can be attached/detached with respect to the portion of the wiper cleaning mechanism 80 other than the foam 166.

<Controller 130>

As depicted in FIG. 17, the controller 130 is provided with CPU 131, ROM 132, RAM 133, EEPROM 134, and ASIC 135, and these components are connected by an internal bus 137. Programs or the like, with which CPU 131 controls various operations, are stored in ROM 132. RAM 133 is used as a storage area for temporarily recording, for example, data and signals to be used when CPU 131 executes the program or as an operation area for performing the data processing. Settings, flags or the like, which are to be retained even after turning OFF the power source, are stored in EEPROM 134.

The conveying motor 53, the head motor 54, the first motor 55, the second motor 56, the pump motor 58, and the shaft motor 59 are connected to ASIC 135.

ASIC 135 generates the driving signals for rotating the respective motors, and ASIC 135 controls the respective motors on the basis of the driving signals. The respective motors are rotated forwardly or reversely in accordance with the driving signals fed from ASIC 135. The controller 130 controls the driving of the conveying motor 53 to rotate the holder 35, the conveying roller 36A, the conveying roller 40A, and the driving roller 102. The controller 130 controls the driving of the head motor 54 to rotate the screw shaft 29A and move the head 38 in the upward-downward direction 7. The controller 130 controls the driving of the first motor 55 to rotate the gear 106 of the first support mechanism 51. The controller 130 controls the driving of the second motor 56 to rotate the gear 120 of the second support mechanism 52. The controller 130 controls the driving the pump motor 58 to drive the suction pump 74. The controller 130 controls the driving of the shaft motor 59 to rotate the first support mechanism 51.

Further, a piezoelectric element 57 is connected to ASIC 135. The piezoelectric element 57 is operated by supplying the electric power by means of the controller 130 via an unillustrated drive circuit. The controller 130 controls the electric power supply to the piezoelectric element 57 to selectively discharge ink droplets from the plurality of nozzles 38A.

<Movement of Maintenance Mechanism 60>

The maintenance mechanism 60 slides with respect to the second support mechanism 52 in a state in which the maintenance mechanism 60 is supported by the second support mechanism 52, and thus the maintenance mechanism 60 is movable to the waiting position and the cleaning termination position in the inclination direction 6. In other words, the second support mechanism 52 can support the maintenance mechanism 60 positioned at the waiting position, the cleaning termination position, and any position between the both positions.

As depicted in FIG. 2, the maintenance mechanism 60, which is disposed at the waiting position, is positioned in front of the rotation forward end 51A of the first support mechanism 51 (downstream in the conveyance direction 8A). In other words, the maintenance mechanism 60, which is disposed at the waiting position, is positioned oppositely to the shaft 109A of the first support mechanism 51 with respect to the rotation forward end 51A of the first support mechanism 51.

The maintenance mechanism 60, which is disposed at the waiting position, is supported by the second support mechanism 52. In this situation, the rack gear 154B is meshed with both of the gears 118, 119. When the second motor 56 is driven, and the gear 120 is rotated clockwise as viewed in FIG. 2, then the gears 118, 119 are rotated counterclockwise as viewed in FIG. 2. Accordingly, the maintenance mechanism 60, which is disposed at the waiting position, is moved in the frontward inclination orientation 5, and the maintenance mechanism 60 arrives at the cleaning termination position (see FIG. 16).

As depicted in FIG. 16, the maintenance mechanism 60, which is disposed at the cleaning termination position, is supported by the second support mechanism 52. In this situation, the rack gear 154B is meshed with the gear 119, while the rack gear 154B is separated from the gear 118. When the second motor 56 is driven in a state in which the maintenance mechanism 60 is positioned on the downstream side in the frontward inclination orientation 5 from the cleaning termination position, and the gear 120 is rotated counterclockwise as viewed in FIG. 2, then the gears 118, 119 are rotated clockwise as viewed in FIG. 2. Accordingly, the maintenance mechanism 60 is moved in the backward inclination orientation 4 as the backward and obliquely upward orientation in the inclination direction 6, and the maintenance mechanism 60 arrives at the waiting position (see FIG. 2). In a state in which the maintenance mechanism 60 is positioned frontwardly and obliquely downwardly as compared with the cleaning termination position, the rack gear 154B is meshed with the gear 119, while the rack gear 154 is separated from the gear 118. In other words, in this embodiment, owing to the provision of the gear 119, the maintenance mechanism 60, which is positioned frontwardly and obliquely downwardly as compared with the cleaning termination position, can be moved toward the waiting position by means of the gear 119.

The cleaning of the wiper 63 is executed by the wiper cleaning mechanism 80 during the process in which the maintenance mechanism 60 is moved from the waiting position to the cleaning termination position. The cleaning of the wiper 60 performed by the wiper cleaning mechanism 80 will be explained in detail later on.

The maintenance mechanism 60 is delivered between the second support mechanism 52 and the first support mechanism 51 disposed at the second rotation position. Thus, the maintenance mechanism 60 is movable to the waiting position and the maintenance position. The waiting position is the position at which the maintenance mechanism 60 is retracted from the maintenance position.

As depicted in FIG. 2, the second support mechanism 52 supports the maintenance mechanism 60 disposed at the waiting position. As depicted in FIG. 14, the first support mechanism 51 supports the maintenance mechanism 60 disposed at the maintenance position. As depicted in FIG. 12, when the maintenance mechanism 60 is delivered between the second support mechanism 52 and the first support mechanism 51 disposed at the second rotation position, the maintenance mechanism 60 is supported by both of the first support mechanism 51 and the second support mechanism 52. On the other hand, the maintenance mechanism 60 cannot be delivered between the second support mechanism 52 and the first support mechanism 51 disposed at the first rotation position. In other words, when the first support mechanism 51 is disposed at the first rotation position, the maintenance mechanism 60 is not in such a state that the maintenance mechanism 60 is simultaneously supported by both of the first support mechanism 51 and the second support mechanism 52.

As depicted in FIG. 2, the maintenance mechanism 60, which is disposed at the waiting position, is supported by the second support mechanism 52. In this situation, the rack gear 154B is meshed with both of the gears 118, 119. When the second motor 56 (see FIG. 17) is driven in this state and the gear 120 is rotated counterclockwise as viewed in FIG. 2, then the gears 118, 119 are rotated clockwise as viewed in FIG. 2. Accordingly, the maintenance mechanism 60, which is disposed at the waiting position, is moved in the backward inclination orientation 4.

In this case, as described above, when the first support mechanism 51 is disposed at the second rotation position, then the first upper surface 117A of the second support mechanism 52 is aligned in the inclination direction 6 with the first upper surface 111A of the first support mechanism 51, the second upper surface 117B of the second support mechanism 52 is aligned in the inclination direction 6 with the second upper surface 111B of the first support mechanism 51, and the upper surface 116A of the second support mechanism 52 is aligned in the inclination direction 6 with the upper surface 110A of the first support mechanism 51.

Further, as depicted in FIG. 11, the length L1 of the rack gear 154B is longer than the distance L3 between the centers of the gear 118 and the gear 105. Note that the length L1 may be the same as the distance L3 between the centers.

Therefore, in the course or process of the movement of the maintenance mechanism 60 in the backward inclination orientation 4, the maintenance mechanism 60 undergoes the state in which the maintenance mechanism 60 is supported by only the second support mechanism 52 (see FIG. 11), and then the maintenance mechanism 60 undergoes the state in which the maintenance mechanism 60 is supported by both of the second support mechanism 52 and the first support mechanism 51 (see FIG. 12). After that, the maintenance mechanism 60 is in the state in which the maintenance mechanism 60 is supported by only the first support mechanism 51 (see FIG. 13).

Note that in the movement process, the first motor 55 (see FIG. 17) is driven at the timing before the maintenance mechanism 60 is supported by the first support mechanism 51. The gears 105, 106 are rotated in the rotation orientation in which the maintenance mechanism 60 is moved in the backward inclination orientation 4.

Further, in the movement process, the rack gear 154B maintains the state in which the rack gear 154B is meshed with at least one of the gear 118 and the gear 105. On this account, in the movement process, the movement of the maintenance mechanism 60 is not stopped, which would be otherwise stopped by disengaging the meshed state between the rack gear 154B and the gears 118, 105.

The shaft motor 59 (see FIG. 17) is driven in the state in which the maintenance mechanism 60 is supported by only the first support mechanism 51, and thus the first support mechanism 51 is rotated from the second rotation position to the first rotation position. Accordingly, the maintenance mechanism 60 is positioned at the maintenance position (see FIG. 14). The maintenance mechanism 60, which is disposed at the maintenance position, is positioned between the head 38 and the first support mechanism 51 disposed at the second rotation position.

When the maintenance mechanism 60 is moved from the maintenance position to the waiting position, the operation, which is reverse to the above, is executed. In other words, the shaft motor 59 (see FIG. 17) is firstly driven, and thus the first support mechanism 51 is rotated from the first rotation position to the second rotation position (see FIG. 13). Subsequently, when the first motor 55 and the second motor 56 (see FIG. 17) are driven, and the gears 106, 120 are rotated clockwise as viewed in FIG. 13, then the gears 105, 118, 119 are rotated counterclockwise as viewed in FIG. 13. Accordingly, the maintenance mechanism 60, which is supported by the first support mechanism 51 disposed at the second rotation position, is moved in the frontward inclination orientation 5, and the maintenance mechanism 60 arrives at the waiting position (see FIG. 11).

Note that when the maintenance mechanism 60 is delivered between the second support mechanism 52 and the first support mechanism 51 disposed at the second rotation position, the process is executed in order to reliably mesh the gears 106, 118, 119 with the rack gear 154B. However, the process will be explained in detail later on.

The maintenance mechanism 60 slides with respect to the first support mechanism 51 in a state in which the maintenance mechanism 60 is supported by the first support mechanism 51, and thus the maintenance mechanism 60 is movable to the maintenance position and the wiping position. The wiping position is the position disposed in front of the maintenance position (on the side of the waiting position). In other words, the first support mechanism 51 can support the maintenance mechanism 60 positioned at the maintenance position, the wiping position, and any position between the both positions.

As depicted in FIG. 14, the maintenance mechanism 60, which is disposed at the maintenance position, is supported by the first support mechanism 51. In this situation, the rack gear 154B is meshed with the gear 105. When the first motor 55 is driven in this state, and the gear 106 is rotated clockwise as viewed in FIG. 14, then the gear 105 is rotated counterclockwise as viewed in FIG. 14. Accordingly, the maintenance mechanism 60, which is disposed at the maintenance position, is moved frontwardly (downstream in the conveyance direction 8A) in the front-back direction 8 (conveyance direction 8A), and the maintenance mechanism 60 arrives at the wiping position (see FIG. 15). The movement distance L4 of the maintenance mechanism 60 between the maintenance position and the wiping position (see FIG. 15) is less than the length L1 of the rack gear 154B (see FIG. 11).

In the process in which the maintenance mechanism 60 is moved from the maintenance position to the wiping position, the wiper 63 moves while making abutment against the lower surface 50 of the discharge module 49 of the head 38. In other words, the wiper 63 slides with respect to the lower surface 50. Accordingly, the wiping of the lower surface 50 of the discharge module 49 is executed by the wiper 63.

As depicted in FIG. 15, when the maintenance mechanism 60 is disposed at the wiping position, the downstream end 60A in the conveyance direction 8A, which is the front end of the maintenance mechanism 60, is positioned in front of (downstream in the conveyance direction 8A from) the back end 39C of the fixing unit 39 (upstream end in the conveyance direction 8A).

When the maintenance mechanism 60 is disposed at the wiping position, when the first motor 55 is driven, and the gear 106 is rotated counterclockwise as viewed in FIG. 15, then the gear 105 is rotated clockwise as viewed in FIG. 15. Accordingly, the maintenance mechanism 60, which is disposed at the wiping position, is moved backwardly (upstream in the conveyance direction 8A), and the maintenance mechanism 60 arrives at the maintenance position (see FIG. 14).

<Gear Meshing Process>

An explanation will be made about the process in order to reliably mesh the gears 106, 118, 119 with the rack gear 154B when the maintenance mechanism 60 is delivered between the second support mechanism 52 and the first support mechanism 51 disposed at the second rotation position.

The process, which is executed when the maintenance mechanism 60 supported by the first support mechanism 51 and positioned at the maintenance position (see FIG. 14) is moved to the waiting position (see FIG. 11), will be explained below with reference to a flow chart depicted in FIG. 18A.

At first, the controller 130 drives the shaft motor 59 (see FIG. 17) to rotate the first support mechanism 51 from the first rotation position (see FIG. 14) to the second rotation position (see FIGS. 13 and 19) (S110).

Figure 19:
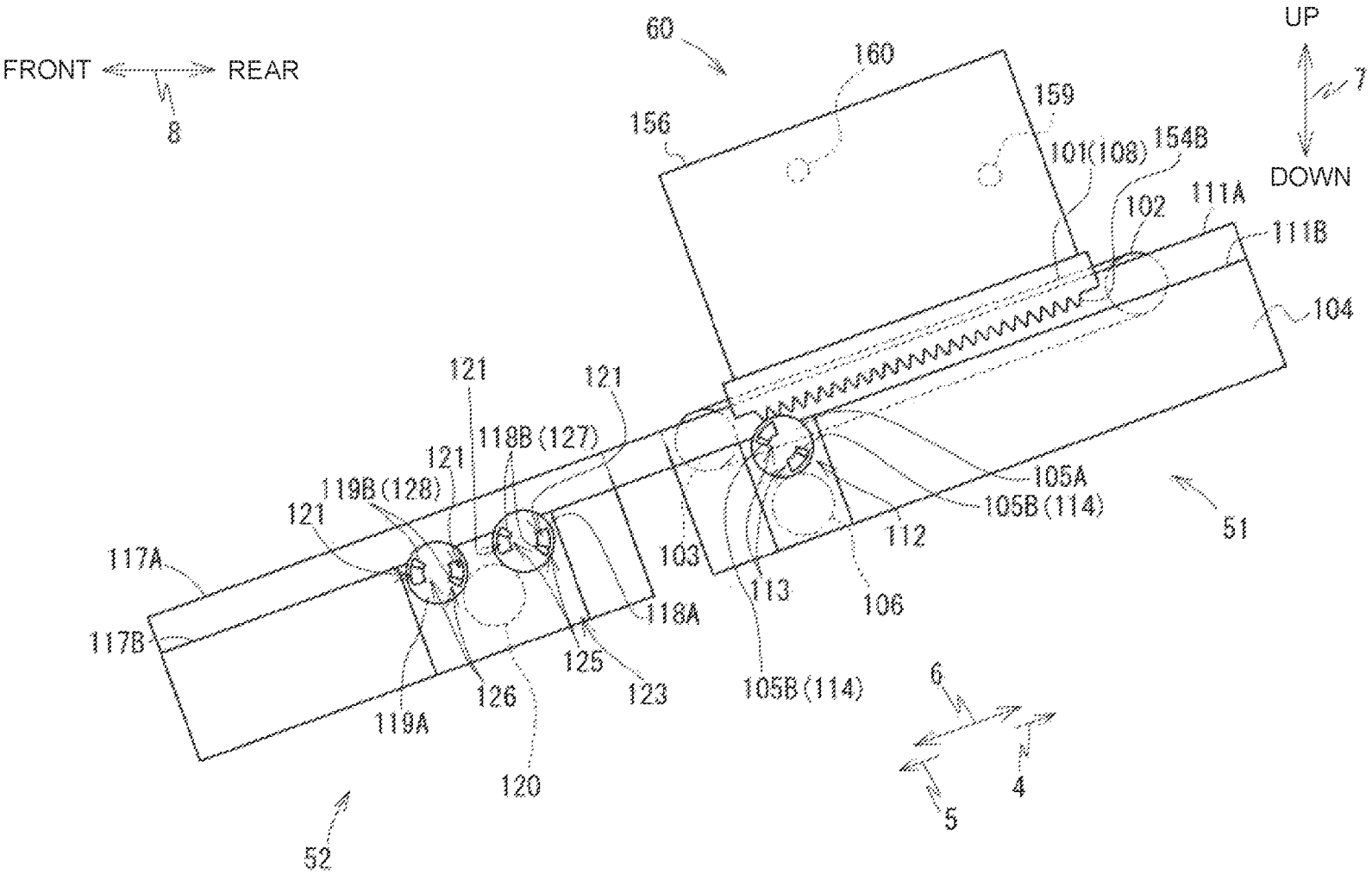
FIG. 19 depicts a sectional view illustrating a cross section taken along VIII-VIII depicted in FIG. 7, depicting a state in which the maintenance mechanism 60 is supported by the first support mechanism 51.

Subsequently, the controller 130 drives the first motor 55 (see FIG. 17) to rotate the gear 106 clockwise as viewed in FIGS. 13 and 19. Accordingly, the gear 105B of the gear 105 meshed with the gear 106 (see FIGS. 5 and 19) is rotated reversely to the gear 106 (counterclockwise as depicted in FIGS. 13 and 19) (S120). The rotation orientation of the gear 105B corresponds to the second rotation orientation. In this situation, the projections 114 of the gear 105B push the surfaces for comparting the holes 113 of the gear 105A (see FIG. 19), and thus the gear 105A is also rotated. Note that the rotation start timing of the gear 105A is based on the spacing distances between the projections 114 and the surfaces when the gear 105B starts the rotation. The maintenance mechanism 60, which has the rack gear 154B meshed with the gear 105A, is moved in the frontward inclination orientation 5 from the maintenance position toward the waiting position in accordance with the rotation of the gear 105A.

The controller 130 drives the second motor 56 (see FIG. 17) to rotate the gear 120 by a predetermined amount counterclockwise as viewed in FIGS. 13 and 19. Accordingly, the gears 118B, 119B of the gears 118, 119 meshed with the gear 120 (see FIGS. 5 and 19) are rotated by predetermined amounts reversely to the gear 106 (clockwise as viewed in FIGS. 13 and 19) (S130). The rotation orientation of the gear 118B, 119B corresponds to the first rotation orientation. The predetermined amount is not less than the amount of the play between the gear 118B, 119B and the gear 118A, 119A, and the predetermined amount is approximate to the amount of the play. When Step S130 is executed, the gap 121 is generated between the projection 127, 128 of the gear 118B, 119B and the surface for comparting the hole 125, 126 of the gear 118A, 119A (see FIG. 19). On this account, the gear 118A, 119A can idle by a predetermined amount counterclockwise as viewed in FIGS. 13 and 19 with respect to the gear 118B, 119B.

Figure 18A:
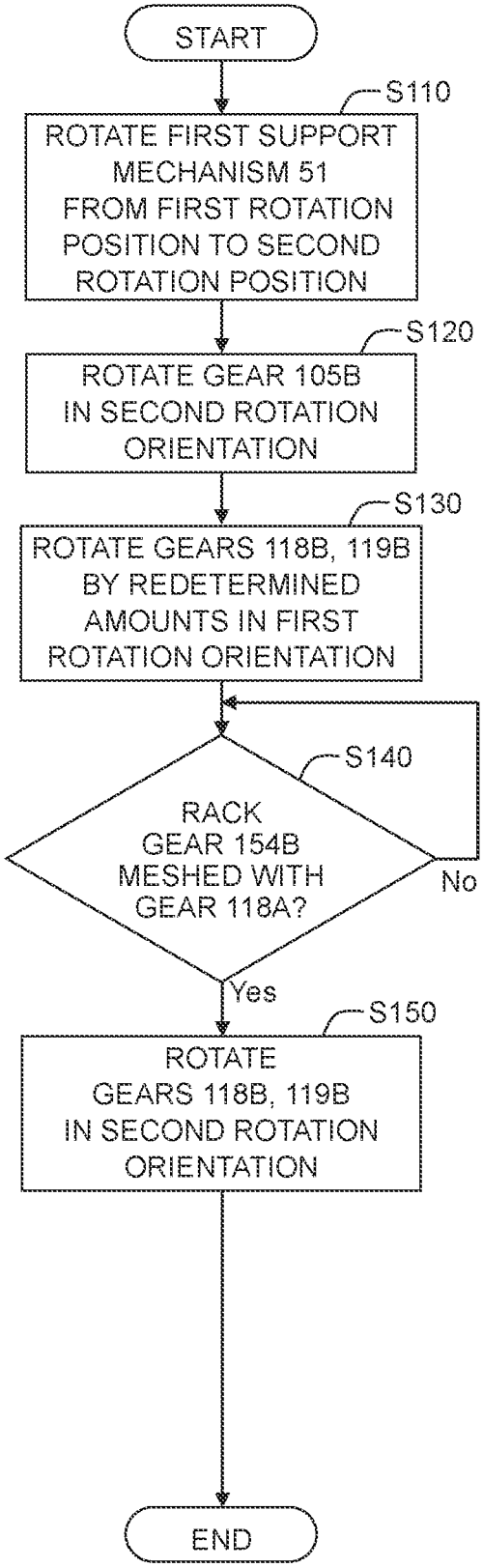
FIG. 18A depicts a part of a flow chart illustrating a gear meshing process.

Note that in FIG. 18A, Step S130 is executed next to Step S120. However, it is enough that Step S130 is executed until the rack gear 154B of the maintenance mechanism 60 which starts the movement in Step S120 is meshed with the gear 118A of the second support mechanism 52. In other words, Step S130 may be executed before Step S120, or Step S130 may be executed concurrently with Step S120.

Subsequently, the controller 130 judges whether or not the rack gear 154B is meshed with the gear 118A (S140). The judgment is executed by means of any known means including, for example, the recognition of the position of the first support mechanism 51 by a sensor or the recognition of the rotation amount of the gear 120 by a rotary encoder.

When the rack gear 154B is meshed with the gear 118A, even when any deviation arises in the circumferential direction between the gear teeth of the rack gear 154B and the gear teeth of the gear 118A, then the gear 118A idles, and thus the rack gear 154B and the gear 118A are meshed with each other by rectifying the deviation.

As depicted in FIG. 8, when the rack gear 154B is meshed with the gear 118A (S140: Yes), the controller 130 drives the second motor 56 (see FIG. 17) to rotate the gear 120 clockwise as viewed in FIG. 8. Accordingly, the gears 118B, 119B of the gears 118, 119 meshed with the gear 120 (see FIGS. 5 and 8) are rotated reversely to the gear 120 (counterclockwise as viewed in FIG. 8) (SI 50). The rotation orientation of the gear 118B, 119B corresponds to the second rotation orientation. In this situation, the gears 118B, 119B idle by predetermined amounts, and then the projections 127, 128 of the gears 118B, 119B push the surfaces for comparting the holes 125, 126 of the gears 118A, 119A. Thus, the gears 118A, 119A are also rotated. Accordingly, the first support mechanism 51 is further moved in the frontward inclination orientation 5, and the first support mechanism 51 arrives at the waiting position (see FIG. 11).

An explanation will be made below with reference to a flow chart depicted in FIG. 18B about the process to be executed when the maintenance mechanism 60 (see FIG. 11), which is supported by the second support mechanism 52 and which is positioned at the waiting position, is moved to the maintenance position (see FIG. 14).

At first, the controller 130 drives the shaft motor 59 (see FIG. 17) to rotate the first support mechanism 51 from the first rotation position (see broken lines in FIG. 20) to the second rotation position (see solid lines in FIGS. 11 and 20) (S210). Note that Step S210 may be executed at the timing of Step S220 or followings on condition that the timing is such timing that the first support mechanism 51 can arrive at the second rotation position before the maintenance mechanism 60, which starts the movement in Step S220, enters the rotation area of the first support mechanism 51.

Subsequently, the controller 130 drives the second motor 56 (see FIG. 17) to rotate the gear 120 counterclockwise as viewed in FIGS. 11 and 20. Accordingly, the gears 118B, 119B of the gears 118, 119 meshed with the gear 120 (see FIGS. 5 and 20) are rotated reversely to the gear 120 (clockwise as viewed in FIGS. 11 and 20) (S220). The rotation orientation of the gear 118B, 119B corresponds to the first rotation orientation. In this situation, the projections 127, 128 of the gears 118B, 119B push the surfaces for comparting the holes 125, 126 of the gears 118A, 119A (see FIG. 20), and thus the gears 118A, 119A are also rotated. Note that the rotation start timing of the gear 118A, 119A is based on the spacing distance between the projection 127, 128 and the surface provided when the gear 118B, 19B starts the rotation. When the gears 118A, 119A are rotated, the maintenance mechanism 60, which has the rack gear 154B meshed with the gears 118A, 119A, is moved in the backward inclination orientation 4 from the waiting position toward the maintenance position.

Figure 20:
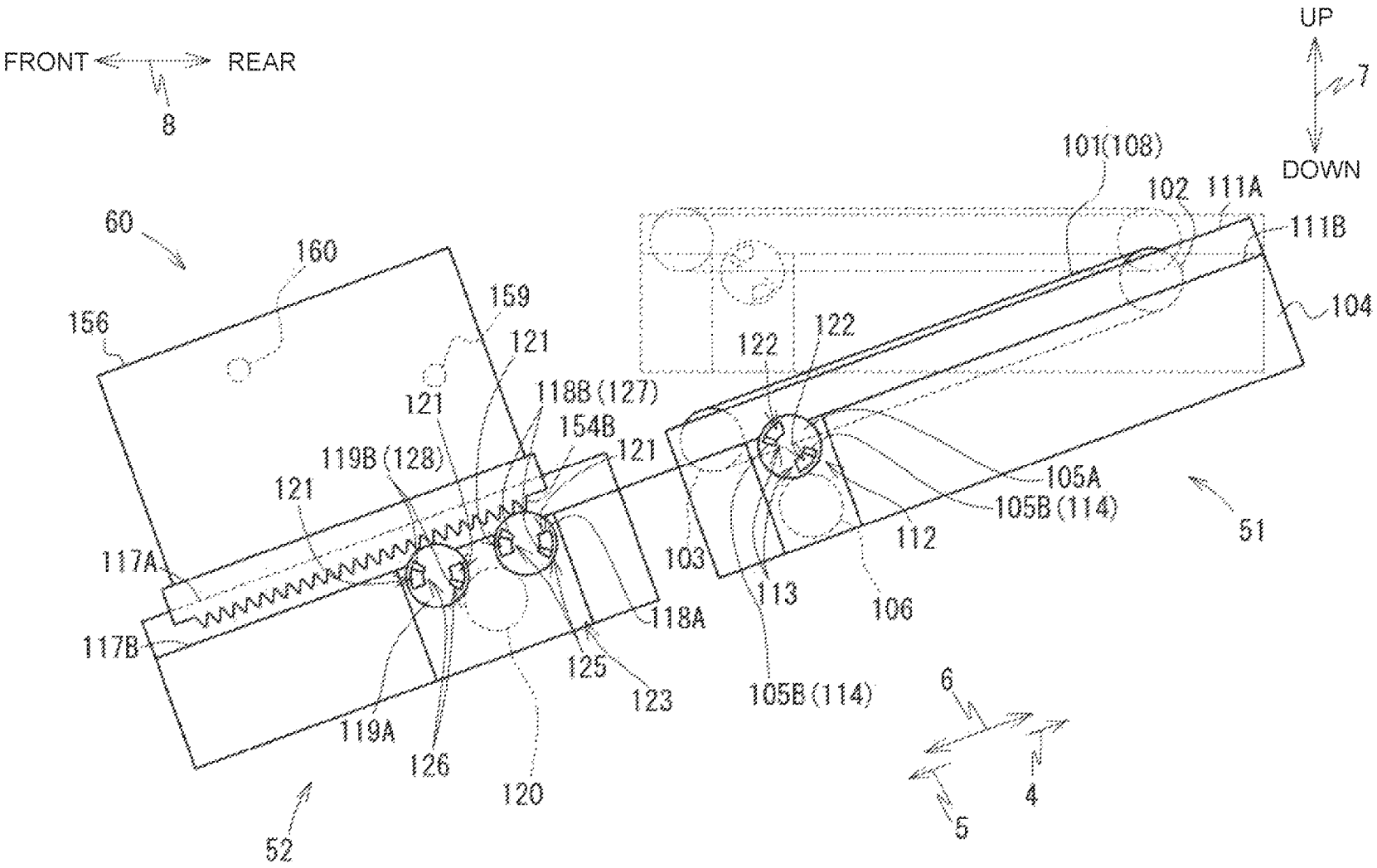
FIG. 20 depicts a sectional view illustrating a cross section taken along VIII-VIII depicted in FIG. 7, depicting a state in which the maintenance mechanism 60 is supported by the second support mechanism 52.

The controller 130 drives the first motor 55 (see FIG. 17) to drive the gear 106 by a predetermined amount clockwise as viewed in FIGS. 11 and 20. Accordingly, the gear 105B of the gear 105 meshed with the gear 106 (see FIGS. 5 and 20) is rotated by a predetermined amount reversely to the gear 106 (counterclockwise as viewed in FIGS. 11 and 20). The reverse rotation orientation of the gear 105B corresponds to the second rotation orientation. The predetermined amount is not less than the amount of the play between the gear 105B and the gear 105A, and the predetermined amount is approximate to the amount of the play. When Step S230 is executed, the gap 122 is generated between the projection 114 of the gear 105B and the surface for comparting the hole 113 of the gear 105A (see FIG. 20). On this account, the gear 105A can idle by a predetermined amount clockwise as viewed in FIGS. 11 and 20 with respect to the gear 106B.

Figure 18B:
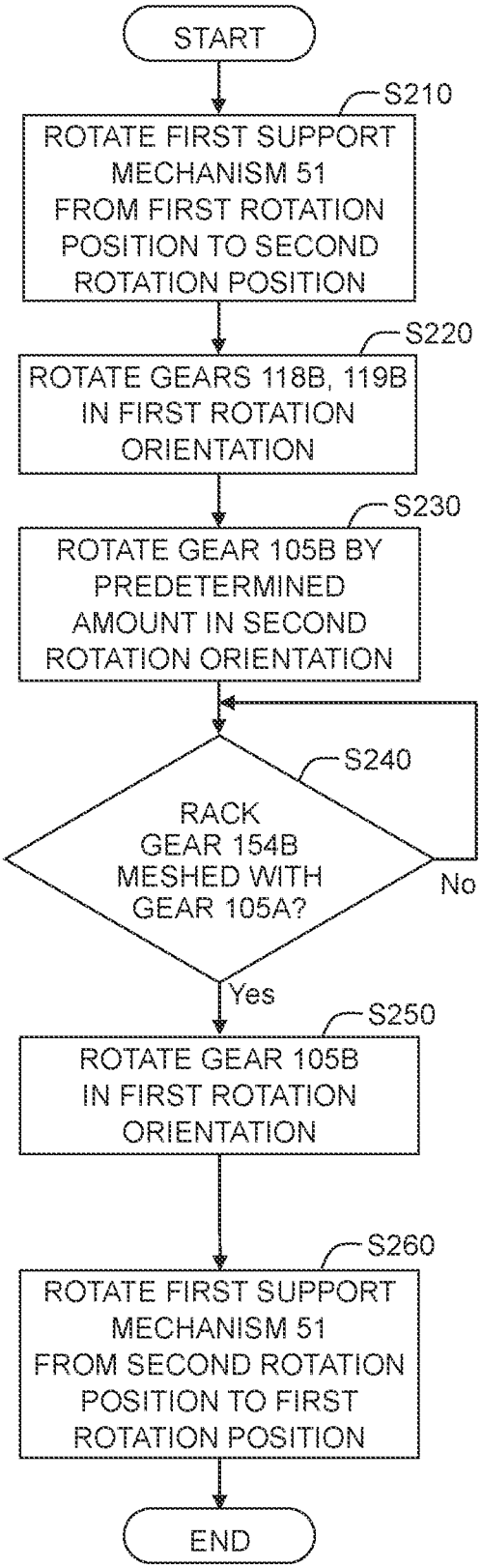
FIG. 18B depicts the remaining part of the flow chart.

Note that in FIG. 18B, Step S230 is executed next to Step S220. However, it is enough that Step S230 is executed until the rack gear 154B of the maintenance mechanism 60 which starts the movement in Step S220 is meshed with the gear 105A of the first support mechanism 51. In other words, Step S230 may be executed before Step S220, or Step S230 may be executed concurrently with Step S220.

Subsequently, the controller 130 judges whether or not the rack gear 154B is meshed with the gear 105A (S240). The judgment is executed by means of any known means described above.

When the rack gear 154B is meshed with the gear 105A, even when any deviation arises in the circumferential direction between the gear teeth of the rack gear 154B and the gear teeth of the gear 105A, then the gear 105A idles, and thus the rack gear 154B and the gear 105A are meshed with each other by rectifying the deviation.

Figure 21:
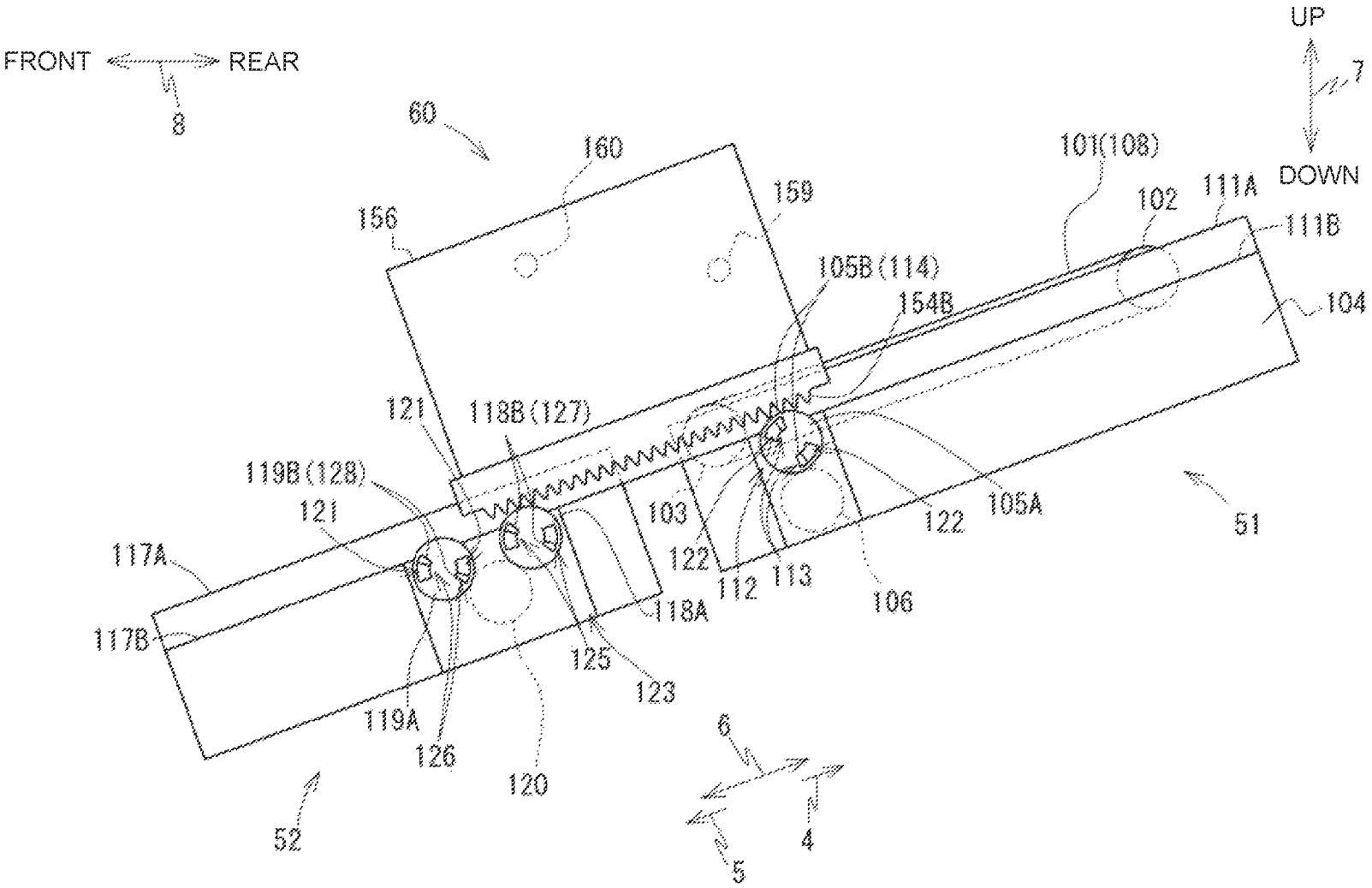
FIG. 21 depicts a sectional view illustrating a cross section taken along VIII-VIII depicted in FIG. 7, depicting a state in which the maintenance mechanism 60 is supported by the first support mechanism 51 and the second support mechanism 52.

As depicted in FIG. 21, when the rack gear 154B is meshed with the gear 105A (S240: Yes), the controller 130 drives the first motor 55 (see FIG. 17) to rotate the gear 106 counterclockwise as viewed in FIG. 21. Accordingly, the gear 105B of the gear 105 meshed with the gear 106 (see FIGS. 5 and 21) are rotated reversely to the gear 106 (clockwise as viewed in FIG. 21) (S250). The rotation orientation of the gear 105B corresponds to the first rotation orientation. In this situation, the gear 105B idles by a predetermined amount, and then the projections 114 of the gear 105B push the surfaces for comparting the holes 113 of the gear 105A. Thus, the gear 105A is also rotated. Accordingly, the maintenance mechanism 60 is further moved in the backward inclination orientation 4, and the maintenance mechanism 60 is supported by the first support mechanism (see FIG. 13).

Subsequently, the controller 130 drives the shaft motor 59 (see FIG. 17) to rotate the first support mechanism 51 from the second rotation position (see FIG. 13) to the first rotation position (see FIG. 14) (S260). Accordingly, the maintenance mechanism 60 arrives at the maintenance position (see FIG. 14).

<Image Recording Process>

An explanation will be made below about the process (image recording process) to be executed when the image is recorded on the sheet S.

When the image recording process is not executed, the image recording apparatus 100 is in the waiting state. In the case of the waiting state, as depicted in FIG. 14, the head 38 is positioned at the capping position, the first support mechanism 51 is positioned at the first rotation position in the state in which the maintenance mechanism 60 is supported, and the maintenance mechanism 60 is positioned at the maintenance position. In this situation, the caps 62 cover the nozzles 38A.

When the controller 130 receives a command to record the image on the sheet S, from the operation panel 44 or any external device such as an information processing apparatus connected by LAN or the like to the image recording apparatus 100, the controller 130 moves the maintenance mechanism 60 from the maintenance position to the waiting position. In particular, the controller 130 rotates the first support mechanism 51 from the first rotation position to the second rotation position (see FIG. 13), and then the controller 130 moves the maintenance mechanism 60 in the frontward inclination orientation 5. Thus, the controller 130 moves the maintenance mechanism 60 to the waiting position (see FIG. 11).

Subsequently, the controller 130 rotates the first support mechanism 51 from the second rotation position to the first rotation position.

Subsequently, the controller 130 moves the head 38 from the capping position to the recording position by moving the head 38 downwardly (see FIG. 16). Then, the conveyance of the sheet S is started, and the ink is discharged from the nozzles 38A in the state in which the sheet S is positioned just under the head 38. Accordingly, the image is recorded on the sheet S. The ink, which lands onto the sheet S, is fixed to the sheet S by the ultraviolet light radiated during the passage under the fixing unit 39. The sheet S, which is further conveyed, is checked for the recorded image by CIS 25, and then the sheet S is discharged after being cut into a predetermined size by the cutter unit 26.

Note that the controller 130 may convey the sheet S to the cutter unit 26 before moving the head 38 from the capping position to the recording position. In this procedure, the forward end portion of the sheet S is cut by the cutter unit 26, and then the sheet S is allowed to reversely travel to the upstream from the head 38 on the conveying passage 43. After that, the head 38 is moved from the capping position to the recording position, and the image recording is executed on the sheet S in accordance with the procedure as described above.

<Wiping Process>

An explanation will be made below about the wiping process in which the wiper 63 wipes out the lower surface 50 of the discharge module 49 of the head 38.

When the image recording process is not executed, the image recording apparatus 100 is in the waiting state. In the waiting state, as depicted in FIG. 14, the head 38 is positioned at the capping position, the first support mechanism 51 is positioned at the first rotation position in the state in which the first support mechanism 51 supports the maintenance mechanism 60, and the maintenance mechanism 60 is positioned at the maintenance position. In this situation, the caps 62 cover the nozzles 38A.

The controller 130 executes the wiping process every time when a predetermined period elapses or when a command is received from any external device. An explanation will be made below about the process executed when the controller 130 receives the command to execute the wiping process from the external device when the image recording apparatus 100 is in the waiting state.

In the wiping process, the controller 130 firstly moves the head 38 upwardly, and thus the controller 130 moves the head 38 from the capping position (see FIG. 14) to the wiping position depicted by solid lines in FIG. 15. Accordingly, the caps 62 are separated from the lower surfaces 50 of the discharge modules 49.

Subsequently, the controller 130 moves the maintenance mechanism 60 from the maintenance position to the wiping position. In particular, the controller 130 moves the maintenance mechanism 60 to the wiping position by moving the maintenance mechanism 60 frontwardly in the front-back direction 8 (see FIG. 15).

The forward end portions (upper end portions) of the wipers 63 slide with respect to the lower surfaces 50 while making abutment against the lower surfaces 50 of the discharge modules 49 in the process in which the maintenance mechanism 60 is moved from the maintenance position to the wiping position. In particular, the wiper 63A slides with respect to the lower surface 50 of the discharge module 49A, the wiper 63B slides with respect to the lower surface 50 of the discharge module 49B, and the wiper 63C slides with respect to the lower surface 50 of the discharge module 49C. Accordingly, the lower surfaces 50 of the respective discharge modules 49A, 49B, 49C are wiped out. As a result, any foreign matter or the like, which adheres to the lower surface 50 and the nozzles 38A open on the lower surface 50, is removed.

The ink and the foreign matter, which have been wiped out, adhere to the wiper 63. Parts of the ink and the foreign matter adhered to the wiper 63 flow downwardly along the wiper 63, and they are collected in the liquid receiver. The ink, which is collected in the liquid receiver, is discharged to the waste liquid tank in accordance with the liquid receiver suction process as described later on. Further, the wiper 63 is cleaned in accordance with the cleaning process as described later on, and thus the ink and the foreign matter, which adhere to the wiper 63, are removed.

Note that when the maintenance mechanism 60 is positioned at the maintenance position, the wiping position, or the position between the both positions, then the cams 71 (see FIG. 4) press the shutter 64 from the upper positions, and the shutters 64 are moved to the positions lower than the wipers 63. Therefore, the shutters 63 do not abut against the lower surfaces 50 of the discharge modules 49A.

Subsequently, the controller 130 moves the head 38 upwardly, and thus the controller 130 moves the head 38 from the wiping position depicted by solid lines in FIG. 15 to the upper retracted position depicted by broken lines in FIG. 15. Accordingly, the lower surfaces 50 of the discharge modules 49A are positioned over or above the wipers 63 and the shutters 64.

Subsequently, the controller 130 moves the maintenance mechanism 60 backwardly in the front-back direction 8, and thus the controller 130 moves the maintenance mechanism 60 from the wiping position to the maintenance position.

<Nozzle Suction Process, Liquid Receiver Suction Process, and Flashing Process>

An explanation will be made below about the nozzle suction process for sucking the ink from the nozzles 38A, the liquid receiver suction process for sucking the ink collected in the liquid receiver, and the flashing process for discharging the ink to the liquid receiver.

When the image recording process is not executed, the image recording apparatus 100 is in the waiting state. In the waiting state, as depicted in FIG. 14, the head 38 is positioned at the capping position, the first support mechanism 51 is positioned at the first rotation position in the state in which the first support mechanism 51 supports the maintenance mechanism 60, and the maintenance mechanism 60 is positioned at the maintenance position. In this situation, the caps 62 cover the nozzles 38A.

In the waiting state, the controller 130 executes the nozzle suction process at a predetermined timing or when a command is received from any external device. An explanation will be made below about the process executed when the controller 130 receives the command to execute the nozzle suction process from the external device when the image recording apparatus 100 is in the waiting state.

In the nozzle suction process, the controller 130 drives the suction pump 74. Accordingly, the ink contained in the nozzles 38A is sucked. The ink passes through the tubes 66, 67 from the spaces formed by the caps 62 and the lower surfaces 50 of the discharge modules 49, and the ink is discharged to the waste liquid tank.

As depicted in FIG. 7, when the image recording apparatus 100 is in the waiting state, the protrusion 72 of the head 38 is positioned closely to the protrusion 158 from the upper position. Accordingly, the portion of the tube 65, which is supported by the protrusion 158, is deformed and closed by being pressed by the protrusion 72, and the portion of the tube 65 is in the closed state. In other words, the first flow passage, which is the internal space of the tube 65, is closed, and the ink cannot flow through the first flow passage. That is, in the nozzle suction process, the ink contained in the nozzles 38A is sucked, while the ink collected in the liquid receiver is not sucked.

Note that the tube 66 is positioned in the vicinity of the portion of the tube 65 supported by the protrusion 158. However, the tube 66 is positioned under or below the portion, and hence the tube 66 is not pressed by the protrusion 72.

In the waiting state, the controller 130 executes the liquid receiver suction process at a predetermined timing or when the controller 130 receives a command from any external device. An explanation will be made below about the process executed when the controller 130 receives the command to execute the liquid receiver suction process from the external device when the image recording apparatus 100 is in the waiting state.

In the liquid receiver suction process, the controller 130 firstly moves the head 38 from the capping position to the wiping position or the upper retracted position. Accordingly, the caps 62 are separated from the discharge modules 49. Further, as a result, the protrusion 72 of the head 38 is separated from the protrusion 158. Therefore, the open state is given, in which the tube 65 is not deformed, and the first flow passage is opened. Thus, the flow of the ink is permitted through the first flow passage.

Subsequently, the controller 130 drives the suction pump 74. Accordingly, the ink collected in the liquid receiver is sucked. The ink passes through the tubes 65, 67, and the ink is discharged to the waste liquid tank. Note that in this situation, the ink collected in the caps 62 is also sucked. The ink passes through the tubes 66, 67, and the ink is discharged to the waste liquid tank.

Note that the liquid receiver suction process can be also executed in any state of the image recording apparatus 100 other than the waiting state. When the image recording apparatus 100 is not in the waiting state, the caps 62 are separated from the discharge modules 49. Therefore, when the controller 130 receives the command to execute the liquid receiver suction process, the controller 130 drives the suction pump 74. Accordingly, the ink collected in the liquid receiver is sucked. The ink passes through the tubes 65, 67, and the ink is discharged to the waste liquid tank.

The controller 130 executes the flashing process at a predetermined timing or when the controller 130 receives a command from any external device. An explanation will be made below about the process executed when the controller 130 receives the command to execute the flashing process from the external device when the image recording apparatus 100 is in the waiting state.

In the flashing process, the controller 130 firstly moves the head 38 to the wiping position or the upper retracted position.

Subsequently, the controller 130 moves the maintenance mechanism 60 frontwardly from the maintenance position. In this procedure, the nozzles 38A are vertically opposed to the caps 62 in the waiting state. However, when the maintenance mechanism 60 is moved frontwardly, the nozzles 38A is vertically opposed to the liquid receiver. The controller 130 stops the maintenance mechanism 60 at the position at which the nozzles 38A are vertically opposed to the liquid receiver.

Subsequently, the controller 130 allows the nozzles 38A to discharge the ink therefrom. The discharged ink is collected in the liquid receiver. The ink collected in the liquid receiver is discharged to the waste liquid tank in accordance with the liquid receiver suction process described above.

<Cleaning Process for Wiper 63>

An explanation will be made below about the cleaning process executed when the wipers 63 are cleaned.

When the image recording process is not executed, the image recording apparatus 100 is in the waiting state. In the waiting state, as depicted in FIG. 14, the head 38 is positioned at the capping position, the first support mechanism 51 is positioned at the first rotation position in the state in which the first support mechanism 51 supports the maintenance mechanism 60, and the maintenance mechanism 60 is positioned at the maintenance position. In this situation, the caps 62 cover the nozzles 38A.

The controller 130 executes the cleaning process at a predetermined timing or when a command is received from any external device. An explanation will be made below about the process executed when the controller 130 receives the command to execute the cleaning process from the external device when the image recording apparatus 100 is in the waiting state.

In the cleaning process, the controller 130 firstly moves the maintenance mechanism 60 to the waiting position in accordance with the same or equivalent procedure as that adopted when the image recording process is executed. In particular, the controller 130 rotates the first support mechanism 51 from the first rotation position to the second rotation position (see FIG. 13), and then the controller 130 moves the maintenance mechanism 60 in the frontward inclination orientation 5 (see FIG. 12). Thus, the controller 130 moves the maintenance mechanism 60 to the waiting position (see FIG. 11).

When the maintenance mechanism 60 is disposed at the waiting position depicted in FIG. 11, then the respective wipers 63A, 63B, 63C are positioned on the upstream side in the frontward inclination orientation 5 as compared with the corresponding foams 166A, 166B, 166C respectively, and the respective wipers 63A, 63B, 63C are not opposed to the corresponding foams 166A, 166B, 166C in the orthogonal direction 1.

Further, as depicted in FIG. 22A, when the maintenance mechanism 60 is disposed at the waiting position depicted in FIG. 11, then the projection 159 does not abut against the protrusion 168 but the projection 159 is positioned in the vicinity of the protrusion 168, and the projection 160 does not abut against the protrusion 169 but the projection 160 is positioned in the vicinity of the protrusion 169.

The controller 130 further moves the maintenance mechanism 60 in the frontward inclination orientation 5 from the waiting position depicted in FIG. 22A. Accordingly, as depicted in FIG. 22B, the projection 159 abuts against the first cam surface 171 of the protrusion 168, and the projection 160 abuts against the first cam surface 171 of the protrusion 169. Note that the projection 160 is positioned over or above the protrusion 168. Therefore, when the maintenance mechanism 60 is further moved in the frontward inclination orientation 5 from the waiting position depicted in FIG. 22, the projection 160 can move toward the downstream side in the frontward inclination direction 5 as compared with the protrusion 168 without making contact with the protrusion 168.

The controller 130 further moves the maintenance mechanism 60 from the position depicted in FIG. 22B in the frontward inclination orientation 5. By doing so, the projections 159, 160 press the first cam surfaces 171. Accordingly, the movement of the maintenance mechanism 60 in the frontward inclination orientation 5 is converted into the movement of the wiper cleaning mechanism 80 to be positioned from the separated position to the abutment position by the aid of the projections 159, 160 and the first cam surfaces 171. As a result, the wiper cleaning mechanism 80 is moved from the separated position to the abutment position. In other words, the first cam surfaces 171 guide the wiper cleaning mechanism 80 from the separated position to the abutment position. In this situation, the first urging members 164 elongate against the urging forces.

Figure 23B:
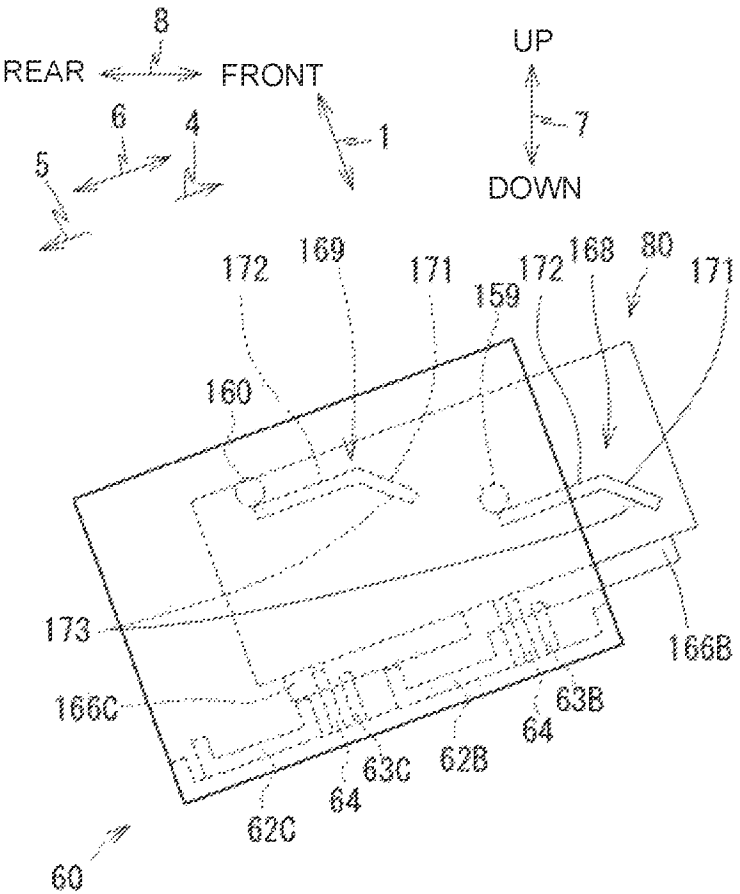
Figure 23A:
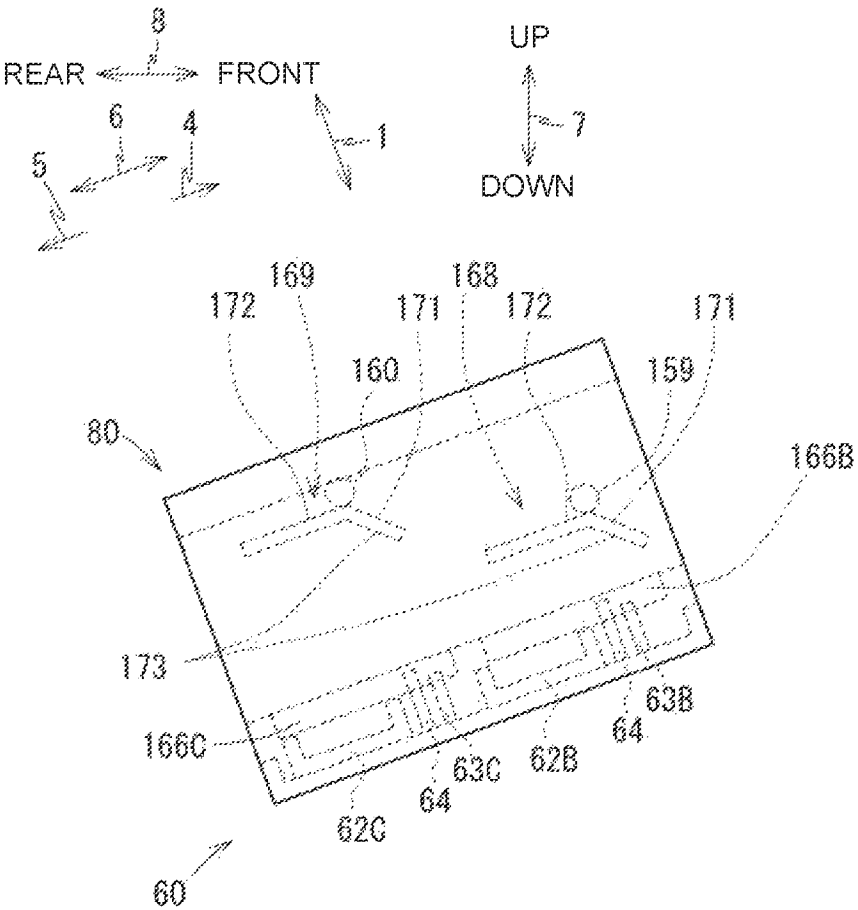

The projections 159, 160 are guided from the first cam surfaces 171 to the second cam surfaces 172 in accordance with the movement of the maintenance mechanism 60 in the frontward inclination orientation 5. As depicted in FIG. 23A, when the projections 159, 160 arrive at the back end portions of the second cam surfaces 172, the wiper cleaning mechanism 80 arrives at the abutment position. The position of the maintenance mechanism 60, which is provided in this situation, is the cleaning start position. When the position of the maintenance mechanism 60 is the cleaning start position, then the wipers 63 are opposed in the orthogonal direction 1 to the upstream end portions in the frontward inclination direction 5 of the foams 166 of the wiper cleaning mechanism 80 disposed at the abutment position, and the foams 166 are brought in contact with the forward end portions of the wipers 63. In particular, the upstream end portion in the frontward inclination orientation 5 of the foam 166A is brought in contact with the forward end portion of the wiper 63A, the upstream end portion in the frontward inclination orientation 5 of the foam 166B is brought in contact with the forward end portion of the wiper 63B, and the upstream end portion in the frontward inclination orientation 5 of the foam 166C is brought in contact with the forward end portion of the wiper 63C. Note that the movement of the wiper cleaning mechanism 80 from the abutment position to the separated position is inhibited by the abutment of the projections 159, 160 against the second cam surfaces 172.

The controller 130 further moves the maintenance mechanism 60 in the frontward inclination orientation 5 from the position depicted in FIG. 23A. Accordingly, the projections 159, 160 are guided by the second cam surfaces 172. In this process, the wipers 63 slide with respect to the foams 166. Accordingly, the forward end portions of the wipers 63 are cleaned, and the ink and the foreign matter, which adhere to the forward end portions of the wipers 63, are removed. After that, as depicted in FIG. 23B, the projections 159, 160 arrive at the front end portions of the second cam surfaces 172. The position of the maintenance mechanism 60 provided in this situation is the cleaning termination position.

When the positions of the maintenance mechanism 60 is the cleaning termination position, then the wipers 63 are opposed in the orthogonal direction 1 to the downstream end portions in the frontward inclination direction 5 of the foams 166 of the wiper cleaning mechanism 80 disposed at the abutment position, and the foams 166 are brought in contact with the forward end portions of the wipers 63. In particular, the downstream end portion in the frontward inclination orientation 5 of the foam 166A is brought in contact with the forward end portion of the wiper 63A, the downstream end portion in the frontward inclination orientation 5 of the foam 166B is brought in contact with the forward end portion of the wiper 63B, and the downstream end portion in the frontward inclination orientation 5 of the foam 166C is brought in contact with the forward end portion of the wiper 63C. Note that the movement of the wiper cleaning mechanism 80 from the abutment position to the separated position is inhibited by the abutment of the projections 159, 160 against the second cam surfaces 172. In other words, the second cam surfaces 172 retain the wiper cleaning mechanism 80 at the abutment position.

Figure 24B:
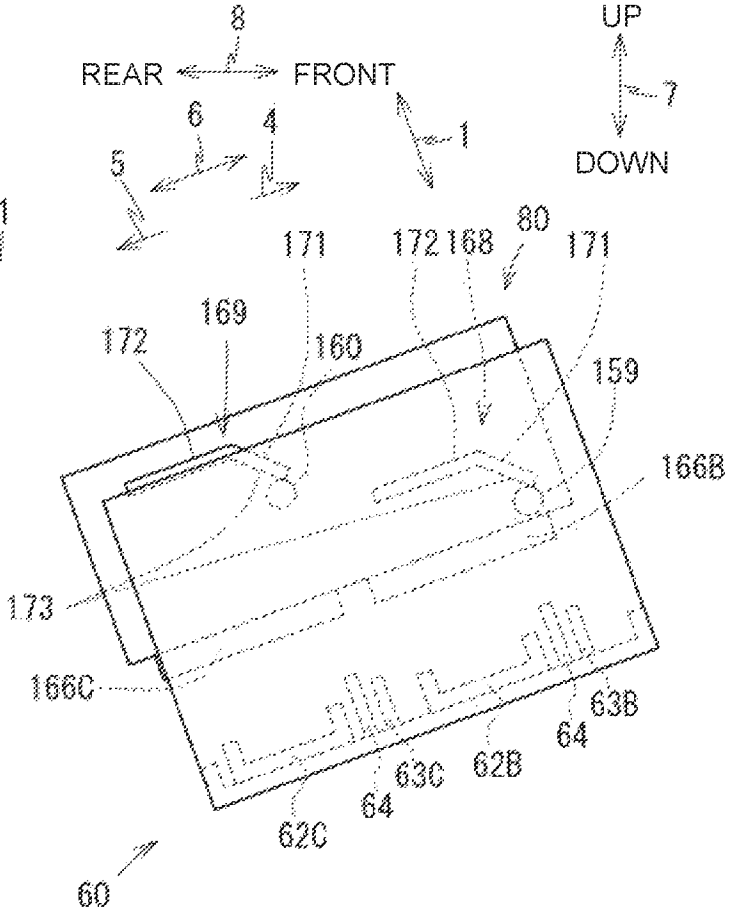
Figure 24A:
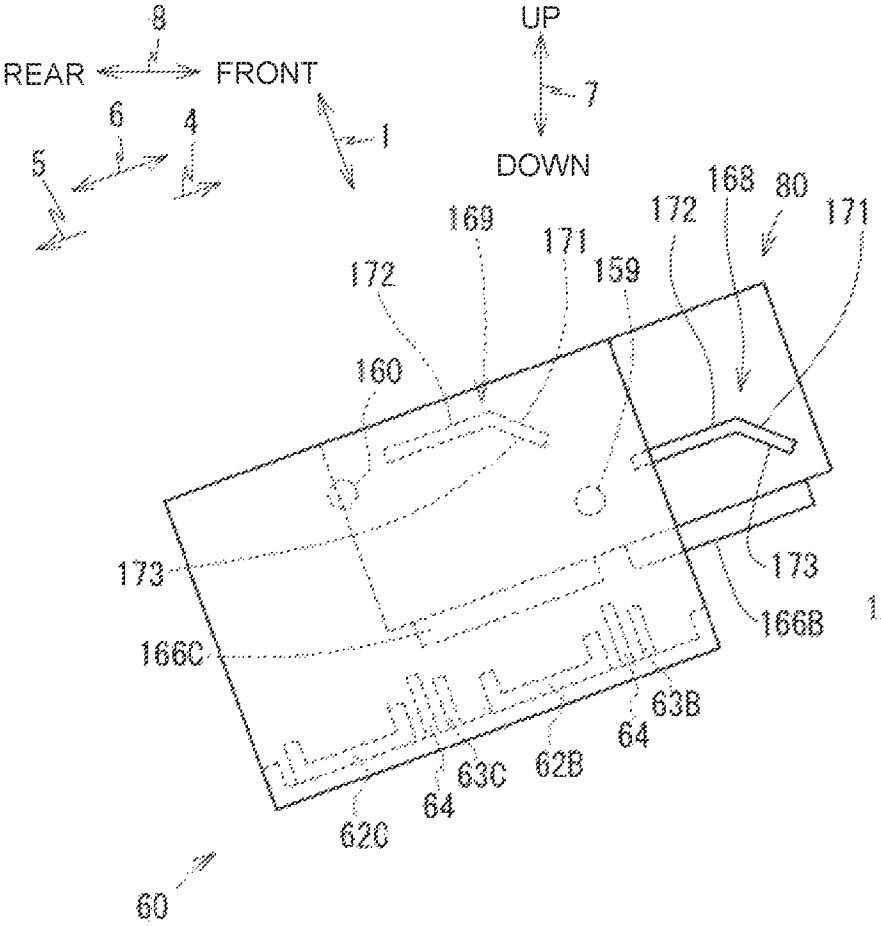

The controller 130 further moves the maintenance mechanism 60 in the frontward inclination orientation 5 from the position depicted in FIG. 23B. Accordingly, as depicted in FIG. 24A, the projections 159, 160 are positioned on the downstream side in the frontward inclination orientation 5 as compared with the second cam surfaces 172. By doing so, the wiper cleaning mechanism 80 is moved from the abutment position to the separated position by means of the urging force of the first urging member 164. Accordingly, the foams 166 are separated from the wipers 63.

The controller 130 moves the maintenance mechanism 60 in the backward inclination orientation 4 from the position depicted in FIG. 24A. By doing so, the projections 159, 160 abut against the third cam surfaces 173. When the maintenance mechanism 60 is further moved in the backward inclination orientation 4 from the position at which the projections 159, 160 abut against the third cam surfaces 173, the projections 159, 160 press the third cam surfaces 173. Accordingly, the movement of the maintenance mechanism 60 in the backward inclination orientation 4 is converted into the movement to allow the wiper cleaning mechanism 80 to be positioned from the separated position to the retracted position by the aid of the projections 159, 160 and the third cam surfaces 173. As a result, the wiper cleaning mechanism 80 is moved from the separated position toward the retracted position (see FIG. 24B). In other words, the third cam surfaces 173 guide the wiper cleaning mechanism 80 from the separated position to the retracted position. In this situation, the second urging members 165 are shrunk against the urging forces. When the wiper cleaning mechanism 80 is moved to the retracted position, then the projections 159, 160 pass through the third cam surfaces 173, and the projections 159, 160 are positioned at the back of the protrusions 168, 169. The maintenance mechanism 60 returns to the waiting position. Further, when the projections 159, 160 are separated from the protrusions 168, 169 in accordance therewith, the wiper cleaning mechanism 80 is moved from the retracted position to the separated position by means of the urging forces of the second urging members 165.

<Function and Effect of Image Recording Apparatus 100>

According to the embodiment described above, the wiper cleaning mechanism 80 is arranged at the position at which at least the part thereof is overlapped with the support member 46 in the direction (upward-downward direction 7) orthogonal to the lower surface 50 of the discharge module 49 under or below the support member 46, without being arranged in the vicinity of the head 38. Therefore, it is unnecessary to provide any space for the wiper cleaning mechanism 80 in the vicinity of the head 38.

Further, when the cleaning function of the wiper cleaning mechanism 80 is lowered on account of the repeated use of the wiper cleaning mechanism 80, the wiper cleaning mechanism 80, which has the lowered function, can be exchanged with a new wiper cleaning mechanism 80.

Further, when the wiper cleaning mechanism 80 is exchanged, the wiper cleaning mechanism 80 can be accessed from the position disposed over or above the image recording apparatus 100. Therefore, it is easy to exchange the wiper cleaning mechanism 80.

Further, the user can access the wiper cleaning mechanism 80 from the position disposed over or above the image recording apparatus 100, and the user can withdraw the wiper cleaning mechanism 80 from the support member 46 by allowing the wiper cleaning mechanism 80 to slide upwardly with respect to the support member 46 disposed at the upstanding position. Further, the user can install the wiper cleaning mechanism 80 to the support member 46 by allowing the wiper cleaning mechanism 80 to slide downwardly with respect to the support member 46 disposed at the upstanding position from the position disposed over or above the image recording apparatus 100. As described above, when the image recording apparatus 100 is configured so that the wiper cleaning mechanism 80 and the support member 46 disposed at the upstanding position can be accessed from the upward position from the outside, both of the direction of the access and the sliding direction of the wiper cleaning mechanism 80 with respect to the support member 46 can be the upward-downward direction 7. Accordingly, the wiper cleaning mechanism 80 can be easily exchanged.

Further, the sheet S is conveyed frontwardly, and the rotation forward end 51B of the support member 46 is positioned frontwardly as compared with the rotation proximal end 46A. Therefore, the wiper cleaning mechanism 80 can be accessed from the same side as the side on which the sheet S is conveyed in the conveying orientation 8A and the sheet S is discharged to the outside of the image recording apparatus 100, i.e., from the front side.

Further, the support member 46 is positioned frontwardly as compared with the head 38. Therefore, it is possible to prevent the rotating support member 46 from interfering with the head 38.

<Modified Embodiments>

In the embodiment described above, the first support mechanism 51 is rotated about the shaft 109A which is formed at the back portion and which extends in the left-right direction 9 so that the rotation forward end 51A, which is the front end, is moved vertically (upwardly/downwardly). However, the rotation of the first support mechanism 51 is not limited thereto. For example, the first support mechanism 51 may be rotated about the shaft 109A which is formed at the front portion and which extends in the left-right direction 9 so that the rotation forward end 51A, which is the back end, is moved vertically (upwardly/downwardly). Further, for example, the first support mechanism 51 may be rotated about the shaft 109A which is formed at the right portion and which extends in the front-back direction 8 so that the rotation forward end 51A, which is the left end, is moved vertically (upwardly/downwardly).

In the embodiment described above, the first support mechanism 51 is rotatable, while the second support mechanism 52 is fixed. In other words, the first support mechanism 51 is moved relatively with respect to the second support mechanism 52. However, conversely to the embodiment described above, the second support mechanism 52 may be rotatable, while the first support mechanism 51 may be fixed. In other words, the second support mechanism 52 may be moved relatively with respect to the first support mechanism 51. Further, one of the first support mechanism 51 and the second support mechanism 52 may be configured to be rotatable, while the other of the first support mechanism 51 and the second support mechanism 52 may be configured to be movable (for example, rotatable or slidable).

In the embodiment described above, the first upper surface 117A and the first upper surface 111A, the second upper surface 117B and the second upper surface 111B, and the upper surface 116A and the upper surface 110A are aligned linearly in the inclination direction 6 respectively. However, it is also allowable that the respective surfaces described above are not aligned linearly in the inclination direction 6 on condition that the maintenance mechanism 60 can be delivered between the second support mechanism 52 and the first support mechanism 51 disposed at the second rotation position. For example, the first upper surface 117A may extend in the inclination direction 6, while the first upper surface 111A may extend in a direction inclined with respect to the inclination direction 6.

In the embodiment described above, the driving force is applied from the first motor 55 to the gear 106 of the first support mechanism 51, and the driving force is applied from the second motor 56 to the gear 120 of the second support mechanism 52. In other words, the driving force is applied to the gears 106, 120 from the different motors. However, the driving force may be applied to the gears 106, 120 from an identical motor. In this case, a known driving stitching mechanism is arranged between the identical motor and the respective gears 106, 120. Thus, the controller 130 controls, for example, the presence or absence of the individual driving of each of the gears 106, 120, the driving start timing, and the driving stop timing.

In the embodiment described above, the head 38 is relatively moved in the upward-downward direction 7 with respect to the maintenance mechanism 60. However, the maintenance mechanism 60 may be relatively moved in the upward-downward direction 7 with respect to the head 38, or both of the head 38 and the maintenance mechanism 60 may be relatively moved in the upward-downward direction 7 with respect to one another.

In the embodiment described above, the wiper cleaning mechanism 80 is detachably held by the support member 46. However, the wiper cleaning mechanism 80 may be detachably held by any member (for example, the lower casing 32) other than the support member 46.

In the embodiment described above, the wiper cleaning mechanism 80 is arranged just under the support member 46. However, the position of the wiper cleaning mechanism 80 is not limited to the position disposed just under the support member 46. For example, the wiper cleaning mechanism 80 may be arranged over or above the support member 46. Further, for example, the wiper cleaning mechanism 80 may be arranged just under the first support mechanism 51, not at the position disposed just under the support member 46.

In the embodiment described above, the maintenance mechanism 60 is provided with the projections 159, 160, and the wiper cleaning mechanism 80 is provided with the protrusions 168, 169. However, conversely to the embodiment described above, the wiper cleaning mechanism 80 may be provided with the projections 159, 160, and the maintenance mechanism 60 may be provided with the protrusions 168, 169.

In the embodiment described above, the wiper cleaning mechanism 80 is relatively moved in the orthogonal direction 1 with respect to the maintenance mechanism 60. However, conversely to the embodiment described above, the maintenance mechanism 60 may be relatively moved in the orthogonal direction 1 with respect to the wiper cleaning mechanism 80. Further, both of the wiper cleaning mechanism 80 and the maintenance mechanism 60 may be configured to be movable in the orthogonal direction 1.

In the embodiment described above, the first support mechanism 51 is provided with the conveying belt 101 for conveying the sheet S. However, the first support mechanism 51 may be provided with any member other than the conveying belt 101 for conveying the sheet S, for example, a roller pair. Further, it is also allowable that the first support mechanism 51 is not provided with any member such as the conveying belt 101 or the like for conveying the sheet S.

Further, it is also allowable to provide any other conveyor (for example, a conveying belt) in place of the conveying roller pairs 36, 40.

In the embodiment described above, the wiper 63 slides against the lower surface 50 of the discharge module 49 during the process in which the maintenance mechanism 60 is moved in the front-back direction 8 from the maintenance position to the wiping position. Thus, the wiper 63 wipes out the lower surface 50. However, the means for wiping out the lower surface 50 is not limited thereto.

Figure 25B:
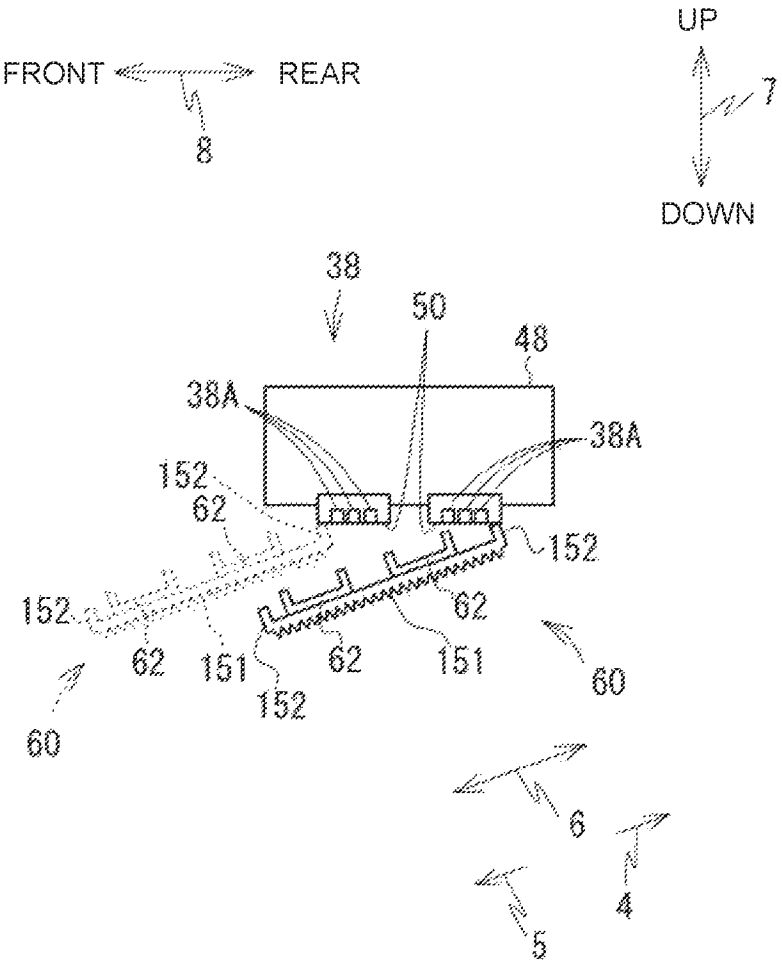
FIGS. 25A and 25B depict a sectional view schematically illustrating a head 38 and a maintenance mechanism 60 according to a modified embodiment.
Figure 25A:
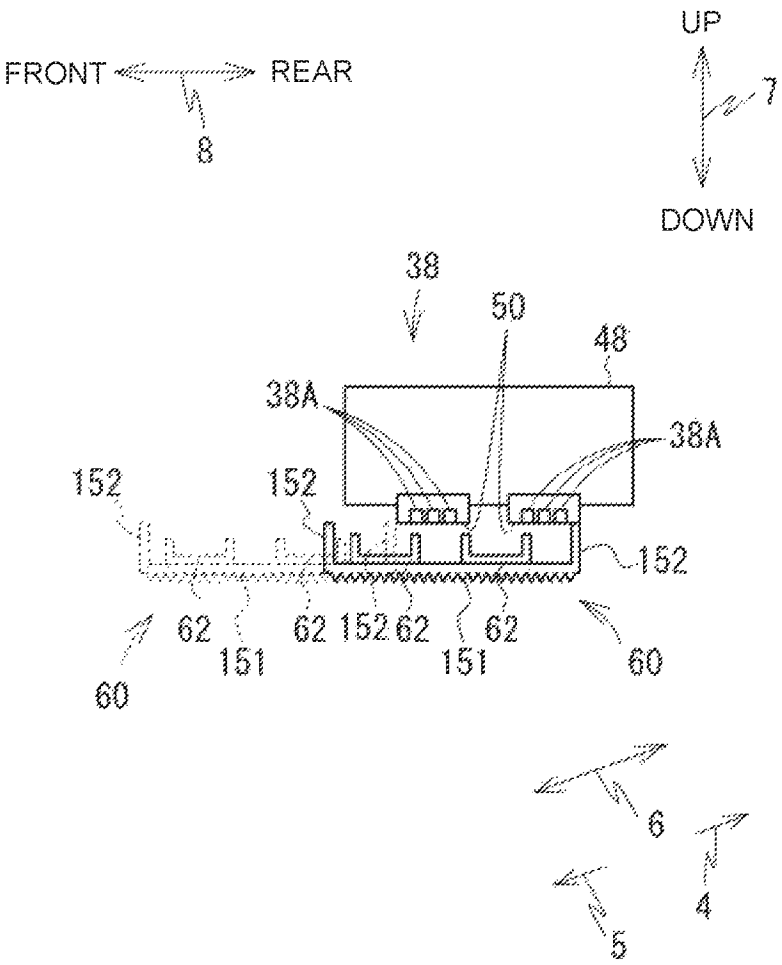

For example, as depicted in FIG. 25A, an edge plate 152 may wipe out the lower surface 50 by allowing the edge plate 152 of the main body 61 of the maintenance mechanism 60 to slide with respect to the lower surface 50 in the process in which the maintenance mechanism 60 is moved in the front-back direction 8 from the maintenance position (position indicated by solid lines in FIG. 25A) to the wiping position (position indicated by broken lines in FIG. 25A). In this case, it is necessary that the edge plate 152 is configured to be higher than the cap 62.

Further, for example, as depicted in FIG. 25B, an edge plate 152 may wipe out the lower surface 50 by allowing the edge plate 152 of the main body 61 of the maintenance mechanism 60 to slide with respect to the lower surface 50 in the process in which the maintenance mechanism 60 is moved in the front-back direction 8 from the position indicated by solid lines in FIG. 25B to the position indicated by broken lines in FIG. 25B in a state in which the maintenance mechanism 60 is moved obliquely so that the front end thereof is positioned under or below the back end (for example, in a state in which the maintenance mechanism 60 extends in the inclination direction 6). In this case, the edge plate 152 may be configured to be lower than the cap 62.

As described in the embodiment described above (see FIGS. 11 to 13) and the modified embodiment described above (see FIG. 25B), in the case of the configuration in which the maintenance mechanism 60 is arranged obliquely so that the front end thereof is positioned under or below the back end, the space, which is occupied by the maintenance mechanism 60, can be shortened in the front-back direction 8 as compared with the configuration in which the maintenance mechanism 60 is arranged in the front-back direction 8. Accordingly, it is possible to miniaturize the image recording apparatus 100 in the front-back direction 8.

Further, when the maintenance mechanism 60 is arranged obliquely so that the front end thereof is positioned under or below the back end, it is possible to increase the vacant space disposed obliquely downwardly at the back of the maintenance mechanism 60 in the internal space 32A of the lower casing 32. Accordingly, it is possible to miniaturize the image recording apparatus 100 in the upward-downward direction 7, while preventing the maintenance mechanism 60 from interfering with the roll member 37 (see FIG. 2) arranged obliquely downwardly at the back of the maintenance mechanism 60.

In other words, it is possible to simultaneously realize the miniaturization in both of the front-back direction 8 and the upward-downward direction 7 of the image recording apparatus 100.

In the embodiment described above, the system, in which the head 38 records the image on the sheet S, is the line head type ink-jet recording system. However, the present disclosure is not limited thereto. For example, it is also allowable to use a serial type ink-jet recording system.

In the embodiment described above, the sheet S is explained as an example of the medium. However, the medium, on which the image recording apparatus 100 records the image, is not limited to the sheet S. For example, the medium, on which the image is to be recorded by the image recording apparatus 100, may be, for example, a resin member to be utilized as a case or the like of a smartphone, a printed circuit board, a fabric (cloth), or a vinyl material.

In the embodiment described above, the ink is explained as an example of the liquid. However, for example, those corresponding to the liquid may include a pretreatment liquid which is discharged to the sheet S or the like prior to the ink when the image is recorded and water which is usable to wash the head 38.

In the embodiment described above, the image recording apparatus 100 records the image on the medium such as the sheet S or the like by means of the ink-jet recording system. However, the present disclosure is not limited to the ink-jet recording system. For example, the image recording apparatus 100 may record the image on the medium such the sheet S or the like by means of the electrophotographic system. In this case, the pretreatment liquid described above is discharged to the medium before recording the image on the medium.

What is claimed is:

1. A liquid discharge apparatus comprising:

a conveyor configured to convey a medium in a conveyance direction;

a support member located downstream, in the conveyance direction, of the conveyor and configured to define a part of a conveying passage for allowing the medium conveyed by the conveyor to pass therethrough and which supports the medium existing in the conveying passage;

a head including a nozzle surface on which a nozzle is opened;

a maintenance mechanism including a wiper configured to wipe the nozzle surface; and a wiper cleaner configured to clean the wiper, wherein the maintenance mechanism is movable to a wiping position and a cleaning position, wherein the maintenance mechanism faces the nozzle surface of the head and the wiper makes contact with the nozzle surface at the wiping position, and the wiper makes contact with the wiper cleaner at the cleaning position, and wherein a part of the wiper cleaner is below the support member and overlapped with the support member in a direction orthogonal to the nozzle surface.

2. The liquid discharge apparatus according to claim 1, further comprising a holder configured to hold the wiper cleaner detachably.

3. The liquid discharge apparatus according to claim 2, wherein the support member includes the holder, and wherein the support member is rotatable around a rotational axis and includes a rotation forward end and a rotation proximal end that is nearer to the rotational axis than the rotation forward end, the support member being rotatable to a first rotation position and a second rotation position, wherein the support member defines the part of the conveying passage at the first rotation position, and wherein the rotation forward end, in the state that the support member is disposed at the second rotation position, is positioned above the rotational forward end in the state that the support member is disposed at the first rotation position.

4. The liquid discharge apparatus according to claim 3, wherein the wiper is configured to be inserted to and removed from the holder in a direction, along which the rotation forward end and the rotation proximal end are aligned when the support member is disposed at the second rotation position.

5. The liquid discharge apparatus according to claim 3, wherein the conveyor is configured to convey the medium in a conveying orientation, and wherein when the support member is disposed at the first rotation position, the rotation forward end of the support member is positioned downstream, in the conveying orientation, of the rotation proximal end of the support member.

6. The liquid discharge apparatus according to claim 5, wherein the support member is positioned downstream, in the conveying orientation, of the head.

7. The liquid discharge apparatus according to claim 3, wherein the conveyor is configured to convey the medium in a conveyance direction, wherein the holder includes a holding surface configured to hold the wiper cleaner, and wherein, when the support member is disposed at the second rotation position, the holding surface of the holder extends in a direction intersecting with the conveyance direction.

8. The liquid discharge apparatus according to claim 7, wherein, when the support member is disposed at the second rotation position, the holding surface of the holder extends in a direction intersecting with the conveyance direction at an acute angle.

9. The liquid discharge apparatus according to claim 7, wherein the support member includes a facing surface facing the medium conveyed in the conveyance direction by the conveyor, wherein, when the support member is disposed at the first position, the facing surface of the support member is parallel to the conveyance direction, and wherein, when the support member is disposed at the second rotation position, the facing surface is orthogonal to the conveyance direction.

10. The liquid discharge apparatus according to claim 9, further comprising another support member located upstream of the supporting member in the conveyance direction, and including a first part facing the head and a second part located downstream of the first part in the conveyance direction, wherein the support member includes a roller pair configured to nip the medium conveyed by the conveyor, the roller pair including a portion located above the facing surface of the support member, and wherein, when the support member is disposed at the second rotation position, the portion of the roller pair is located above the second part of the another support member.

* * * * *